US011776713B2

(12) United States Patent
Aramaki et al.

(10) Patent No.: US 11,776,713 B2
(45) Date of Patent: Oct. 3, 2023

(54) WIRE HARNESS MANUFACTURING SYSTEM, CONVEYANCE DEVICE, ROUTING PROCESSING DEVICE, EXAMINATION DEVICE, AND WORK BOARD

(71) Applicants: FURUKAWA ELECTRIC CO., LTD., Tokyo (JP); FURUKAWA AUTOMOTIVE SYSTEMS INC., Shiga (JP)

(72) Inventors: Eiji Aramaki, Inukami-gun (JP); Koji Kato, Inukami-gun (JP); Mitsuyuki Akai, Inukami-gun (JP); Takayuki Okubo, Inukami-gun (JP); Nobuyuki Minami, Inukami-gun (JP)

(73) Assignees: FURUKAWA ELECTRIC CO., LTD., Tokyo (JP); FURUKAWA AUTOMOTIVE SYSTEMS INC., Shiga (JP)

( * ) Notice: Subject to any disclaimer, the term of this patent is extended or adjusted under 35 U.S.C. 154(b) by 36 days.

(21) Appl. No.: 17/128,931

(22) Filed: Dec. 21, 2020

(65) Prior Publication Data

US 2021/0110951 A1 Apr. 15, 2021

Related U.S. Application Data

(63) Continuation of application No. PCT/JP2019/024929, filed on Jun. 24, 2019.

(30) Foreign Application Priority Data

Jun. 22, 2018 (JP) ..... 2018-119199
Jun. 22, 2018 (JP) ..... 2018-119200
(Continued)

(51) Int. Cl.
*H01B 13/012* (2006.01)

(52) U.S. Cl.
CPC ..... *H01B 13/01209* (2013.01)

(58) Field of Classification Search
CPC ..... H01B 13/01209; H01B 13/01245
See application file for complete search history.

(56) References Cited

U.S. PATENT DOCUMENTS 3,099,439 A 7/1963 Haselton
5,535,788 A * 7/1996 Mori ..... H01R 43/28 140/92.1
(Continued)

FOREIGN PATENT DOCUMENTS

CN 1954275 A 4/2007
CN 101980034 A * 2/2011
(Continued)

OTHER PUBLICATIONS

European Communication pursuant to Article 9 4(3) EPC for European Application No. 19821947.9, dated Sep. 3, 2021.
(Continued)

*Primary Examiner* — Peter Dungba Vo
*Assistant Examiner* — Jose K Abraham
(74) *Attorney, Agent, or Firm* — Birch, Stewart, Kolasch & Birch, LLP

(57) ABSTRACT

A wire harness manufacturing system including a plurality of processing zones and configured to manufacture a wire harness by using a subassembly including a plurality of electrical lines to each of which a connection component is attached includes a conveyance device provided along the plurality of processing zones and including: work boards in a number at least corresponding to the number of the plurality of processing zones; a circulation conveyer configured to sequentially convey each work board in a horizontal state from an upstream side to a downstream side on a downstream conveyance path along the plurality of pro-
(Continued)

cessing zones and then return the work board from the downstream side to the upstream side on an upstream conveyance path; and a raiser configured to set the work board to a stand-up state in which one of edge parts extending in a conveyance direction of the work board is positioned on an upper side of the other edge part in the work board, and to set the work board in the stand-up state to the horizontal state.

23 Claims, 19 Drawing Sheets

(30) Foreign Application Priority Data

Jun. 22, 2018 (JP) ..... 2018-119201
Jun. 22, 2018 (JP) ..... 2018-119202
Jun. 22, 2018 (JP) ..... 2018-119203

(56) References Cited

U.S. PATENT DOCUMENTS

| | | | | |
|---|---|---|---|---|
| 2001/0019478 | A1* | 9/2001 | Izumi | H01B 13/01227 361/826 |
| 2001/0020538 | A1* | 9/2001 | Kinezuka | G01R 31/69 174/68.1 |
| 2007/0215435 | A1 | 9/2007 | Tachibana et al. | |
| 2016/0211056 | A1* | 7/2016 | Horiki | H01R 43/20 |
| 2018/0088550 | A1* | 3/2018 | Kawase | H01B 13/01236 |
| 2018/0108458 | A1* | 4/2018 | Maki | H01R 43/20 |

FOREIGN PATENT DOCUMENTS

| | | | | | |
|---|---|---|---|---|---|
| CN | 102854432 | A | | 1/2013 | |
| CN | 103499764 | A | * | 1/2014 | |
| EP | 3809426 | A1 | * | 4/2021 | H01B 13/01209 |
| JP | 6-302234 | A | | 10/1994 | |
| JP | 7-65652 | A | | 3/1995 | |
| JP | H08-222046 | A | | 8/1996 | |
| JP | 2001-324534 | A | | 11/2001 | |
| JP | 2001324534 | A | * | 11/2001 | G01R 31/045 |
| JP | 2004-186083 | A | | 7/2004 | |
| JP | 2007333399 | A | * | 12/2007 | H04N 7/185 |
| JP | 2008-277061 | A | | 11/2008 | |
| JP | 2014-206394 | A | | 10/2014 | |
| JP | 2015-185516 | A | | 10/2015 | |
| JP | 2015185516 | A | * | 10/2015 | |
| JP | 2016-66525 | A | | 4/2016 | |
| JP | 2016-207550 | A | | 12/2016 | |
| JP | 2017-91770 | A | | 5/2017 | |
| JP | 2017-188237 | A | | 10/2017 | |
| WO | WO 2007/144986 | A1 | | 12/2007 | |
| WO | WO-2018012288 | A1 | * | 1/2018 | B23P 21/00 |
| WO | WO 2018/074245 | A1 | | 4/2018 | |

OTHER PUBLICATIONS

International Preliminary Report on Patentability and Written Opinion of the International Searching Authority (Forms PCT/IB/373 and PCT/ISA/237) for International Application No. PCT/JP2019/024929, dated Dec. 22, 2020, with English translation of the Written Opinion.

International Search Report (Form PCT/ISA/210) for International Application No. PCT/JP2019/024929, dated Sep. 3, 2019, with English translation.

Chinese Office Action and Search Report for Chinese Application No. 201980041869.1, dated Dec. 3, 2021, with an English translation.

Chinese Office Action for corresponding Chinese Application No. 201980041869.1, dated Jul. 15, 2022, with English translation.

Chinese Office Action for corresponding Chinese Application No. 201980041869.1, dated Feb. 28, 2023, with English translation.

Unknown, "Light Industry Technical Equipment Manual," Complied: China Light Industry Federation, Beijing: Machinery Industry Press, vol. 4, Mar. 1996, ISBN 7-111-04936-5, 6 pages total, with English translation.

European Communication pursuant to Article 94(3) EPC for European Application No. 19821947.9, dated Mar. 14, 2023.

Chinese Office Action for corresponding Chinese Application No. 201980041869.1, dated Jun. 9, 2023, with English translation.

* cited by examiner

WIRE HARNESS MANUFACTURING SYSTEM, CONVEYANCE DEVICE, ROUTING PROCESSING DEVICE, EXAMINATION DEVICE, AND WORK BOARD

CROSS REFERENCE TO RELATED APPLICATIONS

The present application is a continuation application of International Patent Application No. PCT/JP2019/024929 filed on Jun. 24, 2019, which claims the benefit of Japanese Patent Application No. 2018-119199, Japanese Patent Application No. 2018-119200, Japanese Patent Application No. 2018-119201, Japanese Patent Application No. 2018-119202, and Japanese Patent Application No. 2018-119203, all filed on Jun. 22, 2018. The contents of these applications are incorporated herein by reference in their entirety.

BACKGROUND

Technical Field

The present disclosure relates to a wire harness manufacturing system, a conveyance device for the wire harness manufacturing system, a routing processing device, an examination device for the wire harness manufacturing system, and a work board for wire harness manufacturing.

Background

A wire harness is obtained by bundling a plurality of electrical lines to each of which a connection component such as a connector or a connection terminal is attached and spreading one end of each electrical line into a predetermined shape. The wire harness is wired, for example, in a vehicle body of an automobile and is used for electrical power supply to various electric instruments included in the automobile, communication of control signals between electric instruments, and the like.

In a wire harness manufacturing system configured to manufacture such a wire harness, a work board for routing of a plurality of electrical lines is used. A plurality of the work boards are used in the manufacturing system, fixed to an endless conveyer device, and move in circulation in the horizontal direction. Manufacturing (assembly) of the wire harness is completed while the work board moves in circulation. For example, there is a wire harness manufacturing system in which a work board for routing is conveyed to a conveyer device in a state of being obliquely standing up (refer to Japanese Patent Laid-Open No. 2017-188237, for example).

In addition, for example, there is a wire harness manufacturing device including a tilted wiring base on which a subassembly including a plurality of connectors mounted on a plurality of electrical lines are multifurcated and arranged, and a subassembly harness hook bar (refer to Japanese Patent Laid-Open No. 2004-186083, for example).

In a wire harness manufacturing process, whether a wire harness as a completed product having ended all fabrication processes satisfies requested specifications is examined before packaging of the wire harness.

For example, an image of the appearance of a wire harness is captured by an examination device provided in an examination area different from a manufacturing area in which the wire harness is assembled, and a visual examination of examining the kind, attachment state, damage (if any), and the like of an exterior component of the wire harness is performed based on the captured image (refer to Japanese Patent Laid-Open No. 2017-188237, for example).

Typically, during the conduction examination of a wire harness, it is necessary to examine conduction and opening among terminals of all connectors to reliably find connection failure between an electrical line and a terminal of a connector or the like at assembly. An automated examination technology using a computer is used to reduce the examination time. The automated examination technology is a technology of comparing input-output results of electric signals to each electrical line of an examination target wire harness with correct connection information of the examination target wire harness and determining whether connection between connector pins is appropriate based on the comparison result (refer to Japanese Patent Laid-Open No. 2014-206394, for example). It is said to be possible to thoroughly examine whether connection between connector pins of the examination target wire harness is appropriate by performing the conduction examination by using the automated examination technology.

SUMMARY

The conveyer device of Japanese Patent Laid-Open No. 2017-188237 circulates a work board (in Japanese Patent Laid-Open No. 2017-188237, a jig plate) through a plurality of manufacturing processes of a wire harness in the horizontal direction while the work board is constantly obliquely standing up. Access to the work board conveyed constantly in the state of being obliquely standing up is possible only from one side of the conveyer device, and operational efficiency in a manufacturing process decreases depending on the process. In addition, to perform appearance examination of a wire harness with the examination device indicated in Japanese Patent Laid-Open No. 2017-188237, it is needed to directly connect a connector of the wire harness to the examination device, and examination of conduction of the wire harness is performed, for example, after assembly and manufacturing of the wire harness on a work board in a manufacturing system. Thus, there has been demand for rationalization of wire harness manufacturing work by performing examination of a wire harness, which has been conventionally performed after the manufacturing process of the wire harness, in a wire harness manufacturing system (in-line). In addition, the operational efficiency of performing appearance examination potentially decreases, and improvement of the operational efficiency has been required.

In the wire harness manufacturing device of Japanese Patent Laid-Open No. 2004-186083, wiring work of a subassembly is performed by a worker. During the wiring work, the worker needs to check an instruction on an induction card at each work and place the subassembly onto a work board. In addition, a work time taken for placement work of a subassembly is not always constant, and there is room for improvement of operational efficiency.

In addition, even when the conduction examination of a wire harness is performed by using the automated examination technology of Japanese Patent Laid-Open No. 2014-206394, it is not easy for a worker to specify at which part of the wire harness connection defect or connection failure actually occurs when an inappropriate connection (error) between connector pins is detected. For example, in a typical automated examination technology, when an error is detected, character information indicating the connector pin at which the error was detected is displayed on a screen of a computer. However, it is not easy to specify a specific defect location with the character information only, and a significant amount of time is required to perform analysis that specifies the defect location in some cases.

Thus, the present disclosure is related to providing a wire harness manufacturing system that improves wire harness manufacturing efficiency and a conveyance device for the wire harness manufacturing system.

In accordance with one aspect of the present disclosure, there is provided a wire harness manufacturing system, which includes a plurality of processing zones and is configured to manufacture a wire harness by using a subassembly including a plurality of electrical lines to each of which a connection component is attached includes a conveyance device, the conveyance device including: work boards in a number at least corresponding to the number of the plurality of processing zones; a circulation conveyer configured to sequentially convey each work board in a horizontal state from an upstream side to a downstream side on a downstream conveyance path along the plurality of processing zones and then return the work board from the downstream side to the upstream side on an upstream conveyance path; and a raiser configured to set each work board to a stand-up state in which one of the edge parts extending in a conveyance direction of the work board is positioned on an upper side of the other edge part in the work board, and to set the work board in the stand-up state to the horizontal state.

In addition, it is preferable to include a routing processing device provided along the conveyance device and configured to place the subassembly onto each work board.

In addition, it is preferable that the raiser is provided at a position corresponding to the routing processing device.

In addition, it is preferable to include an image capturing device provided along the conveyance device and configured to capture an image of a wire harness on each work board.

In addition, it is preferable to include a conduction examination device provided along the conveyance device and configured to perform conduction examination of a wire harness on each work board.

In addition, it is preferable that the conveyance device includes a drive unit configured to drive the conveyer to intermittently convey the work boards.

In accordance with another aspect of the present disclosure, there is provided a conveyance device, which is for a wire harness manufacturing system, the wire harness manufacturing system including a plurality of processing zones and being configured to manufacture a wire harness by using a subassembly including a plurality of electrical lines to each of which a connection component is attached, is provided along the plurality of processing zones and includes work boards in a number at least corresponding to the number of the plurality of processing zones; a circulation conveyer configured to sequentially convey each work board in a horizontal state from an upstream side to a downstream side on a downstream conveyance path along the plurality of processing zones and then return the work board from the downstream side to the upstream side on an upstream conveyance path; and a raiser configured to set each work board to a stand-up state in which one of the edge parts extending in a conveyance direction of the work board is positioned on an upper side of the other edge part in the work board, and to set the work board in the stand-up state to the horizontal state.

In accordance with another aspect of the present disclosure, a routing processing device is configured to place, onto a work board of the wire harness manufacturing system according to the present disclosure, the subassembly, the routing processing device including: a body part capable of freely moving relative to the work board along a shape in which the wire harness is to be manufactured by the wire harness manufacturing system; and a mounting unit attached to a leading end of the body part and configured to receive the subassembly from a supply device that supplies the subassembly and place each connection component of the subassembly at a position on the work board along the shape of the wire harness.

In accordance with another aspect of the present disclosure, an examination device, which is used in a wire harness manufacturing system includes: a conduction examination execution unit configured to perform conduction examination between connection components included in an examination target wire harness; a determination unit configured to determine whether connection between connection components included in the examination target wire harness is appropriate based on an examination result of the conduction examination by the conduction examination execution unit; and a display control unit configured to cause a display device to display a determination result by means of the determination unit, and when a connection component, the connection of which is determined to be inappropriate by the determination unit exists, the display control unit causes the display device to display error information including information of the connection component, connection of which is determined to be inappropriate, together with wire harness image information that schematically illustrates the examination target wire harness.

In accordance with another aspect of the present disclosure, an examination device, which is used in a wire harness manufacturing system includes: an image capturing unit configured to capture an image of an examination target site of a wire harness; and a display unit configured to display an examination target image and an examination reference image in an identical display region based on examination target image data captured by the image capturing unit and examination reference image data as an examination reference for the examination target site, and the image capturing unit is provided in an examination zone downstream of a routing zone for wiring with the electrical line bundle among the plurality of work zones in a production line for the wire harness, through which one work board is sequentially moved to a plurality of work zones with an electrical line bundle as a fabrication target placed on the work board.

In accordance with another aspect of the present disclosure, a work board, which is for wire harness manufacturing using a subassembly including a plurality of electrical lines to each of which a connection component is attached is used in a wire harness manufacturing system and includes an examination jig connected with an examination wire for conduction examination of the wire harness, and the connection component of the subassembly is connected with the examination jig.

According to the present disclosure, it is possible to improve wire harness manufacturing efficiency.

DETAILED DESCRIPTION

The following describes preferable embodiments of the present disclosure with reference to the accompanying drawings. Each embodiment described below is an example and may have various kinds of embodiments in the scope of the present disclosure. The following initially describes a first embodiment of the present disclosure with reference to FIGS. 1 to 9. The first embodiment of the present disclosure relates to a wire harness manufacturing system and a conveyance device for the wire harness manufacturing system.

Figure 1:
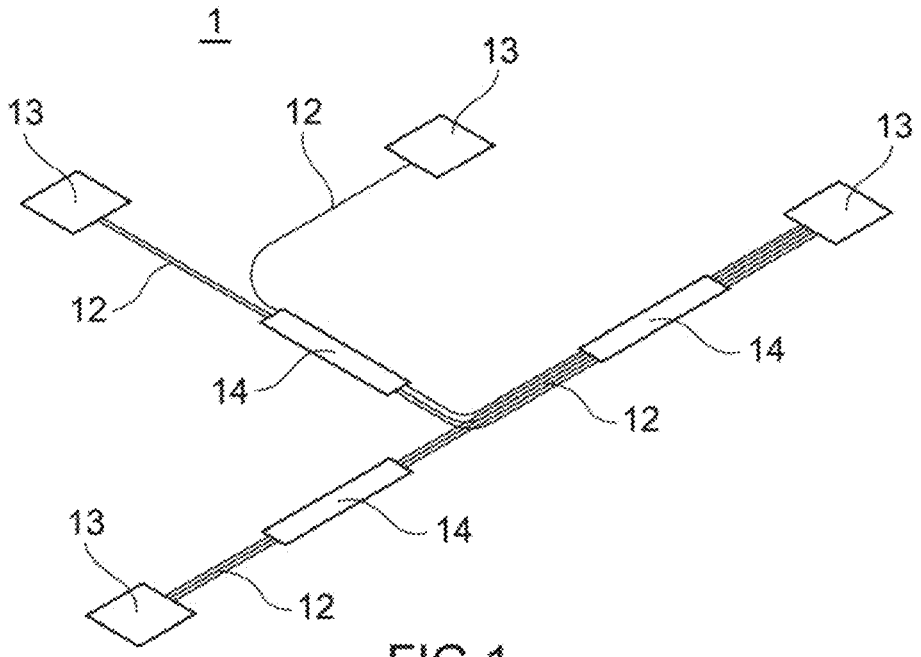
FIG. 1 is a perspective view schematically illustrating an exemplary wire harness manufactured in a first embodiment of the present disclosure.
Figure 2:
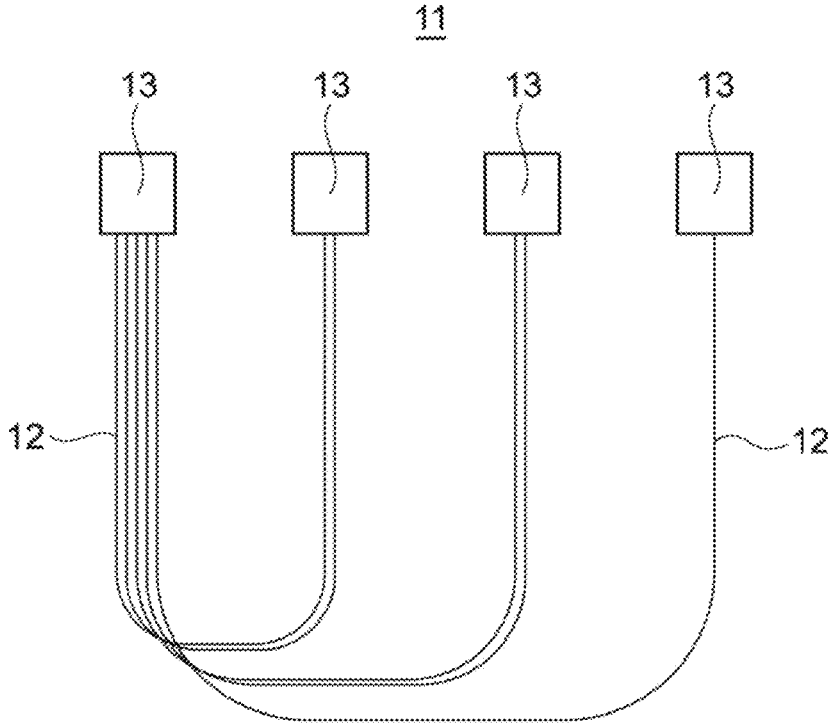
FIG. 2 is a diagram schematically illustrating a subassembly used in manufacturing of a wire harness according to the first embodiment of the present disclosure.
Figure 3:
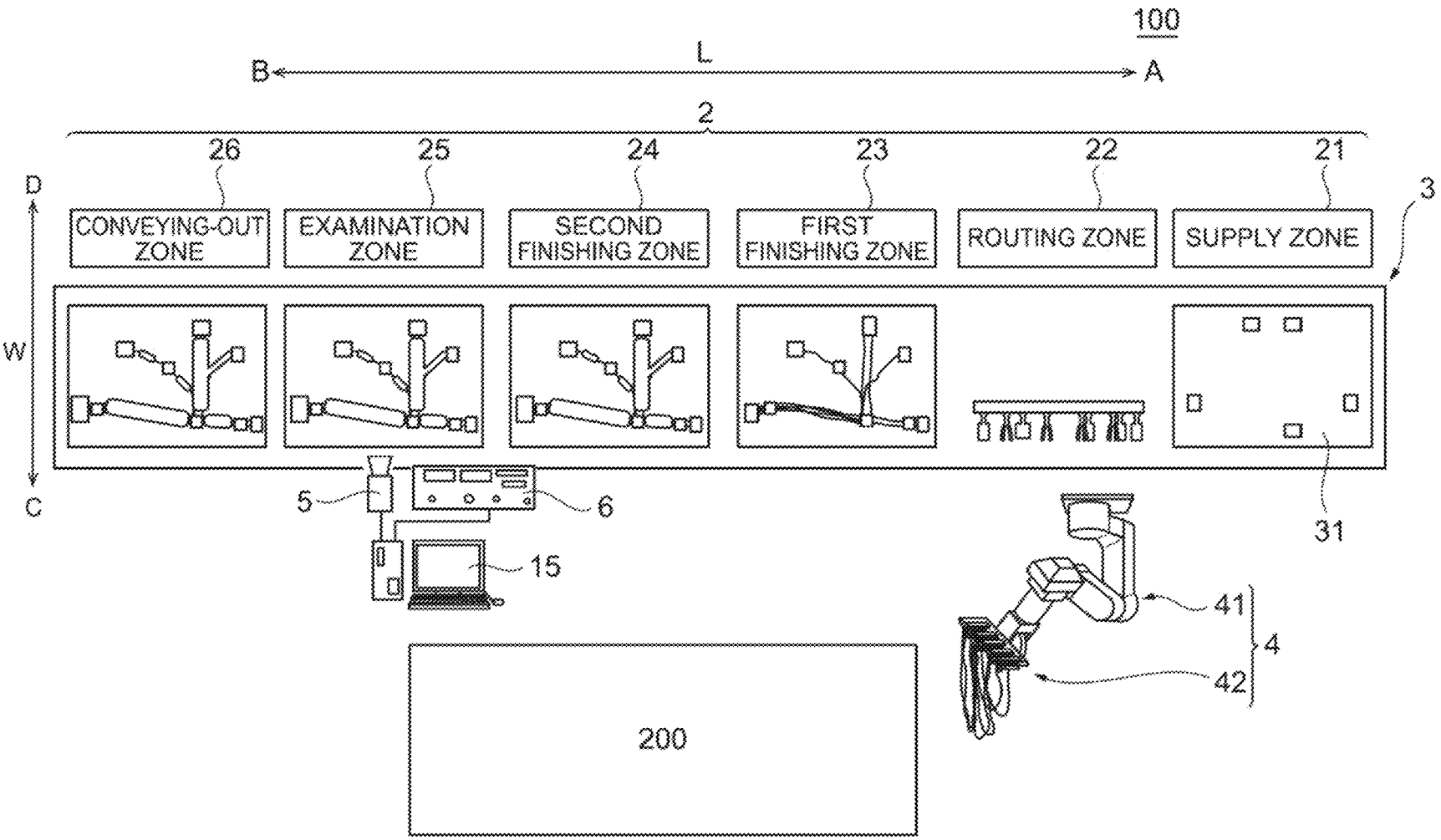
FIG. 3 is a schematic diagram for description of the configuration of a wire harness manufacturing system according to the first embodiment of the present disclosure.
Figure 4:
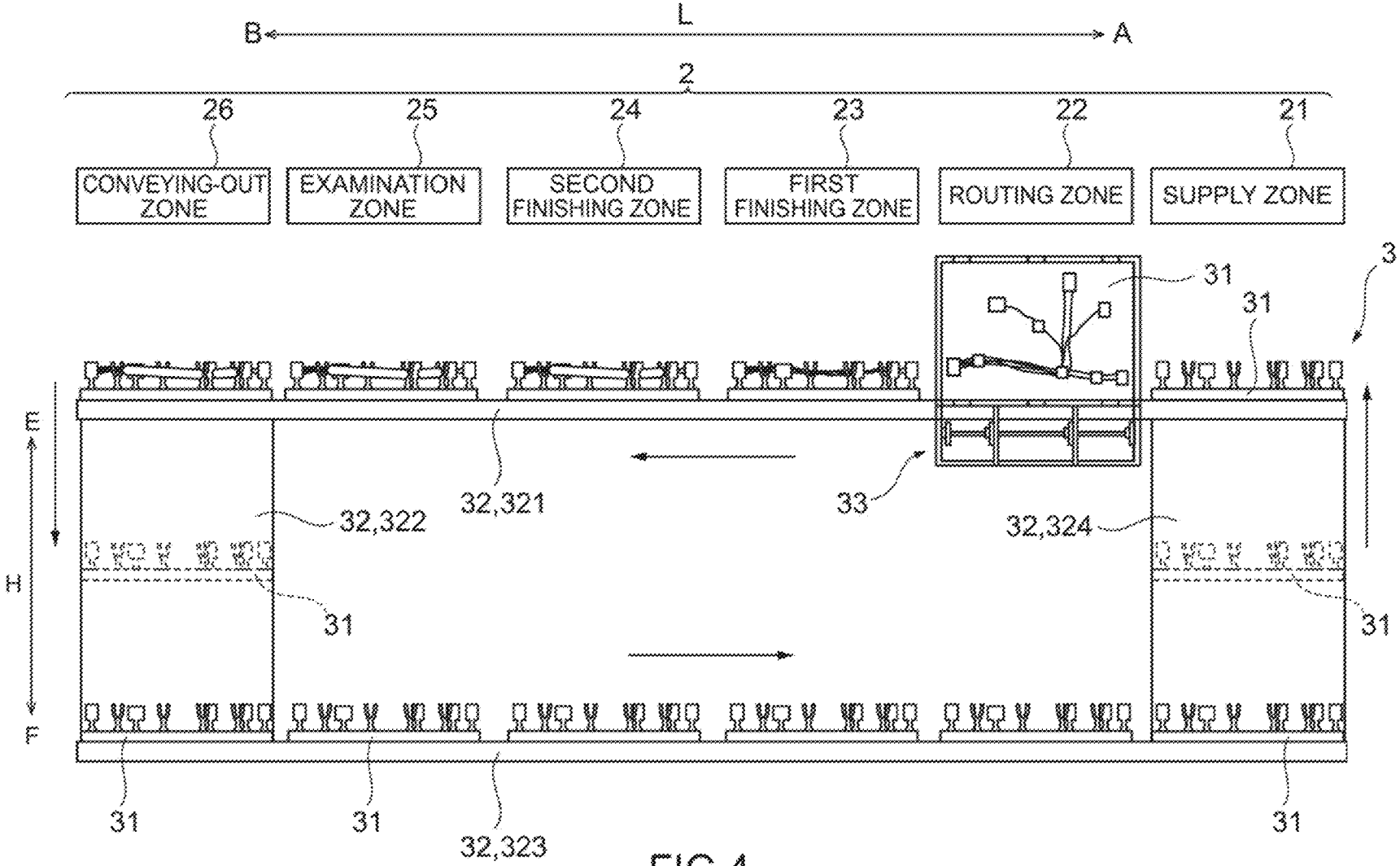
FIG. 4 is a schematic diagram for description of the configuration of a circulation conveyer according to the first embodiment of the present disclosure.
Figure 5:
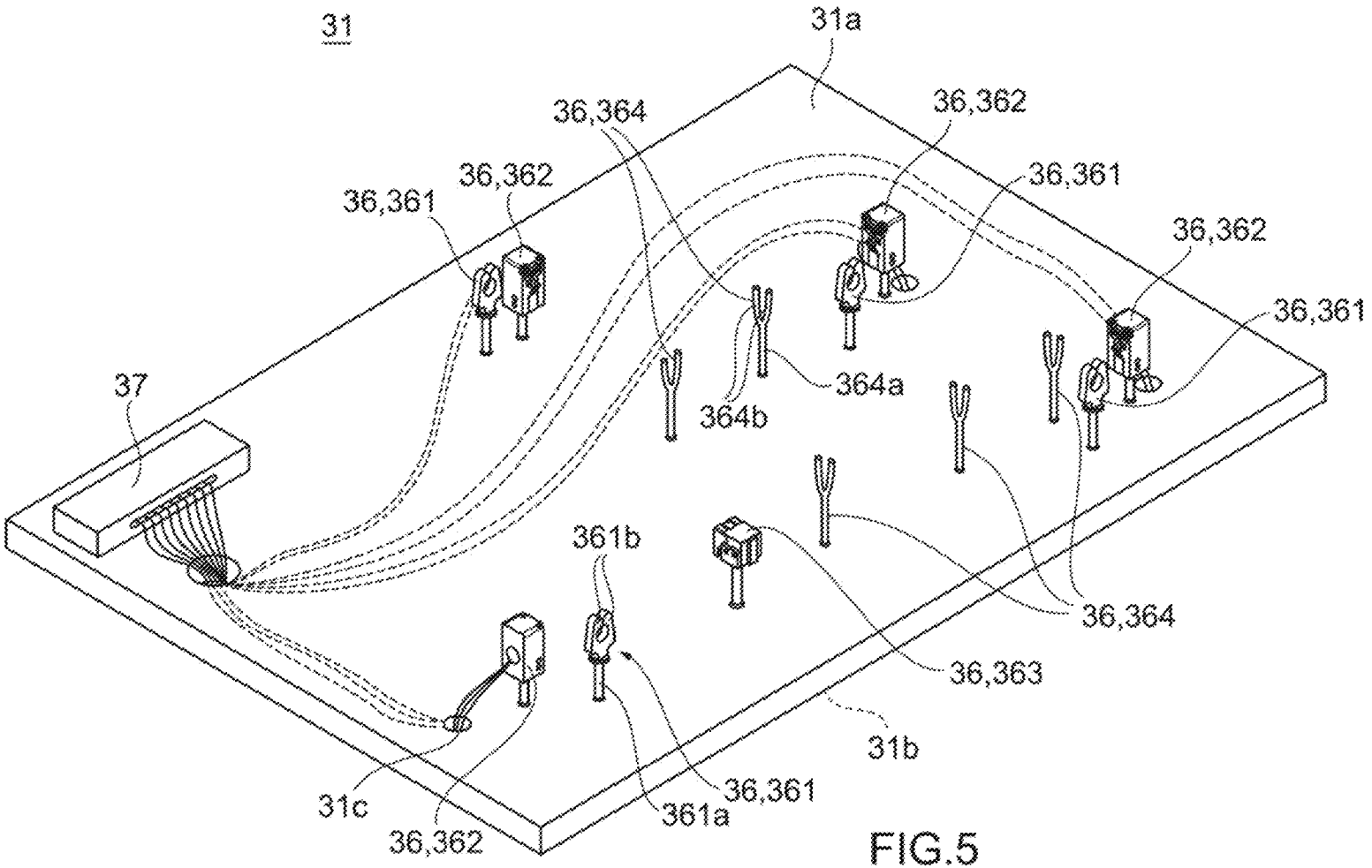
FIG. 5 is a schematic perspective view for description of the configuration of a work board according to the first embodiment of the present disclosure.
Figure 6:
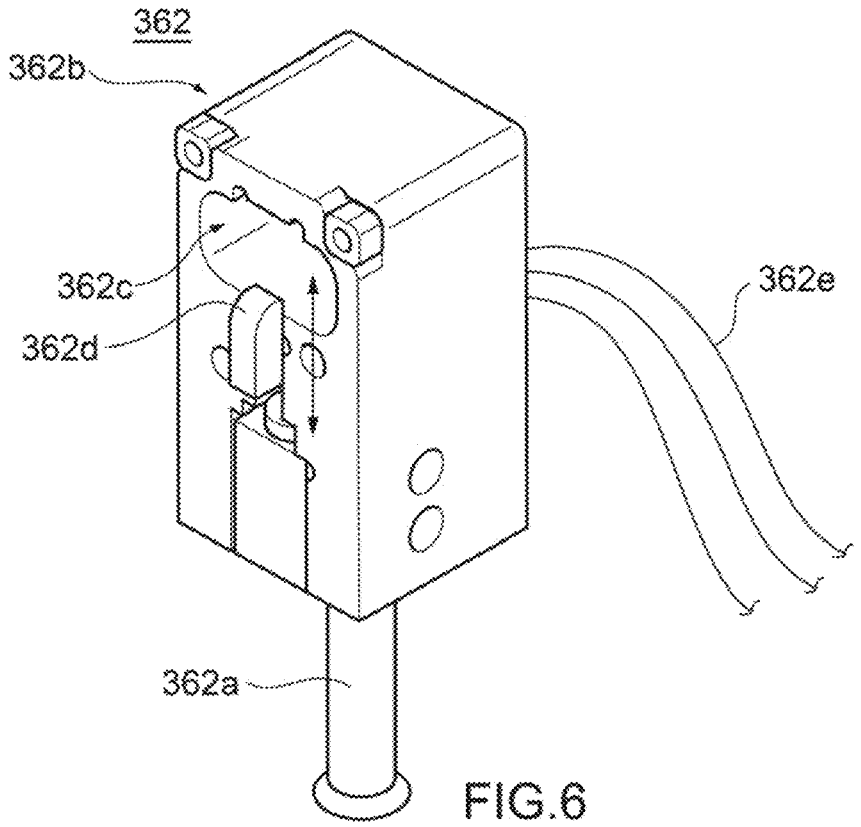
FIG. 6 is a diagram for description of the configuration of a jig provided to the work board according to the first embodiment of the present disclosure.
Figure 7:
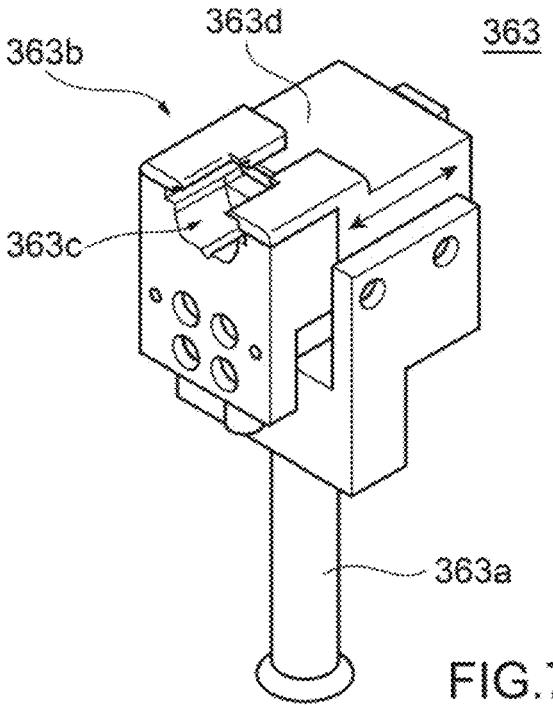
FIG. 7 is a diagram for description of the configuration of another jig provided to the work board according to the first embodiment of the present disclosure.
Figure 8:
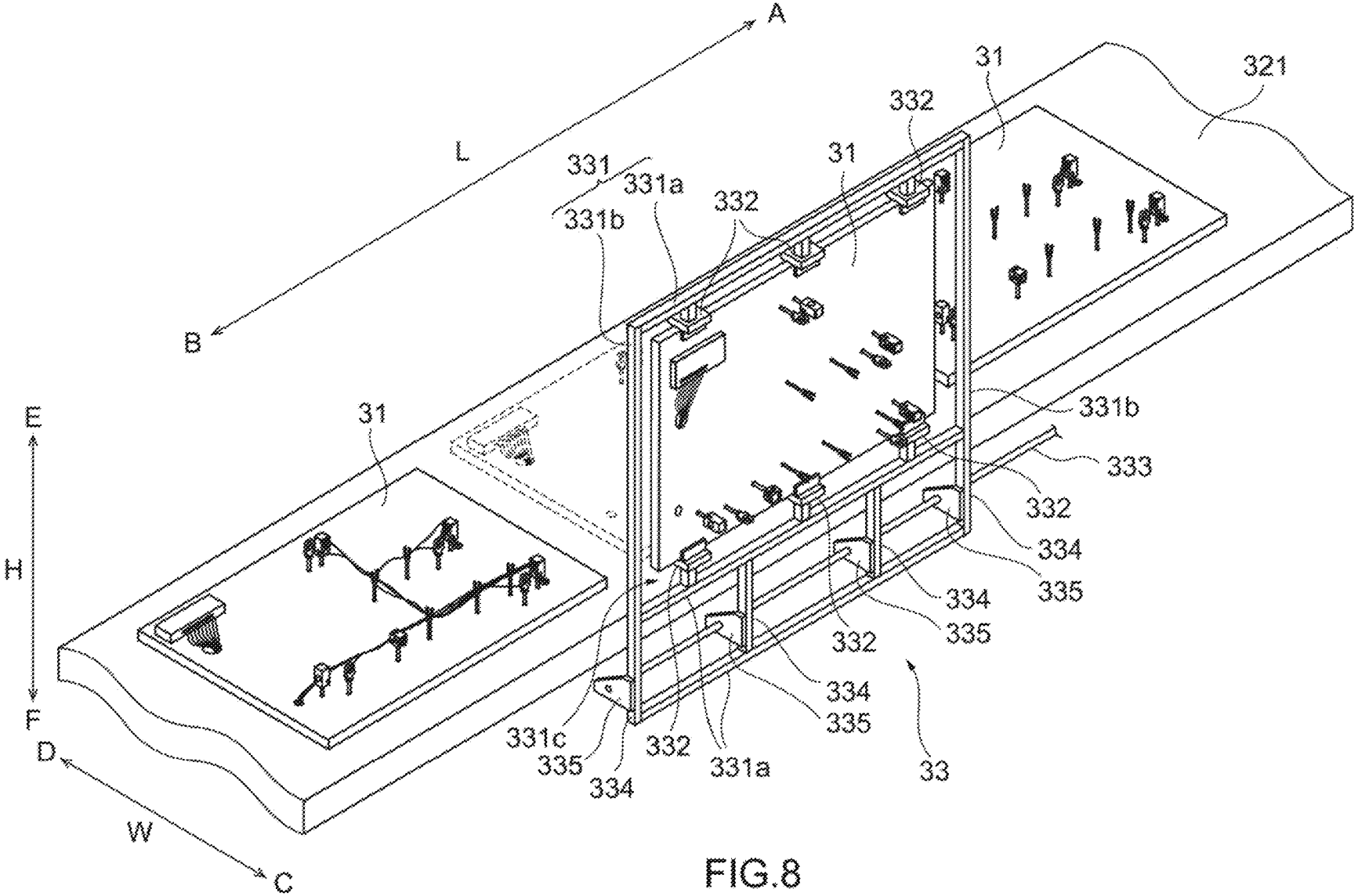
FIG. 8 is a schematic perspective view for description of the configuration of a raiser according to the first embodiment of the present disclosure.
Figure 9:
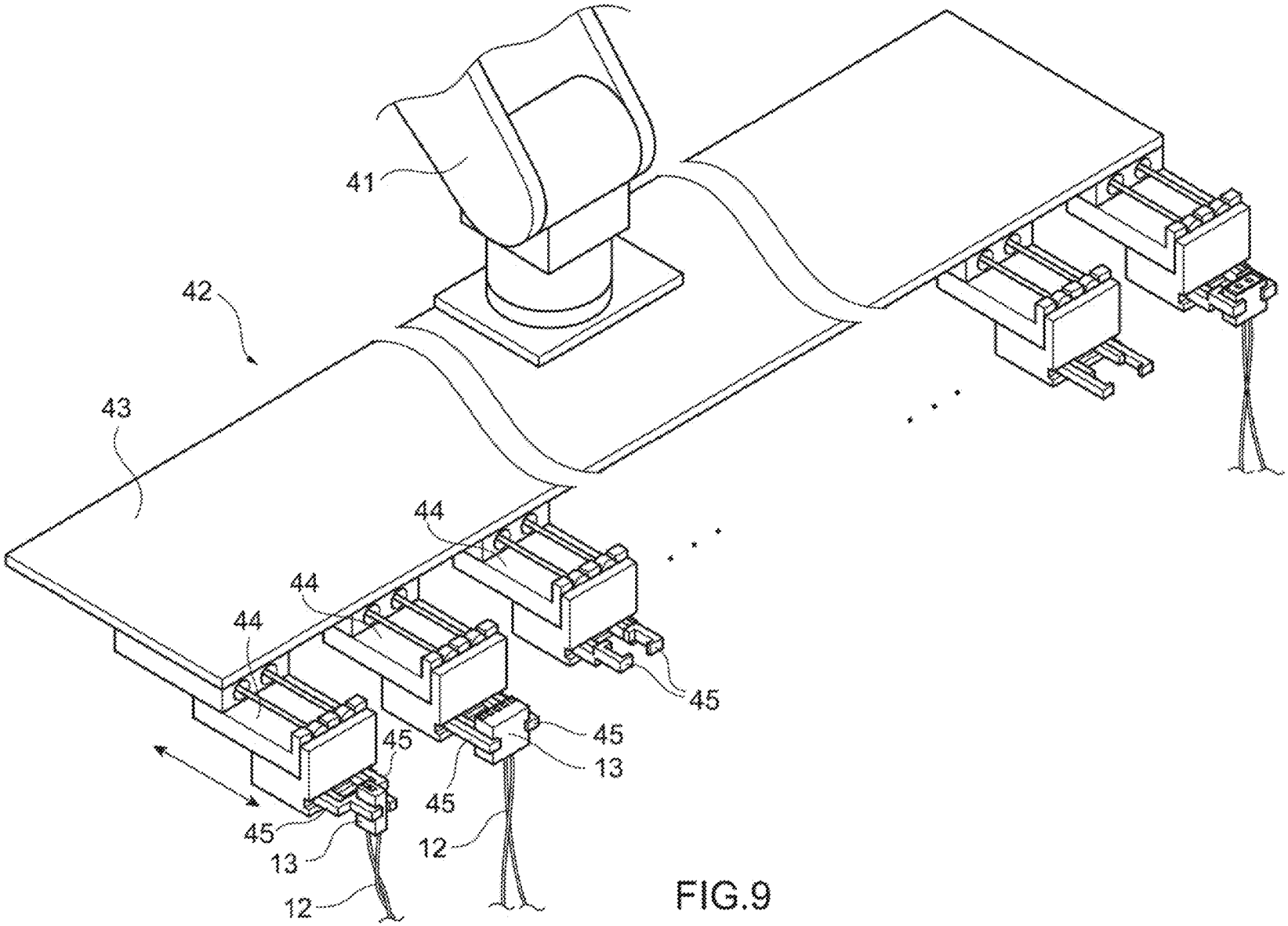
FIG. 9 is a diagram for description of the configuration of a mounting unit of a routing processing device according to the first embodiment of the present disclosure.

FIG. 1 is a diagram schematically illustrating an exemplary wire harness to be manufactured. FIG. 2 is a diagram schematically illustrating a subassembly used in manufacturing of the wire harness. FIG. 3 is a schematic diagram for description of the configuration of a wire harness manufacturing system. FIG. 4 is a schematic diagram for description of the configuration of a circulation conveyer. FIG. 5 is a schematic perspective view for description of the configuration of a work board. FIG. 6 is a diagram for description of the configuration of a connector jig provided to the work board. FIG. 7 is a diagram for description of the configuration of a clamp jig provided to the work board. FIG. 8 is a schematic perspective view for description of the configuration of a raiser. FIG. 9 is a diagram for description of the configuration of a mounting unit of a routing processing device.

Note that, for the objective of description, a length direction (also referred to as a "conveyance direction") of the wire harness manufacturing system is denoted by "L", an upstream side is denoted by "A", and a downstream side is denoted by "B". In addition, a width direction of the wire harness manufacturing system is denoted by "W", a left side and a right side when the downstream side B is viewed from the upstream side A are denoted by "C" and "D", respectively. In addition, an up-down direction of the wire harness manufacturing system is denoted by "H", an upper side is denoted by "E", and a lower side is denoted by "F".

<Configuration of Wire Harness Manufacturing System>

A wire harness manufacturing system 100 according to the present embodiment is for example, a manufacturing device for a wire harness 1 applied to an automobile. The wire harness 1 manufactured by the wire harness manufacturing system 100 is used to supply electrical power to various electric instruments mounted on the automobile, communication between the electric instruments, and the like.

As illustrated in FIGS. 1 and 2, the wire harness 1 is formed of a subassembly 11. The subassembly 11 includes a plurality of electrical lines 12 with terminals, and a plurality of connectors 13 provided at ends of the respective electrical lines 12 and connected with various electric instruments. The wire harness 1 is formed as the electrical lines 12 are bundled with each other by an exterior component 14 such as a grommet, a protection member, a protector, a tape, or a banding band. Each electrical line 12 is wired to have a predetermined bend shape, and the wire harness 1 spreads in a complicated branching structure (multifurcating shape) as a whole. Note that each connector 13 is an exemplary connection component, and a case in which, for example, the connection component is a connection terminal or the like is also included in examples of the embodiment.

The wire harness 1 is manufactured by providing predetermined processing on the subassembly 11 at stages in a plurality of processing zones 2. A series of works until the wire harness 1 is manufactured, for example, assembly of the wire harness 1 and predetermined examination of the wire harness 1 are included in "processing", and stages until the wire harness 1 is conveyed out of the wire harness manufacturing system 100 are included in "wire harness manufacturing".

As illustrated in FIG. 3, the wire harness manufacturing system 100 of the wire harness 1 includes the plurality of processing zones 2 in which manufacturing processing on the wire harness 1 is performed, a conveyance device 3 provided along all processing zones 2, a routing processing device (processing device) 4 configured to wire the subassembly 11 in a multifurcating shape in a predetermined processing zone 2, an image capturing device (processing device) 5 configured to capture an image of the wire harness 1 in a predetermined processing zone 2, and a conduction examination device (processing device) 6 configured to examine conduction of the wire harness 1 in a predetermined processing zone 2.

[Processing Zone]

The processing zones 2 include a supply zone 21 in which a work board 31 to be described later is supplied, a routing zone 22 that is positioned on the downstream side B of the supply zone 21 in the conveyance direction L and in which the subassembly 11 is placed onto the work board 31, a first finishing zone 23 that is positioned on the downstream side B of the routing zone 22 and in which the electrical lines 12 of the subassembly 11 are twisted together, a second finishing zone 24 that is positioned on the downstream side B of the first finishing zone 23 and in which the plurality of electrical lines 12 twisted together are bundled, an examination zone 25 that is positioned on the downstream side B of the second finishing zone 24 and in which the wire harness 1 is examined, and a conveying-out zone 26 that is positioned on the downstream side B of the examination zone 25 and in which the manufactured wire harness 1 is conveyed out of the wire harness manufacturing system 100 to another process.

The supply zone 21, the routing zone 22, the first finishing zone 23, the second finishing zone 24, the examination zone 25, and the conveying-out zone 26 (hereinafter also referred to as the "processing zones 21 to 26" or the like) are disposed along the conveyance device 3 in the order of manufacturing processes of the wire harness 1.

[Conveyance Device]

As illustrated in FIG. 4, the conveyance device 3 is formed as a circulation conveyer (hereinafter also referred to as the "circulation conveyer 3") configured to circulate in the up-down direction H. The circulation conveyer 3 includes the work boards 31 in a number corresponding to the number of the processing zones 21 to 26, a conveyer 32 configured to sequentially convey each work board 31 to the processing zones 21 to 26, a raiser 33 configured to stand up and lay down the work board 31, a drive unit (not illustrated) configured to intermittently drive the conveyer 32, and a control unit (not illustrated) configured to control the drive unit.

(Work Board)

Each work board 31 is formed of a plate material of a rectangular shape in plan view, is a table on which the subassembly 11 is spread and disposed along a predetermined routing path and that is used for assembling the wire harness 1 by processing the subassembly 11 in the processing zones 22 to 25, and is also called an ASSY board. The work board 31 is placed on the conveyer 32 in the horizontal state so that the work board 31 is sequentially conveyed along the plurality of processing zones 21 to 26 while a work surface 31*a* as a surface to be provided with manufacturing processing for manufacturing the wire harness 1 is placed on the upper side E.

Note that the "horizontal state" includes the state (hereinafter also referred to as a "substantially horizontal state") of being laid on the circulation conveyer 3 such that approach to the work board 31 in the wire harness manufacturing system 100 from the right and left sides C and D is enabled to perform work processing.

As illustrated in FIG. 5, the predetermined routing path (not illustrated) of the subassembly 11 is printed on the work surface 31*a* of the work board 31, as a surface on which the subassembly 11 is placed. The work board 31 includes a plurality of jigs 36 configured to hold the subassembly 11 being placed along the routing path, and an integrated terminal mount 37.

Each jig 36 is erected on the work surface 31*a*. The jigs 36 include a receiving jig 361 on which the subassembly 11 is hung by the routing processing device 4, a connector jig 362 electrically connected with the corresponding connector 13, a clamp jig 363 configured to grasp the wire harness 1 at the corresponding exterior component 14, and a support jig 364 configured to support the wire harness 1 at the corresponding electrical line 12. The receiving jig 361 and the connector jig 362 are disposed close to each other. Note that the number of the jigs 361 to 364 is not particularly limited. In addition, the receiving jig 361 and the connector jig 362 may be disposed separately from each other as appropriate as long as the correspondence relation between the receiving jig 361 and the connector jig 362 is clear and the shape of the wire harness 1 to be manufactured does not change and no excessive tensile load is applied to each electrical line 12 when the connector 13 is attached to the connector jig 362.

The receiving jig 361 includes a bar member 361*a* attached to the work surface 31*a* at one end, and two leg parts 361*b* that have a two-fork shape and on which the subassembly 11 is hung at the other end. The leg parts 361*b* of the two-fork shape contact each other to form a closed state of an annular shape at a leading end part on a side opposite to the bar member 361*a* side, and the leg parts 361*b* are formed to be elastically opened and closed.

As illustrated in FIG. 6, the connector jig 362 includes a bar member 362*a* attached to the work surface 31*a* at one end and a connector part 362*b* having a substantially rectangular parallelepiped shape and connected with the corresponding connector 13 of the subassembly 11 at the other end. The connector part 362*b* includes an engagement port part 362*c* that has a concave shape and is engaged with the connector 13 of the subassembly 11, a lock click 362*d* configured to lock the connector 13 housed in the engagement port part 362*c*, a cancellation mechanism (not illustrated), and an examination wire 362*e*.

The engagement port part 362*c* is formed at one surface of the connector part 362*b* in a direction along the work surface 31*a* of the work board 31 in a state in which the connector jig 362 is attached to the work board 31. A plurality of conduction pins (not illustrated) that are electrically connected with the connector 13 are provided inside the engagement port part 362*c*.

The lock click 362*d* is provided at a peripheral part of the engagement port part 362*c* and configured to freely protrude and retract relative to the engagement port part 362*c*. In a state in which the cancellation mechanism does not act, a leading end of the lock click 362*d* overlaps with the engagement port part 362*c* so that the lock click 362*d* is engaged with the connector 13 housed in the engagement port part 362*c* and prevents removal of the connector 13 from the engagement port part 362*c*. In a state in which the cancellation mechanism acts, the leading end part of the lock click 362*d* does not overlap with the engagement port part 362*c*.

The cancellation mechanism includes an air cylinder (not illustrated) configured to cancel the engagement state of the lock click 362*d* and the connector 13. The air cylinder has one end directly or indirectly coupled with the lock click 362*d* and has the other end connected with, for example, a compressor configured to supply compression air on a back surface 31*b* side as a surface of the work surface 31*a* on the back side.

The examination wire 362*e* is connected with each conduction pin on a side of the connector part 362*b*, which is opposite to a side on which the connector 13 is inserted, and is routed from the connector part 362*b* to the back surface 31*b* side through a hole 31*c* formed at the work board 31 near the connector jig 362. The examination wire 362*e* from the connector jig 362 is connected with the integrated terminal mount 37.

As illustrated in FIG. 7, the clamp jig 363 includes a bar member 363*a* attached to the work surface 31*a* at one end, and a clamp member 363*b* configured to grasp the exterior component 14 at the other end. The clamp member 363*b* includes a holding recess 363*c* configured to hold the exterior component 14, a cover part 363*d* that is movable and covers the holding recess 363*c*, and a cancellation mechanism (not illustrated) configured to allow the cover part 363*d* to move.

The holding recess 363*c* is opened, at one surface of the clamp member 363*b*, toward a side opposite to the work surface 31*a* in the direction along the work surface 31*a* of the work board 31. The cover part 363*d* is configured to be slidable in the direction along the work surface 31*a* of the work board 31, covers the holding recess 363*c* in a state in which the cancellation mechanism does not act, and opens the holding recess 363*c* toward the side opposite to the work surface 31*a* in a state in which the cancellation mechanism acts.

The cancellation mechanism includes an air cylinder (not illustrated) configured to cause the cover part 363*d* to move from a position at which the holding recess 363*c* is covered to a position at which the holding recess 363*c* is opened. The air cylinder has one end directly or indirectly coupled with the cover part 363*d* and has the other end connected with, for example, a compressor configured to supply compression air on the back surface 31*b* side as the surface of the work surface 31*a* on the back side. Note that the compressors to which the air cylinder of the clamp jig 363 and the air cylinder of the connector jig 362 are connected may be the same compressor or different compressors.

The support jig 364 includes a bar member 364*a* attached to the work surface 31*a* at one end, and two leg parts 364*b* that have a two-fork shape and on which the electrical line 12 is hung at the other end.

(Conveyer)

Back in FIGS. 3 and 4, the conveyer 32 includes a downstream conveyance unit 321, a move-down conveyance unit 322, an upstream conveyance unit 323, and a move-up conveyance unit 324 to sequentially convey the work board 31 from the upstream side A to the downstream side B on a downstream conveyance path as a conveyance path along the plurality of processing devices 4, 5, and 6 and then return the work board 31 from the downstream side B to the upstream side A on an upstream conveyance path as a conveyance path on the lower side F of the downstream conveyance path. The downstream conveyance unit 321, the move-down conveyance unit 322, the upstream conveyance unit 323, and the move-up conveyance unit 324 are continuous with each other and configured to circulate the work board 31 in the up-down direction H.

The downstream conveyance unit 321 extends along the processing zones 21 to 26 to sequentially convey the work board 31 from the supply zone 21 toward the conveying-out zone 26 in the conveyance direction L. The downstream conveyance unit 321 supports the work board 31 on the back surface 31*b* side and sequentially conveys the work board 31 along the processing zones from the upstream side A to the downstream side B.

The move-down conveyance unit 322 extends toward the lower side F from an end part of the downstream conveyance unit 321 on the conveying-out zone 26 side to the upstream conveyance unit 323 to convey the work board 31 from the conveying-out zone 26 to the upstream conveyance unit 323 provided at a predetermined interval on the lower side F of the downstream conveyance unit 321 while the work surface 31*a* faces towards the upper side E.

The upstream conveyance unit 323 extends from a lower end part of the move-down conveyance unit 322 to the supply zone 21 to return the work board 31 to the supply zone 21. The upstream conveyance unit 323 extends on the lower side F of the downstream conveyance unit 321 at the predetermined interval in parallel.

The move-up conveyance unit 324 is formed toward the upper side E from an end part of the upstream conveyance unit 323 on the supply zone 21 side to the downstream conveyance unit 321 to convey the work board 31 from the upstream conveyance unit 323 to the downstream conveyance unit 321 while the work surface 31*a* faces towards the upper side E.

Note that, when the work board 31 is detachably fixed to the conveyance units 321 to 324, the work board 31 may be conveyed by the conveyer 32 so that the work surface 31*a* faces towards the lower side F at the upstream conveyance unit 323.

(Raiser)

The raiser 33 is provided in a predetermined one of the processing zones 21 to 26 at the downstream conveyance unit 321 of the conveyer 32, specifically, is provided to the routing processing device 4 to be described later in the routing zone 22. The raiser 33 stands up and sets the work board 31 being in a substantially horizontal state to a stand-up state in which one of edge parts of the work board 31 extending in the conveyance direction L of the work board 31 is positioned on the upper side E of the other edge part, and lays down and sets the work board 31 being in the stand-up state into a substantially horizontal state.

As illustrated in FIG. 8, the raiser 33 includes a frame 331 made of steel and surrounding edges of the work board 31, a grasping body 332 provided to the frame 331 and configured to grasp at least part of an edge part of the work board 31, and a drive shaft 333 coupled with the frame 331 and configured to rotate the frame 331.

The frame 331 includes three first frame parts 331*a* extending in the length direction L at predetermined intervals, and a pair of second frame parts 331*b* each coupling the first frame parts 331*a* with one another at their end parts. The first frame part 331*a* at the middle among the three first frame parts 331*a* is provided closer to the first frame part 331*a* positioned on the lower side F of a middle part in an extension direction of the second frame parts 331*b* in a state in which the frame 331 is standing up. In the frame 331, a space 331*c* surrounding the work board 31 is defined by the first frame part 331*a* positioned on the upper side E in a state in which the frame 331 is standing up, the first frame part 331*a* at the middle, and the second frame parts 331*b*.

A plurality of coupling parts 334 for coupling the frame 331 to the drive shaft 333 are provided between the first frame parts 331*a* at the middle and on the lower side F. Each coupling part 334 includes an arm 335 having one end substantially vertically attached to the coupling part 334. The other end of the arm 335 is fixed to the drive shaft 333 not to rotate relative to the drive shaft 333.

A plurality of the grasping bodies 332 are provided at predetermined intervals to the first frame parts 331*a* on the upper side E and at the middle to grasp the edge part of the work board 31 extending in the length direction L.

The drive shaft 333 is integrally coupled with the other end of the arm 335 of each coupling part 334 to prevent relative rotation, and one end of the drive shaft 333 is coupled with, for example, a drive device such as a motor (not illustrated).

In the raiser 33, the frame 331 can freely move close to and away from the downstream conveyance unit 321 as the drive shaft 333 rotates, specifically, the frame 331 is rotatable about the drive shaft 333 between the state (the substantially horizontal state) in which the frame 331 is laid on the downstream conveyance unit 321 and the state (the stand-up state) in which the frame 331 stands up relative to the downstream conveyance unit 321. Note that the frame 331 rotates in the range of 0 to 60°, preferably 0 to 90°, more preferably 0° to 120° from the substantially horizontal state when the substantially horizontal state of being laid on the downstream conveyance unit 321 is taken to be 0°.

(Drive Unit and Control Unit)

The drive unit is a device such as a motor configured to intermittently drive the conveyer 32, specifically, the downstream conveyance unit 321, the move-down conveyance unit 322, the upstream conveyance unit 323, and the move-up conveyance unit 324 in cooperation. The control unit is a processing device such as an MCU configured to process a computer program and instruct a drive timing to the drive unit.

[Routing Processing Device]

The routing processing device 4 is provided on the left side C of the circulation conveyer 3 in the width direction W in the routing zone 22. The routing processing device 4 includes a body part 41 of a multi-axis multi-joint type, and a mounting unit 42 attached to a leading end of the body part 41 and configured to attach the subassembly 11 on the work board 31. The body part 41 may be, for example, a well-known robot of a six-axis multi-joint type. Note that the routing processing device 4 may be provided on the right side D of the circulation conveyer 3 in the width direction W in the routing zone 22.

As illustrated in FIG. 9, the mounting unit 42 includes a holding member 43 and a slide member 44. The holding member 43 is a member having a substantially rectangular shape in plan view which is attached to the body part 41 and configured to hold the slide member 44. A plurality of the slide members 44 are provided at predetermined intervals in a longitudinal direction of the holding member 43 and are slidably attached to the holding member 43 in a transverse direction thereof. Each slide member 44 includes, at an end part facing outward in the transverse direction, a grasping body 45 configured to grasp the connector 13 of the subassembly 11.

Note that the subassembly 11 to be placed onto the work board 31 by the routing processing device 4 is supplied from a subassembly assembly device 200 (refer to FIG. 3) disposed near the wire harness manufacturing system 100 and configured to automatically assemble the subassembly 11. After the routing processing device 4 moves closer to the subassembly assembly device 200 and grasps each connector 13 of the subassembly 11 through the grasping body 45 at the corresponding slide member 44, the routing processing device 4 performs routing processing of spreading and placing the subassembly 11 onto the work board 31 along the routing path. Instead of the routing processing device 4 moving closer to the subassembly assembly device 200 and grasping the subassembly 11, part of the subassembly assembly device 200 may move and pass the subassembly 11 to the routing processing device 4 or the subassembly assembly device 200 may have the function of the routing processing device 4.

[Image Capturing Device]

Back in FIG. 3, the image capturing device 5 is, for example, a camera configured to perform image capturing for examining the appearance of the wire harness 1 manufactured in the second finishing zone 24, for example, the appearance of a particular exterior component 14. A plurality of the image capturing devices 5 are provided along the downstream conveyance unit 321 at positions facing the work surface 31*a* of the work board 31 in the examination zone 25, namely, on the upper side E in the up-down direction H and on the left side C and the right side D of the circulation conveyer 3 in the width direction W. Note that the image capturing device 5 may be provided in a zone other than the examination zone 25.

A display device 15 such as a display configured to display an image of the wire harness 1 captured by the image capturing device 5 is provided in the examination zone 25.

[Conduction Examination Device]

The conduction examination device 6 is a device configured to examine the conduction state of the wire harness 1 manufactured in the second finishing zone 24. The conduction examination device 6 is provided on the left side C or the right side D of the circulation conveyer 3 in the examination zone 25. The conduction examination device 6 includes a connection engagement unit (not illustrated) that is electrically connected with the integrated terminal mount 37 of the work board 31. The connection engagement unit (not illustrated) is automatically connected to the integrated terminal mount 37.

<Manufacturing Process of Wire Harness>

The following describes a manufacturing process of the wire harness 1 in the wire harness manufacturing system 100. A manufacturing method of the wire harness 1 by the wire harness manufacturing system 100 is performed on the circulation conveyer 3 and includes at least a process of standing up the work board 31 being laid down in the substantially horizontal state and placing the subassembly 11 onto the work board 31 in the stand-up state, a process of performing image examination of the wire harness 1, and a process of performing conduction examination of the wire harness 1.

The work boards 31 in a number corresponding to the number of the processing zones 21 to 26 are disposed on the circulation conveyer 3 in the wire harness manufacturing system 100 and simultaneously provided with respective pieces of manufacturing processing in the processing zones 21 to 26. The circulation conveyer 3 is intermittently provided with drive control by the drive unit and the control unit so that the work boards 31 stay in the processing zones 21 to 26 for a predetermined time. Note that the following describes the manufacturing processing in the processing zones 21 to 26 in the order of the processing zones 21 to 26 for the objective of description.

First in the supply zone 21, the work board 31, on which no subassembly 11 is mounted, is supplied. The process of manufacturing the wire harness 1 in the wire harness manufacturing system 100 starts at the supply zone 21. The work board 31 is conveyed while being laid down in the substantially horizontal state and the work surface 31*a* of the work board 31 faces towards the upper side E in the up-down direction H. When the supply of the work board 31 is completed, a signal indicating the completion of the work is transmitted from the supply zone 21 to the control unit.

When the work board 31 is conveyed from the supply zone 21 to the routing zone 22 by the circulation conveyer 3, the raiser 33 is at a position at which the frame 331 does not interfere with the conveyance of the work board 31. Specifically, the frame 331 of the raiser 33 is slightly standing up on the left side C in the width direction W. After the work board 31 is conveyed to the routing zone 22, the frame 331 of the raiser 33 rotates about the drive shaft 333 so as to move closer to the work board 31.

The frame 331 rotates until the work board 31 is housed in the space 331*c* (until the frame 331 moves into a substantially horizontal state), and the grasping body 332 partially grasps an outer edge part extending in the conveyance direction L in the work board 31. Once the work board 31 is grasped by the grasping body 332, the work board 31 is lifted up from one edge part of the work board 31 extending in the conveyance direction L of the work board 31, for example, an edge part on the right side D in the width direction W toward the upper side E in the up-down direction H and the left side C in the width direction W. Accordingly, the raiser 33 sets the work board 31 to the stand-up state in which the work board 31 stands up by 90° approximately from the substantially horizontal state. In the stand-up state, the work surface 31*a* of the work board 31 faces toward the left side C.

Simultaneously in parallel with the above-described work by the raiser 33, the routing processing device 4 moves to acquire the subassembly 11 from the subassembly assembly device 200. In the routing processing device 4, each slide member 44 configured to grasp the corresponding connector 13 of the subassembly 11 protrudes from the holding member 43. Once the grasping body 45 of each slide member 44 grasps the corresponding connector 13 of the subassembly 11 from the subassembly assembly device 200, the slide members 44 other than the slide member 44 grasping a connector 13 to be mounted onto the work board 31 first retract to the holding member 43 side.

The body part 41 moves closer to the work board 31 in the stand-up state, and the slide member 44 protruding from the holding member 43 hangs the connector 13 of the subassembly 11 onto a predetermined receiving jig 361 provided to work surface 31*a* of work board 31. After the grasping body 45 releases the connector 13, the slide member 44 retracts to the holding member 43 side, and the slide member 44 grasping a connector 13 to be subsequently hung on a receiving jig 361 protrudes from the holding member 43. The routing processing device 4 spreads the connectors 13 of the subassembly 11 on the work board 31 (forms a multifurcating shape) by attaching each connector 13 of the subassembly 11 to an individual receiving jig 361 in accordance with the routing path on the work board 31.

After the routing work of the subassembly 11 onto the work surface 31*a* of the work board 31 by the routing processing device 4 ends, the raiser 33 lays down the frame 331 until the work board 31 moves into a substantially horizontal state. Then, the grasping body 332 of the frame 331 releases the work board 31 and the work board 31 is placed on the downstream conveyance unit 321 of the circulation conveyer 3 again. Once the work board 31 is laid down in the substantially horizontal state again, a signal indicating the completion of the work is transmitted from the routing zone 22 to a control unit. Note that, at conveyance of the work board 31 from the routing zone 22 to the first finishing zone 23, the frame 331 has moved to a position where the frame 331 does not interfere with the conveyance of the work board 31.

In the first finishing zone 23, a worker removes each connector 13 of the subassembly 11 from the receiving jig 361 and inserts the connector 13 into the engagement port part 362*c* of the connector part 362*b* of the corresponding connector jig 362. In addition, each electrical line 12 of the subassembly 11 wired on the work board 31 is placed between the leg parts 364*b* of the corresponding support jig 364. Once the work in the first finishing zone 23 is completed, a signal indicating the completion of the work is transmitted from the first finishing zone 23 to the control unit. Note that the work in the first finishing zone 23 may be performed by using a dedicated device, not by a worker.

In the second finishing zone 24, a worker finishes the subassembly 11 into the wire harness 1 by mounting, for example, the exterior component 14 on twisted electrical lines 12 to bundle the electrical lines 12. In the second finishing zone 24, the worker slides the cover part 363*d* of the clamp jig 363 and houses the exterior component 14 in the holding recess 363*c*. The cover part 363*d* automatically returns to a position in which the cover part 363*d* covers the holding recess 363*c*.

In addition, in the second finishing zone 24, for example, a part number label such as a bar code or a QR code (registered trademark) is attached to the wire harness 1 by a worker. Examination contents to be executed on the examination zone 25 are transmitted to the image capturing device 5 and the conduction examination device 6 by reading the part number label. Note that the attachment of the part number label to the wire harness 1 may be performed in the first finishing zone 23.

Once the work in the second finishing zone 24 is completed, a signal indicating the completion of the work is transmitted from the second finishing zone 24 to the control unit. Note that the work in the second finishing zone 24 may be performed by using a dedicated device, not by a worker.

In the examination zone 25, first, image examination of the wire harness 1 is performed. Specifically, the image capturing device 5 captures an image of the appearance of the wire harness 1, for example, the appearance of a particular exterior component 14 from the upper side E, the left side C, and the right side D. The image captured by the image capturing device 5 is displayed on the display device 15. Whether the displayed image of the wire harness 1 satisfies a predetermined reference is determined by a worker. Note that this image determination work may be performed by using an AI or the like, not by a worker. In addition, the image capturing device 5 may be installed to be movable. When the image capturing device 5 is movable, it is possible to, for example, more effectively prevent interference with the worker and reduce the number of image capturing devices 5.

After the image examination ends, conduction examination of the wire harness 1 is performed. The conduction examination is performed when the connection engagement unit of the conduction examination device 6 is automatically engaged with the integrated terminal mount 37 of the work board 31. Once the image examination and the conduction examination are completed, a signal indicating the completion of the work is transmitted from the examination zone 25 to the control unit. Note that connection between the connection engagement unit of the conduction examination device 6 and the integrated terminal mount 37 may be performed by the worker. In addition, the order of the image examination and the conduction examination is not particularly limited, but the image examination may be performed after the conduction examination, or the image examination and the conduction examination may be simultaneously performed.

In the conveying-out zone 26, the connection state of each connector 13 of the wire harness 1 and the connector part 362*b* of the corresponding connector jig 362 of the work board 31 and the grasping state of each exterior component 14 of the wire harness 1 by the clamp member 363*b* of the corresponding clamp jig 363 are canceled first.

Specifically, air cylinders are provided to the connector jig 362 and the clamp jig 363, and the other end of each air cylinder is connected to a compressor configured to supply compression air. The engagement state with the connector 13 of the wire harness 1 is canceled as compression air is supplied from the compressor to the air cylinder of the cancellation mechanism of the connector jig 362, the lock click 362*d* moves down to the work surface 31*a* side of the work board 31, and in addition, the cover part 363*d* slides from the holding recess 363*c* and the grasping state of the exterior component 14 of the wire harness 1 is canceled as compression air is supplied from the compressor to the air cylinder of the cancellation mechanism of the clamp jig 363. Note that the cancellation of the wire harness 1 from the connector jig 362 and the clamp jig 363 may be simultaneously performed, or orders may be allocated to the connector jig 362 and the clamp jig 363 and the cancellation may be performed based on the orders.

Once the engagement state of each connector 13 of the wire harness 1 and the grasping state of each exterior component 14 of the wire harness 1 are canceled, the connector 13 and the exterior component 14 of the wire harness 1 are removed from the connector part 362*b* of the connector jig 362 and the clamp member 363*b* of the clamp jig 363 by the own weight of the wire harness 1. Accordingly, the wire harness 1 falls onto the work surface 31*a*. Then, the work board 31 is tilted from the substantially horizontal state to one side in the width direction W, for example, the left side C, and the wire harness 1 is conveyed out of the circulation conveyer 3, specifically, the wire harness manufacturing system 100. Once the conveyance-out of the wire harness 1 is completed, a signal indicating the completion of the work is transmitted from the conveying-out zone 26 to the control unit.

Having received the signals, each indicating the completion of the work from the processing zones 21 to 26, the control unit transmits a signal to the drive unit. The drive unit having received the signal from the control unit drives the conveyer 32 to convey the work boards 31 in the processing zones 21 to 25 to processing zones disposed on the downstream side B thereof, and in addition, convey the work board 31 in the processing zone 26 to the upstream conveyance unit 323. The conveyance of the work boards 31 in the processing zones 21 to 26 is performed on the condition that all above-described manufacturing processing in the processing zones 21 to 26 is completed. In other words, the conveyance of the work boards 31 in the conveyance direction L is not performed when even one manufacturing process is not completed among the processing zones 21 to 26.

All above-described manufacturing processing in the processing zones 21 to 26 is performed simultaneously in parallel, and the process of manufacturing the wire harness 1 is completed through all processing zones 21 to 26. The wire harness 1 thus conveyed out is conveyed to the next process of the manufacturing process, for example, a packaging process.

Note that the work board 31 from which the wire harness 1 has been conveyed out is conveyed from the downstream conveyance unit 321 to the lower side F by the move-down conveyance unit 322, then to the upstream side A by the upstream conveyance unit 323, and then finally to the upper side E by the move-up conveyance unit 324, and is subsequently returned to the downstream conveyance unit 321.

<Characteristics of Wire Harness Manufacturing System>

Since each work board 31 is conveyed in the substantially horizontal state by the wire harness manufacturing system 100 as described above, it is possible to perform work processing on the work board 31 from the left side C and the right side D of the circulation conveyer 3 to manufacture the wire harness 1. Accordingly, occupation area (installation area of the conveyer and work region area) decreases as compared to a conventional conveyer system, and effective utilization of factory premises becomes possible. In addition, since the wire harness manufacturing system 100 includes the raiser 33, the work board 31 can be set to the stand-up state as appropriate in the processing zone 22 in which the work board 31 needs to be stood up to perform manufacturing processing.

Since the wire harness manufacturing system 100 includes, in the routing zone 22, the routing processing device 4 configured to spread and place the subassembly 11 onto the work board 31 along the routing path, the efficiency of the work consisting of placing the subassembly 11 onto the work board 31, which has been manually performed by a worker in conventional cases, significantly improves. In addition, since the raiser 33 is provided at part of the circulation conveyer 3 provided along the routing zone 22, the placement work of the subassembly 11 onto the work board 31 by the routing processing device 4 can be performed in a state in which the work board 31 is standing up. Accordingly, the electrical lines 12 of the subassembly 11, which droop on the lower side F due to their own weight, remain on the work board 31 and do not interfere with the placement work performed by the routing processing device 4.

In a conventional wire harness manufacturing system, a manufactured wire harness is moved to an examination area provided at a place separated from a wire harness manufacturing area and examined, but in the wire harness manufacturing system 100, since the image capturing device 5 and the conduction examination device 6 are provided in the examination zone 25 in which the image examination and conduction examination of the wire harness 1 are performed, it is possible to perform the image examination and conduction examination of the wire harness 1 on an identical line (in-line) in the wire harness manufacturing system 100 and significantly improve operational efficiency.

Since each work board 31 is in the substantially horizontal state in the examination zone 25, it is possible to dispose the image capturing device 5 at a position where the image capturing device 5 does not interfere with work, and image capturing of the wire harness 1 by the image capturing device 5 becomes easy. Note that the image capturing device 5 may be installed to be movable. When the image capturing device 5 is movable, it is possible to, for example, more effectively prevent interference with a worker and reduce the number of image capturing devices 5.

Since the connector part 362*b* of each connector jig 362 provided to each work board 31 of the circulation conveyer 3 includes the connector part 362*b* that electrically connects the corresponding connector 13 of the wire harness 1, and the examination wire 362*e* that is connected with the conduction examination device 6, it is possible to perform easy and fast conduction examination of the wire harness 1 on the work board 31 in the examination zone 25.

Since the circulation conveyer 3 is intermittently driven, it is possible to reliably complete processing in each of the processing zones 21 to 26 and then convey each work board 31 to a processing zone on the downstream side B.

In the work board 31, since each connector jig 362 includes the air-cylinder cancellation mechanism configured to cancel the connection state with the wire harness 1, each clamp jig 363 includes the air-cylinder cancellation mechanism configured to cancel the grasping state of the wire harness 1, and each cancellation mechanism is connectable with an external device configured to supply compression air, it is possible to easily and rapidly remove the wire harness 1 from the work board 31 in the conveying-out zone 26.

<Others>

Note that the present disclosure is not limited to the above-described first embodiment but may be modified as appropriate without departing from the scope of the present disclosure. For example, the work board 31 may be changed as appropriate to the work board 31 having the corresponding routing path and size in accordance with the type of the wire harness 1 to be manufactured, and is placed at the conveyer 32 of the circulation conveyer 3.

In the above-described first embodiment, the circulation conveyer 3 intermittently performs conveyance of the work board 31 by the conveyer 32 but may continuously perform the conveyance. In addition, the conveyance speed of the work board 31 may be variably adjusted. Note that the conveyer 32 may be provided across all processing zones 21 to 26, or the conveyer 32 corresponding to each of the processing zones 21 to 26 may be provided as long as conveyance of the work board 31 between the processing zones 21 to 26 is not adversely affected. When the conveyer 32 is individually provided to each of the processing zones 21 to 26, there may be a conveyer 32 on which no work board 31 is placed (a free space may be temporarily provided between the work boards 31 on the circulation conveyer 3). Accordingly, it is possible to have a time difference between intermittent operations of the work boards 31, and in addition, it is possible to variably adjust the conveyance speed for each work board 31.

In the above-described first embodiment, the work board 31 is conveyed in the horizontal state with the work surface 31*a* facing towards the upper side E, but may be conveyed so that the work surface 31*a* is parallel to the installation surface of the circulation conveyer 3.

In the above-described first embodiment, the cancellation mechanisms of the connector jig 362 and the clamp jig 363 each use an air cylinder but may be a solenoid or piezoelectric actuator.

In the above-described first embodiment, the connector part 362*b* of the connector jig 362 and the connector 13 of the subassembly 11 hold the engagement state with each other through the lock click 362*d*, but a multi-coupler may be provided to the engagement port part 362*c* of the connector part 362*b* so that the connector 13 is fitted to the multi-coupler. When the connector 13 is removed from the multi-coupler, the cancellation mechanism exerts pressure on the multi-coupler.

In the above-described first embodiment, the first and second finishing zones 23 and 24 are independent processing zones but may be integrated with each other as a single processing zone.

In the above-described first embodiment, the upstream conveyance unit 323 is provided on the lower side F of the downstream conveyance unit 321, but may be provided on the upper side E of the downstream conveyance unit 321. In addition, the circulation conveyer 3 may be a conveyance device formed in a loop shape and configured to convey the work board 31 on an identical plane in the horizontal direction. In addition, the downstream conveyance unit 321 and the upstream conveyance unit 323 may extend straight, or, for example, may extend with a meandering bend halfway through them.

The work surface 31*a* or the back surface 31*b* of the work board 31 in the above-described first embodiment may be provided with a test-check wire harness that is connectable to the conduction examination device 6. In this case, the test-check wire harness is electrically connectable to the integrated terminal mount 37.

Figure 10:
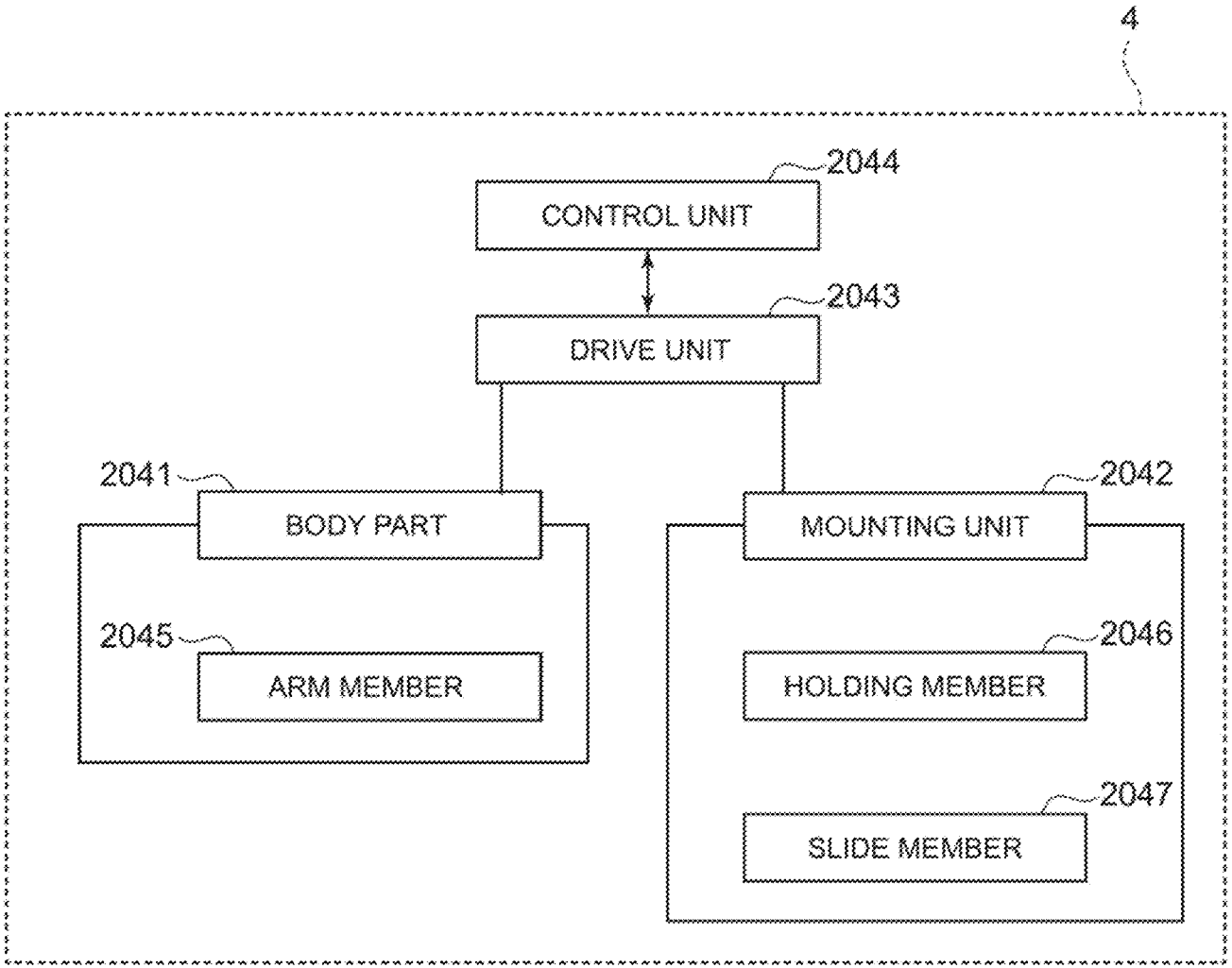
FIG. 10 is a block diagram for description of the configuration of a routing processing device according to a second embodiment of the present disclosure.
Figure 11:
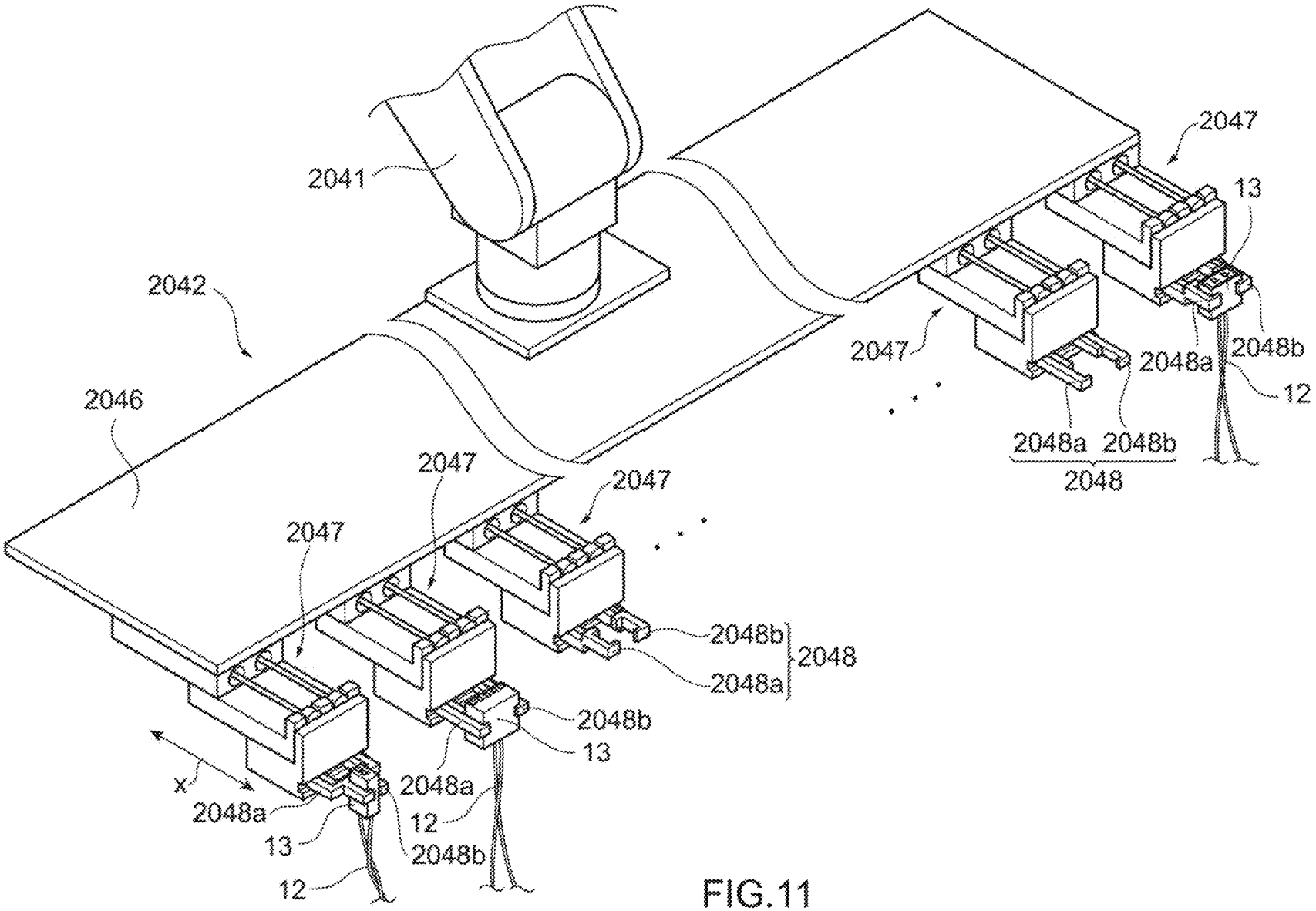
FIG. 11 is a diagram for description of the configuration of a mounting unit of the routing processing device according to the second embodiment of the present disclosure.

The following describes a second embodiment of the present disclosure with reference to FIGS. 10 and 11.

The second embodiment of the present disclosure relates to a routing processing device that places a subassembly onto a work board of a wire harness manufacturing system by using a subassembly including a plurality of electrical lines to each of which a connector is attached.

A wire harness is obtained by bundling a plurality of electrical lines to each of which a connector is attached and spreading one end of each electrical line into a predetermined shape. The wire harness is wired, for example, in the vehicle body of an automobile and used for electrical power supply to various electric instruments that are included in the automobile, communication of control signals between electric instruments, and the like.

For example, there is a wire harness manufacturing device including a tilted wiring base on which a subassembly including a plurality of connectors mounted on a plurality of electrical lines are multifurcated and arranged, and a subassembly harness hook bar (refer to Japanese Patent Laid-open No. 2004-186083, for example). A plurality of work boards (wiring plates in Japanese Patent Laid-open No. 2004-186083) are fixed to the wiring base, and a hook member configured to lock a subassembly (subassembly harness in Japanese Patent Laid-open No. 2004-186083) is provided to each work board. The hook member is detachably attached to the wiring base to be freely movable in a lateral direction of the wiring base. The component hook bar locks a branch part of the subassembly so that it is possible to move the subassembly as a whole.

In the wire harness manufacturing device of Japanese Patent Laid-open No. 2004-186083, connectors and branch parts of electrical lines of a subassembly being temporarily hooked to the hook member are wired on a work board by a worker. In the wire harness manufacturing device of Japanese Patent Laid-open No. 2004-186083, an induction card that instructs, to a worker, the positions of connectors and branch parts of electrical lines of a subassembly to be arranged is provided, which facilitates wiring work.

However, wiring work of a subassembly is performed by a worker. During the wiring work, the worker must check an instruction on the induction card for each piece of work and place the subassembly onto a work board. In addition, a work time taken for placement work of a subassembly is not always constant, and there has been room for improvement of operational efficiency.

Thus, the present disclosure is related to providing a routing processing device that can improve operational efficiency when a subassembly is placed onto a work board.

The second embodiment of the present disclosure is a routing processing device configured to place the subassembly onto a work board of a wire harness manufacturing system and includes: a body part capable of freely moving relative to the work board along a shape in which the wire harness is to be manufactured by the wire harness manufacturing system; and a mounting unit attached to a leading end of the body part and configured to receive the subassembly from a supply device that supplies the subassembly and place each connection component of the subassembly at a position on the work board along the shape of the wire harness.

The mounting unit preferably includes a slide member configured to grasp the connection component and capable of freely protruding and retracting relative to the work board.

In addition, it is preferable to include a control unit storing a plurality of pieces of path information based on the shape of the wire harness and configured to move the body part relative to the work board based on the path information.

According to the second embodiment of the present disclosure, it is possible to improve efficiency of work of placing a subassembly onto a work board.

Note that the second embodiment described below is one example and may have various forms in the scope of the present disclosure. In addition, the configurations of the wire harness 1 and the work board 31 are identical to the configurations of the wire harness 1 and the work board 31 in the first embodiment, and thus specific description thereof is omitted.

FIG. 10 is a block diagram for description of the configuration of the routing processing device. FIG. 11 is a diagram for description of the configuration of the mounting unit of the routing processing device.

[Routing Processing Device]

As illustrated in FIG. 3, the routing processing device 4 is provided on the left side C of the circulation conveyer 3 in the width direction W in the routing zone 22. As illustrated in FIG. 10, the routing processing device 4 includes a body part 2041 of a multi-axis multi-joint type, a mounting unit 2042 configured to mount the subassembly 11 onto the work board 31, a drive unit 2043 configured to drive the body part 2041 and the mounting unit 2042, and a control unit 2044 configured to control driving of the drive unit 2043. Note that the routing processing device 4 may be provided on the right side D of the circulation conveyer 3 in the width direction W in the routing zone 22.

The body part 2041 includes a plurality of arm members 2045 coupled with each other and configured to enable movement along the shape of the wire harness 1 to be manufactured. The body part 2041 may be, for example, a well-known robot of a six-axis multi-joint type but is not limited to a six-axis rotation type but may be a robot of any multi-axis type such as a robot of a rotation type of two to five axes or of seven axes or more.

As illustrated in FIG. 11, the mounting unit 2042 is attached to a leading end of the body part 2041, receives the subassembly 11 from the subassembly assembly device (supply device) 200 configured to supply the subassembly 11, and places each connector 13 of the subassembly 11 at a position on the work board 31 along the routing path. The mounting unit 2042 includes a holding member 2046 and a slide member 2047. The holding member 2046 is a member having a substantially rectangular shape in plan view and is attached to the leading end of the body part 2041. A plurality of the slide members 2047 are provided at predetermined intervals on one edge side in a longitudinal direction of the holding member 2046 in the holding member 2046. Each slide member 2047 is attached to the holding member 2046 to be slidable in a transverse direction (also referred to as a "slide direction") x of the holding member 2046. The slide member 2047 includes a grasping body 2048 configured to grasp the connector 13 of the subassembly 11 at one end face in the slide direction x.

The grasping body 2048 includes sandwiching leg parts 2048*a* and 2048*b* as a pair of leg parts that sandwich the connector 13 of the subassembly 11. The sandwiching leg parts 2048*a* and 2048*b* are formed to be freely opened and closed by moving close to and away from each other.

The drive unit 2043 is an actuator configured to drive the body part 2041 and the mounting unit 2042, is directly or indirectly coupled with the arm members 2045, the slide members 2047, and the grasping bodies 2048, drives the arm members 2045 in a freely movable manner, and drives the slide members 2047 to freely protrude and retract relative to the holding member 2046. The drive of the drive unit 2043 is controlled by the control unit 2044.

The control unit 2044 is a processing device such as an MCU configured to process a computer program and causes the drive unit 2043 to drive (move) the body part 2041 and the mounting unit 2042 so that the subassembly 11 is spread onto the work board 31 along a multifurcation structure (routing path) in accordance with the part number of the wire harness 1 to be manufactured. A plurality of pieces of routing path information (path information) related to the routing path in accordance with the part number of the wire harness 1 are stored in the control unit 2044. The control unit 2044 moves the body part 2041 together with the mounting unit 2042 relative to the work board 31 based on the routing path information corresponding to the shape of the wire harness 1 to be manufactured.

Note that the subassembly 11 to be placed onto the work board 31 by the routing processing device 4 is supplied from the subassembly assembly device 200 (refer to FIG. 3) disposed near the wire harness manufacturing system 100 and configured to automatically assemble the subassembly 11. After the routing processing device 4 moves closer to the subassembly assembly device 200 and grasps each connector 13 of the subassembly 11 through the grasping body 2048 at the corresponding slide member 2047, the routing processing device 4 performs routing processing including the tasks of spreading and placing the subassembly 11 onto the work board 31 along the routing path. Instead of the routing processing device 4 moving closer to the subassembly assembly device 200 and grasping the subassembly 11, part of the subassembly assembly device 200 may move and pass the subassembly 11 to the routing processing device 4 or the subassembly assembly device 200 may have the function of the routing processing device 4.

<Manufacturing Process of Wire Harness>

The following describes the process of manufacturing the wire harness 1 in the wire harness manufacturing system 100. Note that the manufacturing process in the present embodiment is basically identical to the manufacturing process of a wire harness in the first embodiment. Hereinafter, the manufacturing process using the routing processing device 4 illustrated in FIGS. 10 and 11 will be described.

In a routing processing device 4, the control unit 2044 transmits, to the drive unit 2043, an input signal indicating reception of the subassembly 11 from the subassembly assembly device 200. The drive unit 2043 having received the input signal from the control unit 2044 moves the body part 2041 so that the mounting unit 2042 squarely faces a manufacturing table 210 of the subassembly assembly device 200, and causes a slide member 2047 that receives the corresponding connector 13 of the subassembly 11 to protrude from the holding member 2046. Then, the drive unit 2043 drives the body part 2041 to move closer to the manufacturing table 210 together with the mounting unit 2042 and drives the corresponding grasping body 2048 to grasp the connector 13.

Once the grasping body 2048 of each slide member 2047 grasps the corresponding connector 13 of the subassembly 11 from the subassembly assembly device 200, the drive unit 2043 transmits a signal indicating grasping of the connector 13 to the control unit 2044. Note that the slide members 2047 other than the slide member 2047 grasping a connector 13 to be mounted onto the work board 31 first retract to the holding member 2046 side.

Then, the control unit 2044 transmits, to the drive unit 2043, a mounting signal based on the routing path information on the connector 13 which is grasped by slide member 2047 is to be hung on which receiving jig 361 of the work board 31. The drive unit 2043 having received the mounting signal from the control unit 2044 freely moves the arm members 2045 of the body part 2041 and the mounting unit 2042 on the work board 31 to the upstream side A, the downstream side B, the left side C, the right side D, the upper side E, and the lower side F in FIG. 17.

The drive unit 2043 moves the body part 2041 together with the mounting unit 2042 closer to the work board 31 based on the mounting signal and hangs the connector 13 grasped by the slide member 2047 on a desired receiving jig 361 provided to the work board 31 based on the routing path information. Once the grasping body 2048 releases the connector 13, the slide member 2047 retracts to the holding member 2046 side, and the slide member 2047 grasping the connector 13 to be subsequently hung on the receiving jig 361 protrudes from the holding member 2046. The routing processing device 4 spreads the connector 13 of the subassembly 11 on the work board 31 (forms a multifurcating shape) by attaching each connector 13 of the subassembly 11 to an individual receiving jig 361 in accordance with the routing path information on the work board 31.

<Characteristics of Wire Harness Manufacturing System>

It is possible to automate the routing processing of the subassembly 11 on the work board 31, which has been conventionally performed by a worker, by the routing processing device 4 of a six-axis multi-joint type, which is included in a wire harness manufacturing system 100 as described above, and thus the operational efficiency of the routing processing improves, and it is possible to significantly reduce the work time of the routing processing.

In the routing processing device 4, it is possible to drive only a desired slide member 2047 relative to the work board 31 in a freely protruding and retracting manner from the mounting unit 2042, for example, it is possible to cause only the slide member 2047 grasping a connector 13 desired to be placed on a predetermined receiving jig 361 of the work board 31 to protrude from the holding member 2046. Accordingly, it is possible to prevent another slide member 2047 grasping a connector 13 other than the connector 13 to be placed on the predetermined receiving jig 361 from interfering with the work board 31 when the slide member 2047 grasping the connector 13 to be placed on the predetermined receiving jig 361 moves closer to the predetermined receiving jig 361.

The routing processing device 4 includes the control unit 2044 configured to move the body part 2041 and the mounting unit 2042 along the routing path of the subassembly 11, and thus moves the body part 2041 relative to the work board 31 together with the mounting unit 2042 in accordance with routing path information for each wire harness 1 to be manufactured when different kinds of wire harnesses 1 are manufactured, and accordingly, it is possible to fast and easily place the subassembly 11 onto the work board 31.

The following describes a third embodiment of the present disclosure with reference to FIGS. 12 to 16.

The third embodiment of the present disclosure relates to an examination device and specifically relates to, for example, an examination device configured to examine whether connection of electrical lines and terminals between connectors of a wire harness is correct based on the presence of conduction.

In the manufacturing process of a wire harness in which connection components such as connectors are connected with both end parts and middle parts of a plurality of electrical lines, whether a wire harness as a completed product having ended all fabrication processes satisfies the requested specifications is examined before packaging of the wire harness.

In this examination process, for example, conduction examination determining whether connection between connectors of the wire harness is correct based on the existence of conduction, and appearance examination, in which the kind, attachment state, damage, and the like of an exterior component of the wire harness is assessed are performed.

The conduction examination among these examinations needs to examine conduction and opening among connector pins of all connectors to reliably find connection failure between an electrical line and a terminal (connector pin) of a connector at assembly and the like. Thus, the examination time of the conduction examination tends to increase as the number of connector pins of the wire harness increases.

Typically, an automated examination technology using a computer is used in the conduction examination of a wire harness to reduce the examination time. The automated examination technology is a technology of comparing input-output results of electric signals to each electrical line of an examination target wire harness with correct connection information of the examination target wire harness and determining whether connection between connector pins is appropriate based on the comparison result (refer to Japanese Patent Laid-open No. 2014-206394). It is possible to thoroughly examine whether connection between connector pins of the examination target wire harness is appropriate by performing the conduction examination by using the automated examination technology.

However, even when the conduction examination is performed by using the above-described automated examination technology, it is not easy for a worker to specify at which part of a wire harness connection defect or connection failure actually occurs when inappropriate connection (error) between connector pins is detected. For example, in a typical automated examination technology, when error is detected, character information indicating a connector pin at which the error is detected is displayed on a screen of the computer. However, it is not easy to specify a specific defect location with only the character information, and a significant amount of time has been needed for analysis work to specify the defect location in some cases.

The present disclosure is related to improving operational efficiency in the conduction examination of a wire harness.

The examination device according to the third embodiment of the present disclosure is an examination device used in a wire harness manufacturing system and includes: a conduction examination execution unit configured to perform conduction examination between connection components included in an examination target wire harness; a determination unit configured to determine whether connection between connection components included in the examination target wire harness is appropriate based on an examination result of the conduction examination by the conduction examination execution unit; and a display control unit configured to cause a display device to display a determination result by the determination unit, and when a connection component, connection of which is determined to be inappropriate by the determination unit exists, the display control unit causes the display device to display error information including information of the connection component, connection of which is determined to be inappropriate, together with wire harness image information that schematically illustrates the examination target wire harness.

With the examination device according to the third embodiment of the present disclosure, it is possible to improve operational efficiency in the conduction examination of a wire harness.

The following first describes an overview of the third embodiment. Note that in the following description, a reference sign in drawings, which corresponds to a component of the disclosure, is written in parentheses as an example.

[1] The examination device (302, 302A) according to the third embodiment of the present disclosure includes: a conduction examination execution unit (3021) configured to perform conduction examination between connection components (13) included in an examination target wire harness (1); a determination unit (3022) configured to determine whether connection between connection components included in the examination target wire harness is appropriate based on an examination result of the conduction examination by the conduction examination execution unit; and a display control unit (3023) configured to cause a display device (304) to display a determination result by the determination unit, and when a connection component, connection of which is determined to be inappropriate by the determination unit exists, the display control unit causes the display device to display error information (416, 414, 415) including information of the connection component, connection of which is determined to be inappropriate, together with wire harness image information (411, 412, 413) that schematically illustrates the examination target wire harness.

[2] In the above-described examination device, the display control unit may display the error information (414, 415) over the wire harness image information (412, 413).

[3] In the above-described examination device, the display control unit may display, as the error information, image information (414) that schematically illustrates a path between connection components (13), connection between which is determined to be inappropriate, over the wire harness image information (412).

[4] In the above-described examination device, when a connection component (13), connection of which is determined to be inappropriate by the determination unit exists, the display control unit may cause the display device to display connection component image information (421) that schematically illustrates the connection component (13), connection of which is determined to be inappropriate, and error terminal information (422) indicating a terminal of the connection component, connection of which is determined to be inappropriate.

[5] In the above-described examination device, the display control unit may display the error terminal information over the connection component image information.

[6] In the above-described examination device, when a connection component, connection of which is determined to be inappropriate by the determination unit exists, the display control unit may cause the display device to display information (433, 431, 432) of a circuit including a terminal of the connection component, connection of which is determined to be inappropriate.

[7] The above-described examination device may further include a self-check unit (3026) configured to determine whether the examination device can normally operate, the self-check unit may cause the conduction examination execution unit to execute conduction examination between connection components included in a test wire harness (1X) different from the examination target wire harness and cause the determination unit to determine whether connection between connection components included in the test wire harness is appropriate based on an examination result of the conduction examination of the test wire harness by the conduction examination execution unit, and the self-check unit may determine whether the examination device can normally operate based on a determination result of the test-examination wire harness by the determination unit.

The following describes a specific example of the third embodiment of the present disclosure with reference to drawings. Note that in the following description, a component common to embodiments is denoted by an identical reference sign, and duplicate description thereof is omitted. In addition, it needs to be noted that the drawings are schematic, the relation of dimensions of elements, the ratio of each element, and the like are different from those in reality in some cases. Parts between which the relation of dimensions and the ratio are different are sometimes included among the drawings.

Figure 12:
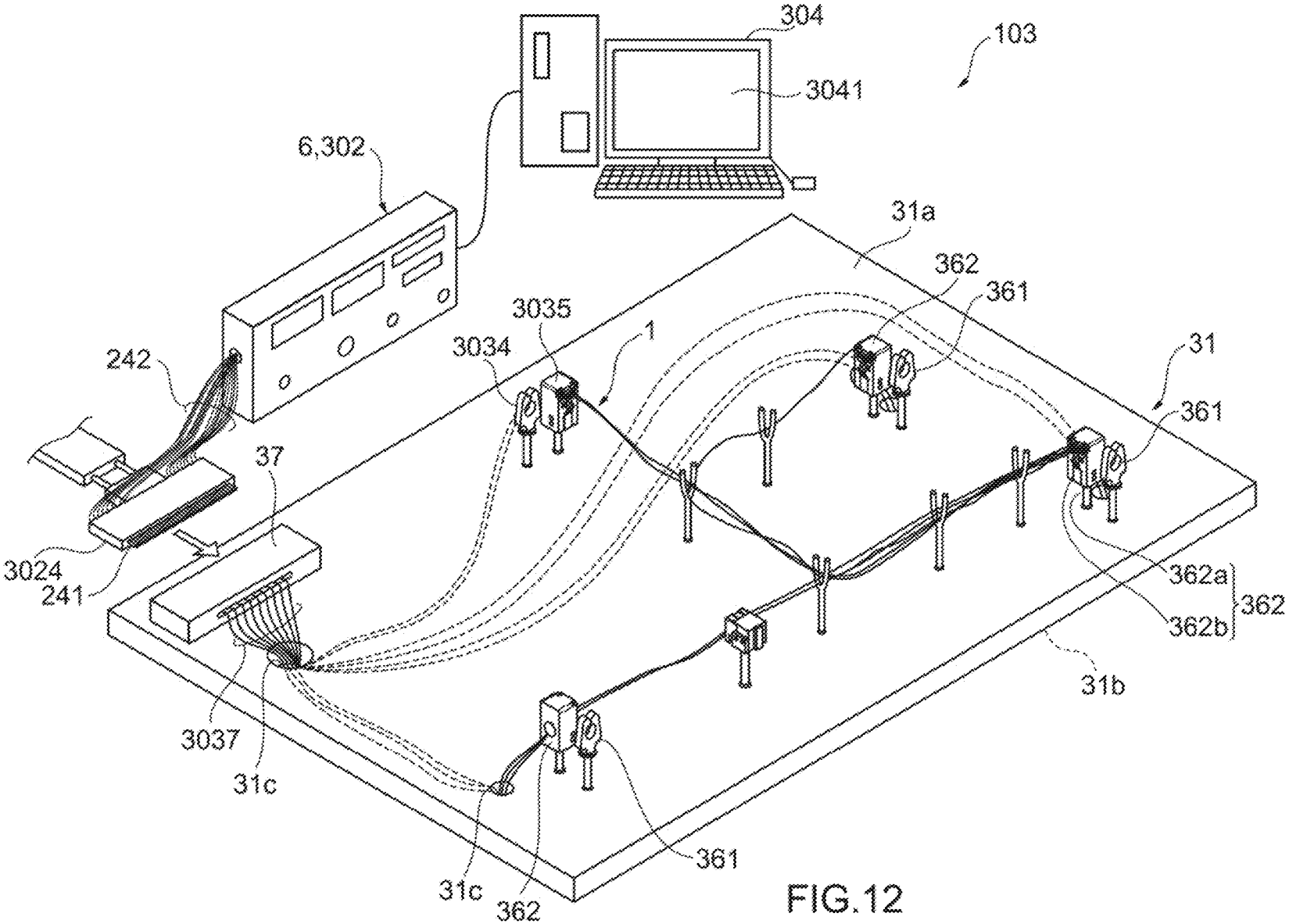
FIG. 12 is a diagram illustrating the configuration of a wire harness examination system including an examination device according to a third embodiment of the present disclosure.

FIG. 12 is a diagram illustrating the configuration of a wire harness examination system including the examination device according to the third embodiment.

A wire harness examination system 103 illustrated in the drawing is a system for performing conduction examination examining whether connection between connection components of a wire harness as a completed product assembled through various kinds of fabrication processes in the wire harness manufacturing process is correct based on the existence of electric conduction. The wire harness examination system 103 can perform the conduction examination on a production line (in-line) in the same way as it does for fabrication work of attaching an exterior component or the like to a subassembly including a plurality of electrical lines to which connection components are connected in the manufacturing process of a wire harness.

As illustrated in FIG. 12, the wire harness examination system 103 includes a work board 31 on which an examination target wire harness 1 is placed, an examination device 302, and a display device 304. Note that the configurations of the wire harness 1 and the work board 31 are identical to the configurations of the wire harness 1 and the work board 31 in the first embodiment, and thus specific description thereof is omitted.

[Display Device]

The display device 304 is a device connected with the examination device 302 and configured to display operation information for operating the examination device 302, an examination result of conduction examination by the examination device 302, and the like on a screen 3041. The display device 304 is, for example, a liquid crystal display or an organic EL display.

[Examination Device]

Figure 13:
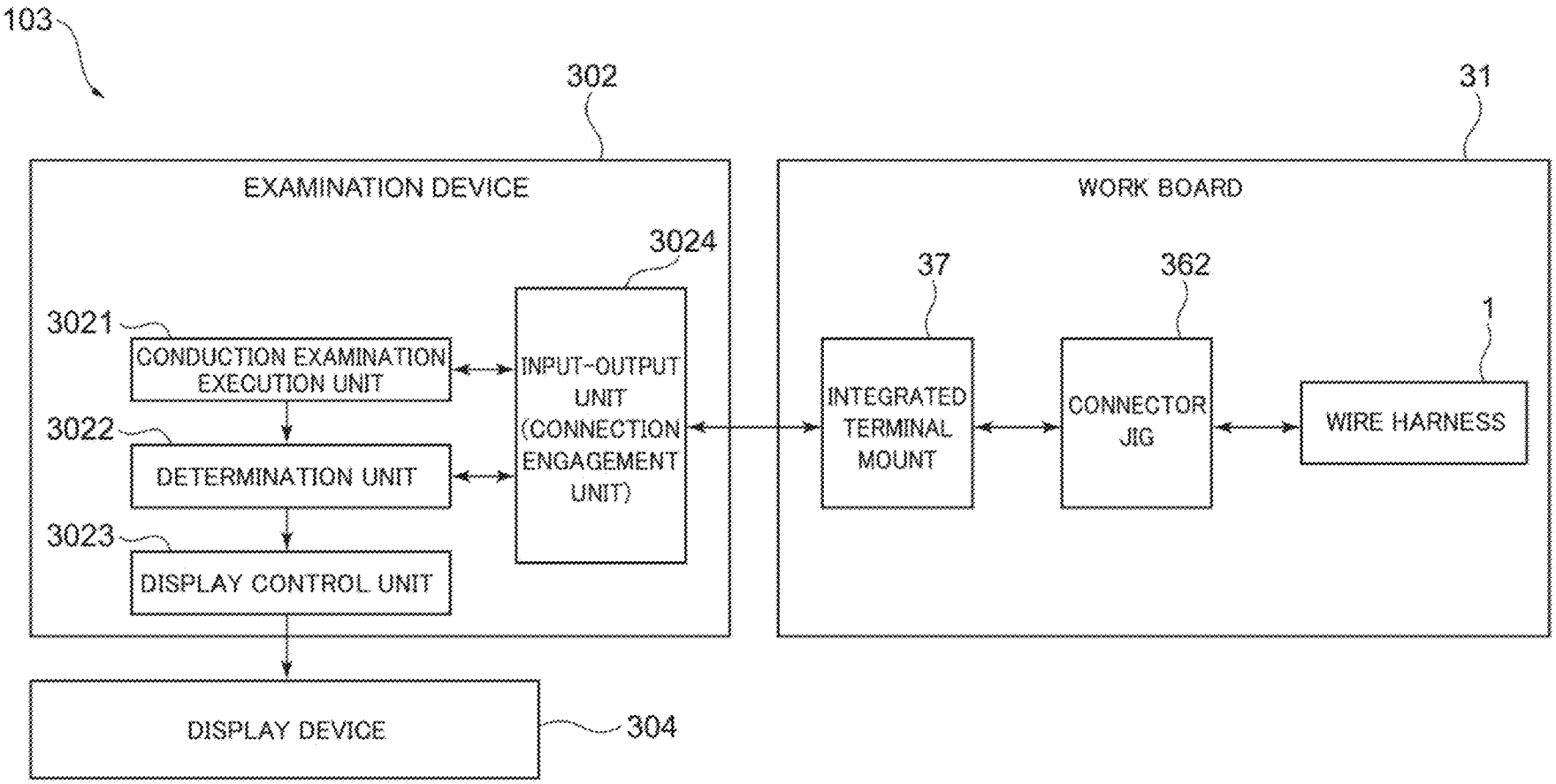
FIG. 13 is a diagram illustrating a functional block configuration of the examination device according to the third embodiment of the present disclosure.

FIG. 13 is a diagram illustrating a functional block configuration of the examination device according to the embodiment.

The examination device 302 is a device configured to perform the conduction examination of the examination target wire harness 1. As illustrated in FIG. 13, the examination device 302 includes, as functional blocks, input-output unit (connection fitting unit) 3024, a conduction examination execution unit 3021, a determination unit 3022, and a display control unit 3023.

Each functional block included in the examination device 302 is achieved through cooperation of hardware resources and software included in the examination device 302. Specifically, the examination device 302 includes, for example, as the hardware resources, a program processing device such as an MCU, a storage device such as a RAM or a ROM, and a peripheral circuit such as a power circuit, an AC/DC converter, a DC/AC converter, a communication circuit, or an input-output interface circuit, and an input-output unit 3024, the conduction examination execution unit 3021, the determination unit 3022, and the display control unit 3023 are achieved by the above-described program processing device controlling the above-described peripheral circuit by executing arithmetic processing in accordance with a computer program stored in the above-described storage device.

Note that each above-described computer program (conduction examination program) may be distributable through a network or may be written in a computer-readable storage medium (non-transitory computer readable medium) such as a CD-ROM and be distributable.

The input-output unit 3024 is a functional component for electrically connecting an internal circuit (not illustrated) of the examination device 302 and the wire harness 1 on the work board 31. For Example, as illustrated in FIG. 12, the input-output unit 3024 includes a plurality of connector pins 241 and a signal wire 242 for electrically connecting each connector pin 241 and the internal circuit of the examination device 302. For example, as illustrated in FIG. 12, the input-output unit 3024 and each terminal of the integrated terminal mount 37 are electrically connected with each other by fitting the connector pins 241 of the input-output unit 3024 to the integrated terminal mount 37. Accordingly, the examination target wire harness 1 connected with the connector jig 362 of the work board 31 and the internal circuit of the examination device 302 are electrically connected to each other.

The conduction examination execution unit 3021 is a functional component configured to perform conduction examination between connectors 13 included in the examination target wire harness 1. The conduction examination execution unit 3021 examines a conduction state (short-circuiting or opening) between specified connector terminals of the plurality of connectors 13 in the wire harness 1. For example, the conduction examination execution unit 3021 examines short-circuiting or opening between the specified connector terminals based on a resistance value (or capacitance value) when voltage (or current) is applied between the connector terminals. For example, the conduction examination execution unit 3021 examines the conduction state for all combinations of connector terminals of all connectors 13 included in the examination target wire harness 1.

The determination unit 3022 is a functional component configured to determine whether connection of connectors in the examination target wire harness 1 is appropriate based on an examination result of the conduction examination performed by the conduction examination execution unit 3021. For example, the determination unit 3022 determines whether the connection state of each connector 13 is appropriate by comparing master information stored in a storage device in the examination device 302 in advance and indicating a correct conduction state between connectors 13 (connector terminals) of the examination target wire harness 1 and an examination result of the conduction state between connectors by the conduction examination execution unit 3021.

The display control unit 3023 is a functional component configured to control the display device 304 to display various kinds of information on the screen 3041 of the display device 304. The display control unit 3023 causes a determination result by the determination unit 3022 to be displayed on the screen 3041 of the display device 304.

Figure 14:
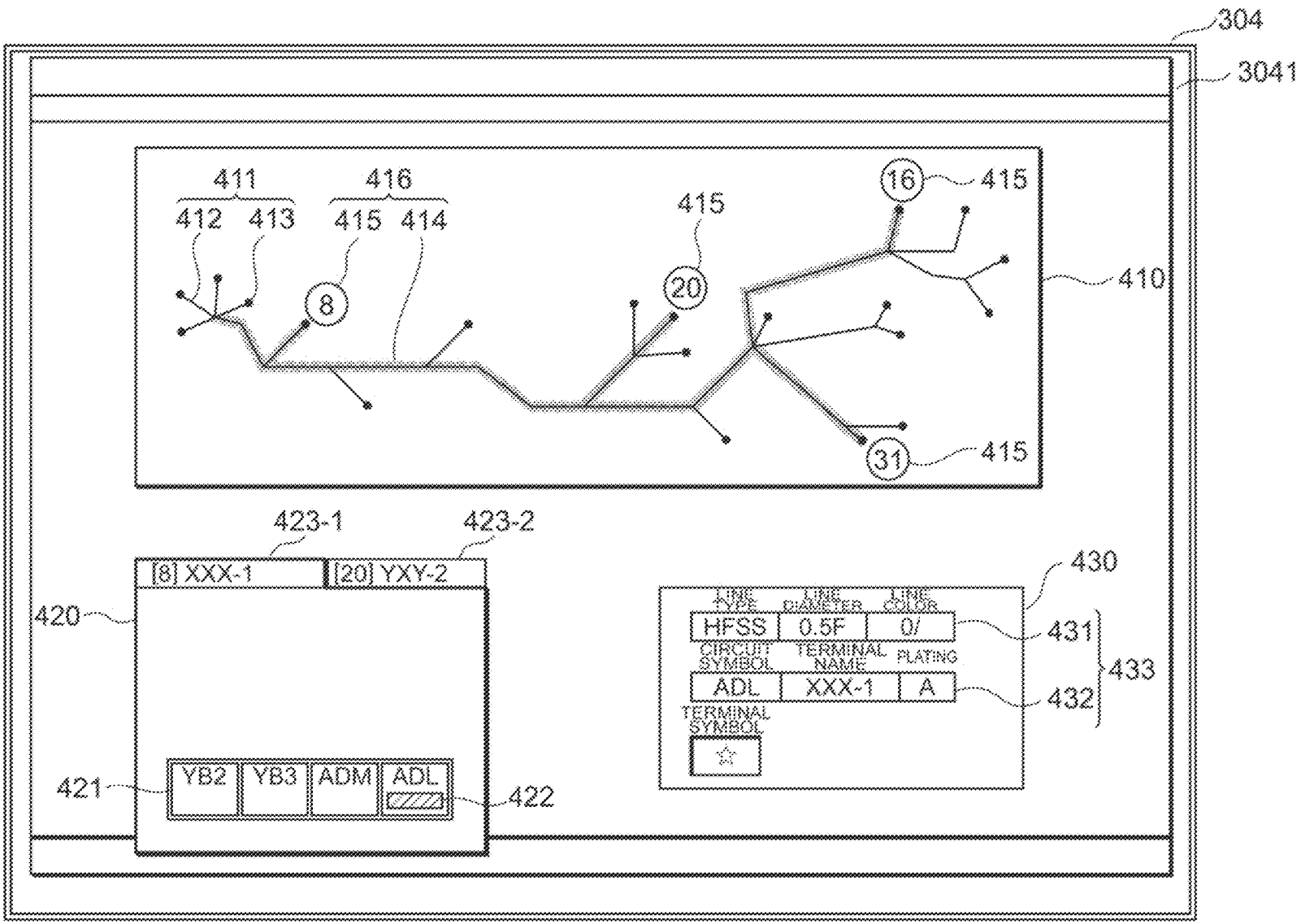
FIG. 14 is a diagram illustrating exemplary display of a conduction examination result by the examination device according to the third embodiment of the present disclosure.

FIG. 14 is a diagram illustrating exemplary display of a conduction examination result by the examination device according to the third embodiment illustrated in FIG. 13.

FIG. 14 illustrates exemplary information displayed on the screen 3041 of the display device 304 in a case in which a connector 13, connection of which is inappropriate is found in the examination target wire harness 1 through the conduction examination by the examination device 302.

When a connector 13, connection of which is determined to be inappropriate by the determination unit 3022, exists in the examination target wire harness 1, the display control unit 3023 causes the display device 304 to display error information 416 including information regarding the connector 13, connection of which is determined to be inappropriate, together with wire harness image information 411 that schematically illustrates the examination target wire harness 1.

For example, as illustrated in FIG. 14, the display control unit 3023 causes the wire harness image information 411 to be displayed in a display region 410 on the screen 3041 of the display device 304. The wire harness image information 411 includes, for example, image information 413 that schematically illustrates the connectors 13 included in the examination target wire harness 1, and image information 412 that schematically illustrates a bundle (trunk line) of the electrical lines 12 connecting the connectors 13.

In addition, for example, as illustrated in FIG. 14, the display control unit 3023 causes the error information 416 to be displayed in the display region 410 on the screen 3041 together with the wire harness image information 411.

For example, As illustrated in FIG. 14, the error information 416 includes error connector information 415 indicating identification information (for example, a connector number) of a connector 13, connection of which is determined to be inappropriate, and error path image information 414 that illustrates a path between connectors, (more preferably, connector terminals), connection between which is determined to be inappropriate.

The display control unit 3023 causes the error information to be displayed over the wire harness image information 411. For example, as illustrated in FIG. 14, the display control unit 3023 causes a circle surrounding the image information 413 of a connector 13, connection of which is determined to be inappropriate, and the connector number of the connector 13 to be displayed as the error connector information 415 near the image information 413 of the corresponding connector 13 on the wire harness image information 411. In addition, the display control unit 3023 causes the error path image information 414 of a path between connectors, connection between which is determined to be inappropriate, to be displayed over the corresponding path on the wire harness image information 411. In this case, it is preferable to display a trunk line in the wire harness image information 411 and the error path image information 414 in colors different from each other.

Note that exemplary display when connection is determined to be inappropriate among four connectors 13 specified by the connector numbers 8, 16, 20, and 31 in the wire harness 1 is illustrated as an example in the display region 410 of the display device 304 in FIG. 14.

In addition, when a connector 13, connection of which is determined to be inappropriate by the determination unit 3022 exists, the display control unit 3023 causes the display device 304 to display connector image information 421 that schematically illustrates the connector 13, connection of which is determined to be inappropriate, and error terminal information 422 that illustrates a connector terminal, connection of which is determined to be inappropriate among connector terminals included in the connector 13.

For example, as illustrated in FIG. 14, the display control unit 3023 causes the connector image information 421 to be displayed in a display region 420 on the screen 3041 of the display device 304. The connector image information 421 includes, for example, image information that illustrates a terminal room of each connector 13, and identification information (circuit symbol) of a connector terminal corresponding to each terminal room.

In addition, the display control unit 3023 causes the error terminal information 422 to be displayed in the display region 420 on the screen 3041. In this case, the display control unit 3023 may cause the error terminal information 422 to be displayed over the connector image information 421. For example, as illustrated in FIG. 14, a figure of a rectangular shape as the error terminal information 422 is displayed in the terminal room corresponding to a connector terminal, connection of which is determined to be inappropriate in the connector 13 indicated by the connector image information 421. Accordingly, it is possible to notify a worker of which connector terminal of the connector 13 is in an inappropriate connection state.

In addition, as illustrated in FIG. 14, when a plurality of connector terminals, connection of which is determined to be inappropriate exist, the identification information of the connector terminals may be displayed in tabs. For example, FIG. 14 illustrates a case in which a tab 423_1 displaying information of the connector 13 of the connector number 8 and a tab 423_2 displaying information of the connector 13 of the connector number 20 are displayed at an upper part of the display region 420. When any one of these tabs is selected, the connector image information 421 and the error terminal information 422 related to a connector of the connector number corresponding to the selected tab are displayed in the display region 420. A case in which the tab 423_1 is selected and the connector image information 421 and the error terminal information 422 of the connector 13 of the connector number 8 are displayed in the display region 420 is illustrated as an example in FIG. 14.

In addition, when a connector 13, connection of which is determined to be inappropriate by the determination unit 3022 exists, the display control unit 3023 causes the display device 304 to display information of a circuit including a connector terminal, connection of which is determined to be inappropriate, in the connector 13.

A circuit is an object in which connector terminals of each connector 13 are appropriately connected with each other through the electrical line 12.

For example, as illustrated in FIG. 14, the display control unit 3023 causes information 433 of a circuit to be displayed in a display region 430 on the screen 3041 of the display device 304. The information 433 of a circuit includes, for example, information 431 (for example, a line type, a line diameter, and a line color) of an electrical line 12 to be connected with a connector terminal, connection of which is determined to be inappropriate, and identification information 432 (for example, a circuit symbol, the terminal name of the connector terminal, the existence of plating processing, and the terminal symbol of the connector terminal) of the connector terminal.

For example, when any one of the tabs 423_1 and 423_2 in the display region 420 described above is selected, the display control unit 3023 displays, in the display region 430, the information 433 of a circuit including the connector terminal corresponding to the selected tab.

[Conduction Examination by Examination Device 302 According to the Third Embodiment]

The following describes flow of the conduction examination by the examination device 302 according to the embodiment.

Figure 15:
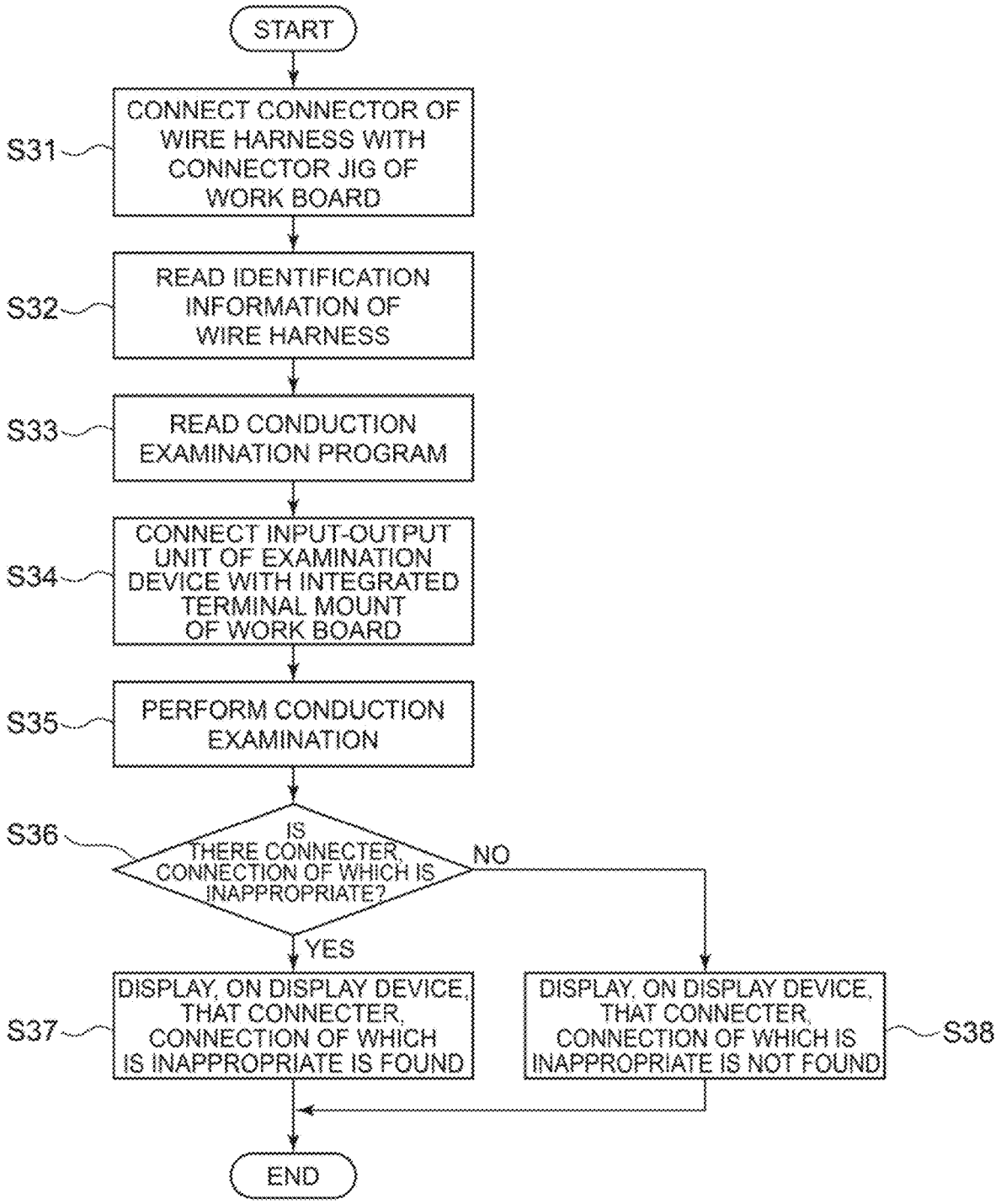
FIG. 15 is a flowchart illustrating flow of the conduction examination by the examination device according to the third embodiment of the present disclosure.

FIG. 15 is a flowchart illustrating the flow of the conduction examination by the examination device according to the embodiment.

First, as illustrated in FIG. 12, each connector 13 of the examination target wire harness 1 on the work board 31 is connected with the corresponding connector jig 362 on the work board 31 (step S31). For example, a worker in charge of a fabrication process removes the wire harness 1 for which the fabrication process has ended from the receiving jig 361, and connects each connector 13 of the wire harness 1 with the corresponding connector jig 362.

Subsequently, the examination device 302 reads identification information of the examination target wire harness 1 (step S32). The identification information of the wire harness 1 is stored as, for example, a two-dimensional code such as a bar code or a QR code (registered trademark), and the two-dimensional code is bonded to an exterior component or the like of the wire harness 1 or the work board 31. For example, the worker causes the examination device 302 to read the identification information of the wire harness 1 by scanning the two-dimensional code bonded to the wire harness 1 or the like by using a two-dimensional code reader connected to the examination device 302.

Subsequently, the examination device 302 reads the conduction examination program corresponding to the examination target wire harness 1 based on the identification information read at step S32 (step S33). For example, various kinds of conduction examination programs of wire harnesses are stored in an auxiliary storage device such as an HDD or the like inside the examination device 302. The examination device 302 reads the conduction examination program corresponding to the identification information read at step S32 from the auxiliary storage device and loads the conduction examination program onto a main storage device such as RAM or the like.

Subsequently, as illustrated in FIG. 12, the input-output unit (connection fitting unit) 3024 of the examination device 302 is connected with the integrated terminal mount 37 of the work board 31 (step S34). For example, each connector pin 241 of a connection fitting unit 3024 is fitted to a connector of the integrated terminal mount 37. The connection between the input-output unit 3024 and the integrated terminal mount 37 may be automatically performed by a robot. For example, a lock machine may be provided and placed on a conveyer configured to convey the work board 31, and the lock machine may operate to connect the connection fitting unit 3024 to the integrated terminal mount 37 when the work board 31 reaches a station that performs the conduction examination.

Subsequently, the examination device 302 starts the conduction examination of the examination target wire harness 1 (step S35). For example, when having sensed that the connection fitting unit (input-output unit) 24 and the integrated terminal mount 37 are electrically connected with each other at step S34, the examination device 302 executes the conduction examination in accordance with the conduction examination program read at step S33. Specifically, the conduction examination execution unit 3021 examines the conduction state between connectors 13 included in the examination target wire harness 1 by an above-described method, and the determination unit 3022 determines, by an above-described method, whether connection between connectors 13 is appropriate based on an examination result by the conduction examination execution unit 3021.

The examination device 302 determines whether a connector 13, connection of which is inappropriate, is found through the conduction examination at step S35 (step S36).

When a connector 13, connection of which is inappropriate, is found, the examination device 302 causes the display device 304 to display information indicating that an error has been found in the examination target wire harness 1 (step S37). Specifically, as illustrated in FIG. 14, the display control unit 3023 causes the display device 304 to display, in addition to the wire harness image information 411, various kinds of information related to the connector, connection of which is inappropriate, such as the error path image information 414, the error connector information 415, the connector image information 421, the error terminal information 422, and the information 433 of a circuit.

When no connector 13, connection of which is inappropriate, is found at step S36, the examination device 302 causes the display device 304 to display information indicating that no connector 13, connection of which is inappropriate, is found in the examination target wire harness 1 (step S38).

Through the above-described procedure, the conduction examination is performed by the examination device 302.

[Effects of Examination Device]

As described above, when a connector 13, connection of which is determined to be inappropriate, during the conduction examination of the examination target wire harness 1 exists, the examination device 302 according to the embodiment causes the display device 304 to display the error information 416 including information of the connector 13, connection of which is determined to be inappropriate, in correspondence with the wire harness image information 411 that schematically illustrates the examination target wire harness 1.

Accordingly, a worker in charge of the conduction examination can easily recognize a connection for which connector 13 is inappropriate in the examination target wire harness 1, and thus it is easy to specify a specific defect place in the wire harness 1 and it is possible to reduce the time required for analysis work of specifying the defect location as compared to conventional cases.

In addition, when the display device 304 is caused to display the error information 416 related to the conduction examination, the examination device 302 causes the error information 416 to be displayed over the wire harness image information 411. For example, as illustrated in FIG. 14, the error path image information 414 that illustrates a path between connectors, connection between which is determined to be inappropriate is displayed over the wire harness image information 411 (the image information 412 of the electrical line 12).

Accordingly, the worker can more clearly recognize which electrical line 12 is related to error(s) in the examination target wire harness 1, and thus it is easier to specify a specific defect location in the wire harness 1.

In addition, when a connector 13, connection of which is determined to be inappropriate, exists, the examination device 302 causes the display device 304 to display the connector image information 421 that schematically illustrates the connector 13, connection of which is determined to be inappropriate, and the error terminal information 422 that illustrates a connector terminal, connection of which is determined to be inappropriate, in the connector. For example, as illustrated in FIG. 14, the examination device 302 causes the error terminal information 422 to be displayed over the connector image information 421.

Accordingly, the worker can easily understand which connector terminal is in an inappropriate connection state in a connector 13 in which an error has been detected.

In addition, when a connector 13, connection of which is determined to be inappropriate, exists, the examination device 302 causes the display device 304 to display information 433 regarding a circuit including a connector terminal, connection of which is determined to be inappropriate. For example, it is possible to provide, to the worker, a greater amount of data related to the connector 13, connection of which is determined to be inappropriate, by causing the display device 304 to display, as the information 433 of the circuit, the information 431 (for example, the line type, the line diameter, and the line color) of an electrical line 12 to be connected with the connector terminal, connection of which is determined to be inappropriate, and the identification information 432 (a circuit symbol, a terminal name, a terminal symbol, and the like) of the connector terminal as illustrated in FIG. 14, and thus it is easier to specify a specific defect location in the wire harness 1.

As described above, with the examination device 302 according to the third embodiment, it is possible to improve operational efficiency in the conduction examination of a wire harness.

Figure 16:
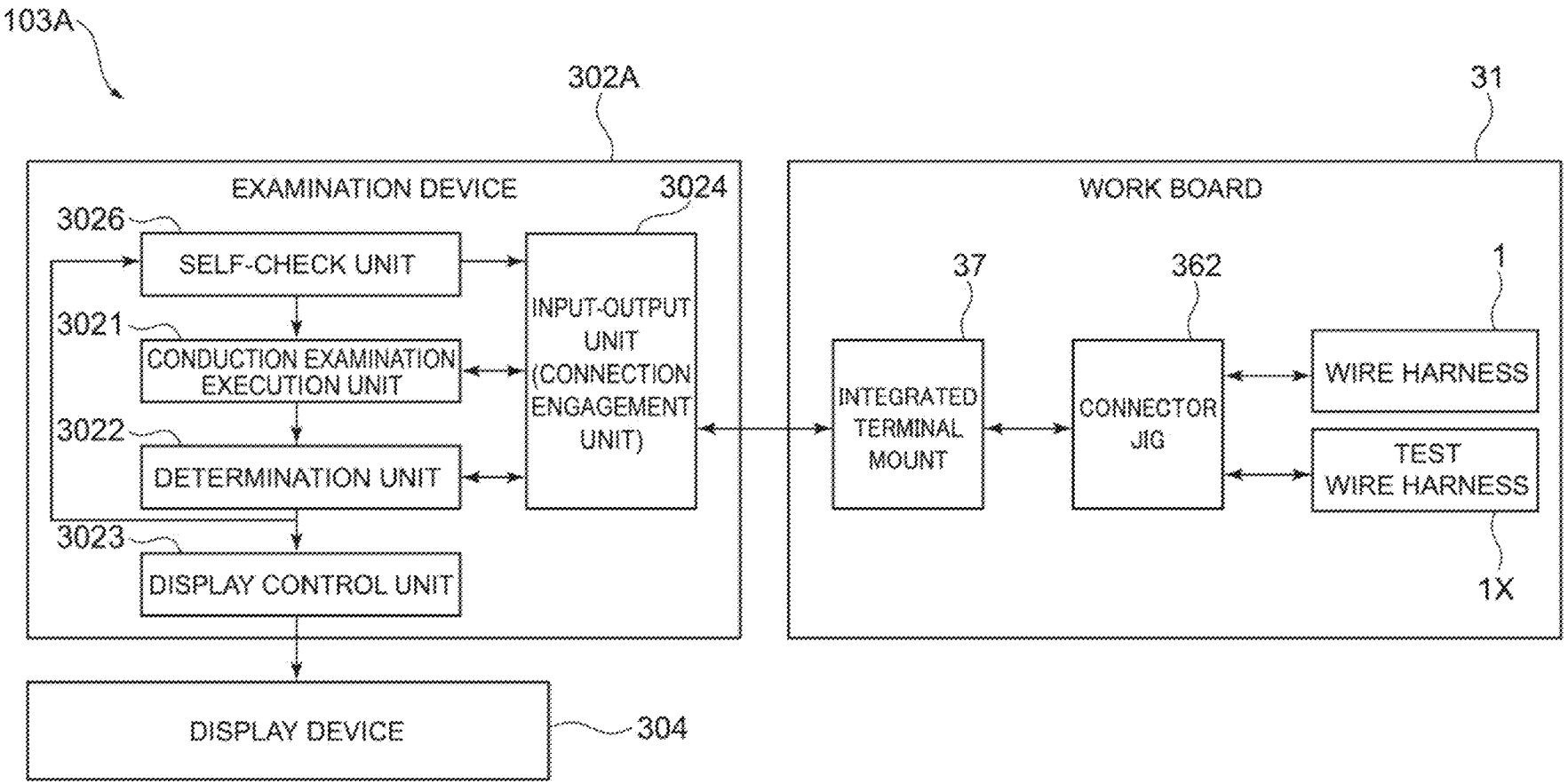
FIG. 16 is a diagram illustrating a functional block configuration of an examination device according to the third embodiment of the present disclosure.

FIG. 16 is a diagram illustrating a functional block configuration of the examination device 302A according to a modification of the third embodiment.

The examination device 302A according to the modification of the third embodiment is different from the examination device 302 according to the third embodiment in execution of self-check processing of determining whether the examination device 302A can normally operate, but is identical to the examination device 302 according to the third embodiment in other points.

In the examination device 302 of a wire harness examination system 103A, a self-check unit 3026 executes, at a predetermined timing, the self-check processing of determining whether the examination device 302A can normally operate. The self-check processing is processing for performing the conduction examination of a test wire harness 1X prepared separately from the examination target wire harness 1 and checking whether a determination result of the examination device 302A based on the examination result is correct.

The predetermined timing is, for example, an instant after power-on reset is canceled upon activation of the examination device 302A, an instant before the conduction examination of the first wire harness 1 is executed after activation of the examination device 302A, an instant at which a signal instructing execution of the self-check processing is input through an operation of the examination device 302A by a worker, or an instant specified by an internal timer of the examination device 302A.

During the self-check processing, first, the self-check unit 3026 connects, to the examination device 302A, the test wire harness 1X different from an examination target wire harness.

The test wire harness 1X includes, for example, at least one electrical line and two connectors connected with both ends of the electrical line. The test wire harness 1X is provided to, for example, the back surface 31*b* of the work board 31 and electrically connectable with the integrated terminal mount 37 through a dedicated connector jig (not illustrated). Specifically, the connection destination of the integrated terminal mount 37 is switchable by a switch or the like, between the connector jig 362 with which the examination target wire harness 1 is connected and the connector jig with which the test wire harness 1X is connected.

The self-check unit 3026 executes the self-check processing through a procedure described below.

First, the self-check unit 3026 switches the above-described switch to establish connection between the integrated terminal mount 37 and the test wire harness 1X. Thereafter, the self-check unit 3026 causes the conduction examination execution unit 3021 to execute the conduction examination between connectors of the test wire harness 1*x*.

Subsequently, the self-check unit 3026 causes the determination unit 3022 to determine whether connection between connectors included in the test wire harness is appropriate based on an examination result of the conduction examination of the test wire harness by the conduction examination execution unit 3021. For example, the determination unit 3022 determines whether the connection state of each connector 13 is appropriate by comparing the master information stored in the storage device in the examination device 302 in advance and indicating a correct conduction state between connectors (connector terminals) of the test wire harness 1*x*, and an examination result of the actual conduction state between connectors of the test wire harness 1X by means of the conduction examination execution unit 3021.

Subsequently, the self-check unit 3026 determines whether the examination device 302A normally operates based on a determination result of the test wire harness 1X by means of the determination unit 3022.

For example, consider a case in which the master information that defines a correct connection state as having conduction of a predetermined connector terminal of the test wire harness 1*x*, and the test wire harness 1X including the connector terminal intentionally set to an open state are prepared and the conduction examination is executed by using them.

In this case, when the determination unit 3022 determines that connection of the connector terminal is inappropriate, for example, when the determination unit 3022 determines that "the connector terminal is in the open state and connection is inappropriate", the self-check unit 3026 determines that the examination device 302A is operating normally.

When the determination unit 3022 determines that connection of the connector terminal is appropriate, for example, when the determination unit 3022 determines that "the connector terminal is in the conduction state and connection is appropriate", the self-check unit 3026 determines that the examination device 302A is not normally operating.

Thereafter, the self-check unit 3026 causes the display control unit 3023 to display the result of the self-check processing on the display device 304. Accordingly, a worker can check that the examination device 302A is operating normally.

As described above, the examination device 302A according to the modification of the third embodiment automatically performs a self-check to determine whether the examination device 302A can perform normal determination based on the conduction examination, and thus it is possible to prevent shipment of a wire harness as a defective product due to failure of the examination device 302A, and it is possible to further improve operational efficiency in the conduction examination of a wire harness.

Although the disclosure achieved by the inventors is specifically described above based on embodiments, the present disclosure is not limited thereto but may be modified in various manners without departing from the scope thereof.

For example, the above-described flowchart illustrates an example for description of operation, and the present disclosure is not limited thereto. In other words, the steps in illustrations of the flowchart are specific examples, and the present disclosure is not limited to the illustrated flow. For example, the order of some processing tasks may be changed, another processing task may be inserted between processing tasks, and some processing tasks may be performed in parallel.

The following describes a fourth embodiment of the present disclosure with reference to FIGS. 17 to 21.

The fourth embodiment of the present disclosure relates to an examination device, and particularly relates to an examination device configured to examine the appearance of an examination object, such as the connection state of a connector or the existence of damage.

In the manufacturing process of a wire harness in which connectors are connected with both end parts and middle parts of a plurality of electrical lines, whether a wire harness as a completed product having ended all fabrication processes satisfies requested specifications is examined before packaging of the wire harness.

In such an examination process, for example, an image of the appearance of a wire harness is captured by an examination device provided in an examination area different from a manufacturing area in which the wire harness is assembled, and appearance examination that examines the type, attachment state, damage existence, and the like of an exterior component of the wire harness is performed based on the captured image (refer to Japanese Patent Laid-open No. 2017-188237, for example).

However, it has been required to move a wire harness assembled in the manufacturing area to the examination area to perform the appearance examination of the wire harness with the above-described examination device. Thus, the operational efficiency of performing the appearance examination potentially decreases, and improvement of the operational efficiency has been required.

Recently, automated examination of capturing an image of the appearance of a wire harness and automatically determining the type, attachment state, damage existence, and the like of an exterior component of the wire harness from the captured image by performing image processing using a computer has been increasingly performed.

However, to reliably find the type, attachment state, damage existence, and the like of an exterior component, not all of a plurality of examination items in the appearance examination can be automated, and a worker must perform visual determination on some items.

Thus, the fourth embodiment of the present disclosure is related to providing an examination device with which the operational efficiency in the appearance examination of a wire harness can be improved.

The examination device according to the fourth embodiment of the present disclosure is an examination device used in a wire harness manufacturing system and includes: an image capturing unit configured to capture an image of an examination target site of a wire harness; and a display unit configured to display an examination target image and an examination reference image in an identical display region based on examination target image data captured by the image capturing unit and examination reference image data as an examination reference for the examination target site, and the image capturing unit is provided in an examination zone downstream of a routing zone for wiring with the electrical line bundle among the plurality of work zones in a production line for the wire harness, through which one work board is sequentially moved to a plurality of work zones with an electrical line bundle as a fabrication target placed on the work board.

The examination device according to the fourth embodiment of the present disclosure preferably further includes: a determination result input unit configured to input a determination result related to the examination target site in the examination target image displayed on the display unit; and a storage unit configured to store the examination target image data and the examination reference image data displayed on the display unit in association with determination result data based on the determination result input by the determination result input unit.

In the examination device according to the fourth embodiment of the present disclosure, the image capturing unit is preferably disposed at a position facing at least one of a pair of edge parts extending in a conveyance direction of the work board conveyed to the examination zone with a work surface being in a horizontal state and a position facing the work surface of the work board.

The examination device according to the fourth embodiment of the present disclosure preferably further includes: an information input unit configured to input identification information of the wire harness; an examination condition setting unit configured to set the examination target site of the wire harness based on the identification information input by the information input unit; and an image determination unit configured to determine the examination target image data and the examination reference image data based on the examination target site set by the examination condition setting unit, and the display unit displays the examination target image and the examination reference image based on the examination target image data and the examination reference image data determined by the image determination unit.

According to the fourth embodiment of the present disclosure, it is possible to improve the operational efficiency in the appearance examination of a wire harness.

[Configuration of Examination System of Wire Harness]

Figure 17:
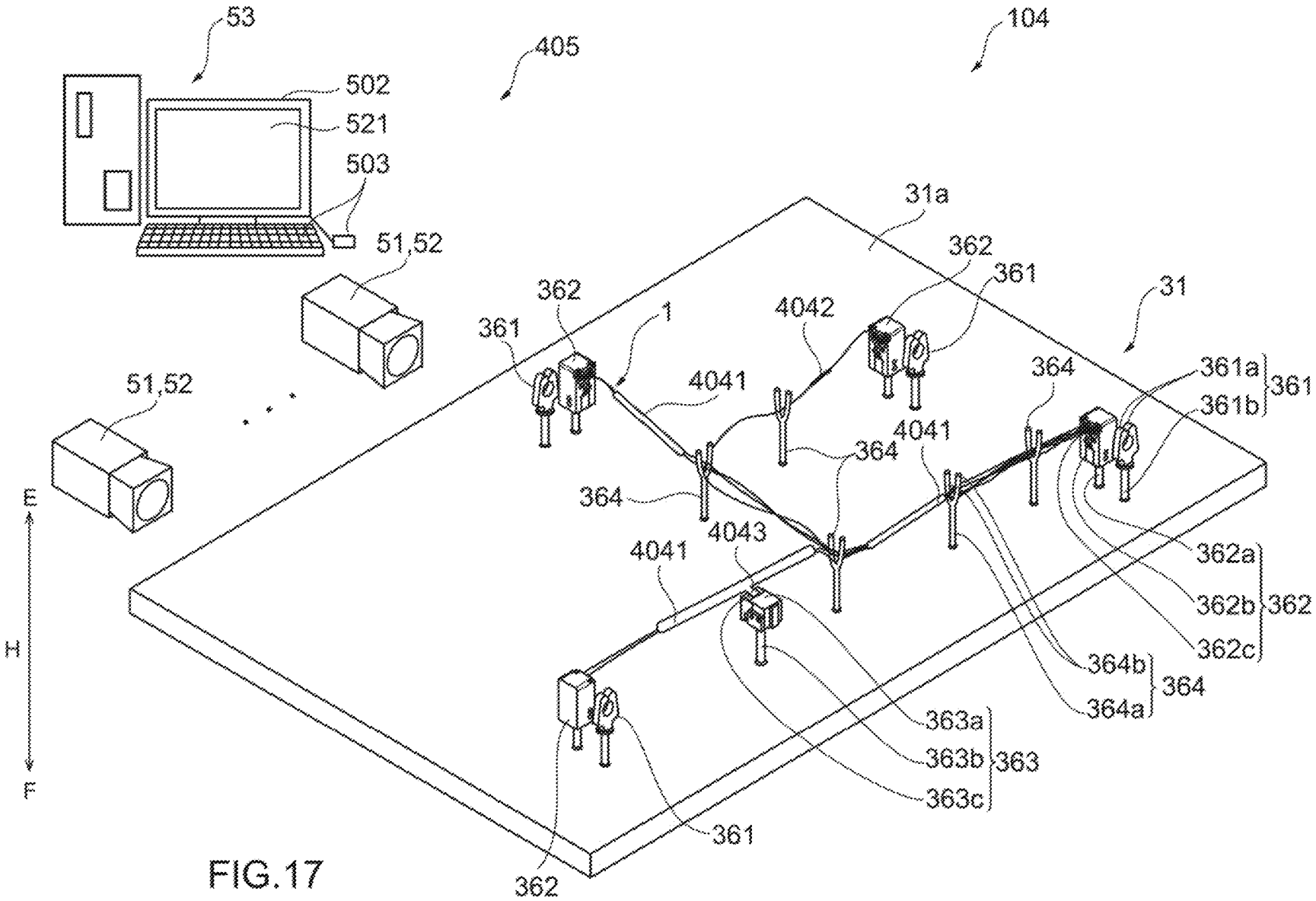
FIG. 17 is a diagram illustrating the configuration of a wire harness examination system including an examination device according to a fourth embodiment of the present disclosure.

The following first describes a wire harness examination system including the examination device according to the fourth embodiment of the present disclosure with reference to FIG. 17. FIG. 17 is a diagram illustrating the configuration of the wire harness examination system including the examination device according to the fourth embodiment of the present disclosure.

As illustrated in FIG. 17, a wire harness examination system 104 is a system for performing appearance examination of performing examination of whether, for example, mounting of an exterior component of the wire harness 1 as a completed product assembled through various kinds of fabrication processes in the manufacturing process of a wire harness is correct by capturing an image of the appearance.

In the process of manufacturing the wire harness 1, the wire harness examination system 104 can perform appearance examination of a production line (in-line) identical to that of fabrication work of attaching the exterior component 14 (refer to FIG. 1) or the like to the subassembly 11 (refer to FIG. 1) made of a plurality of electrical lines with which the connectors 13 are connected.

As illustrated in FIG. 17, the wire harness examination system 104 includes the work board 31 on which the examination target wire harness 1 is placed and an examination device 405. Note that the configurations of the wire harness 1 and the work board 31 are identical to the configurations of the wire harness 1 and the work board 31 in the first embodiment, and thus specific description thereof is omitted.

[Configuration of Examination Device]

Figure 18:
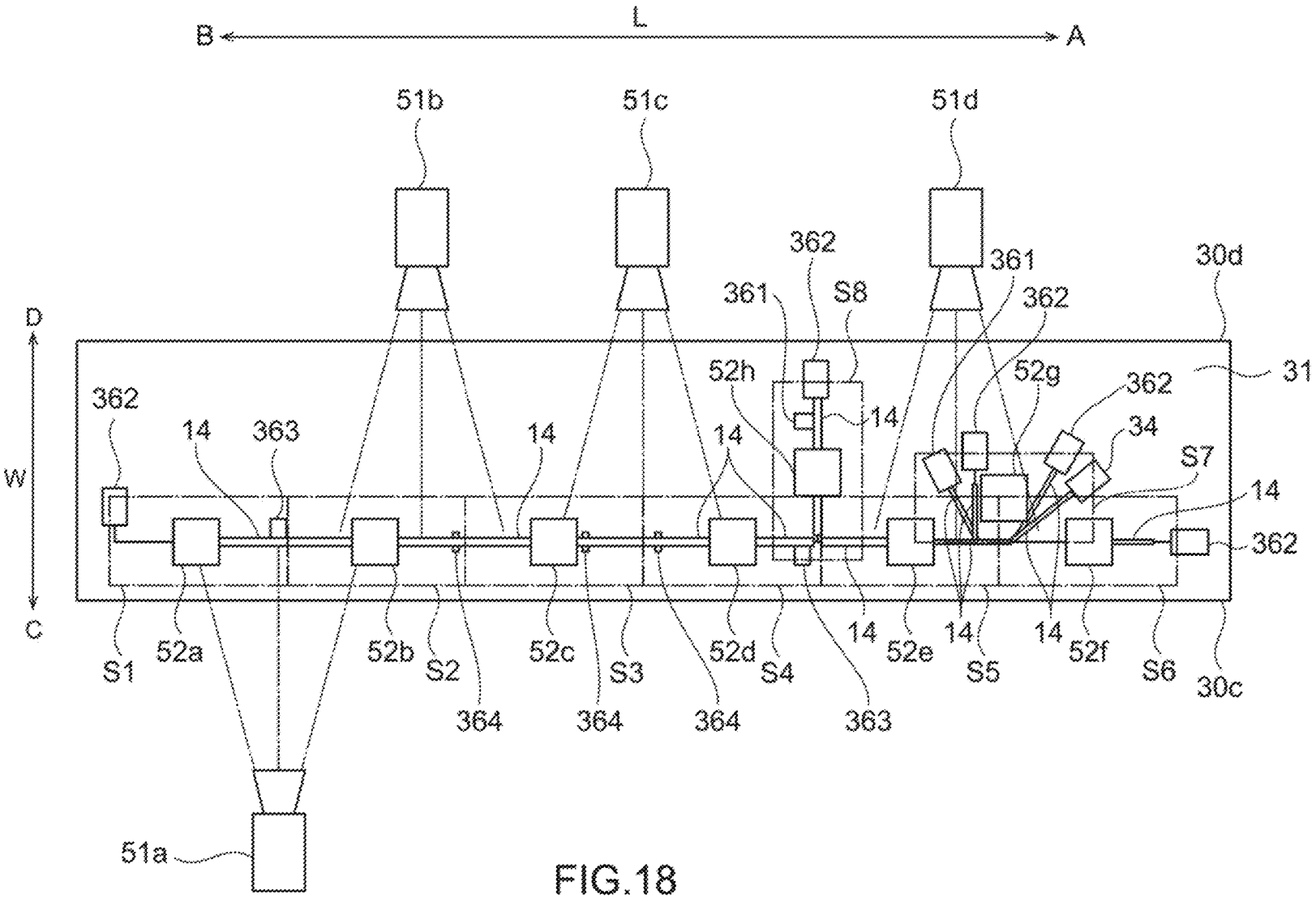
FIG. 18 is a schematic diagram for description of disposition of an image capturing unit of the examination device according to the fourth embodiment of the present disclosure.
Figure 19:
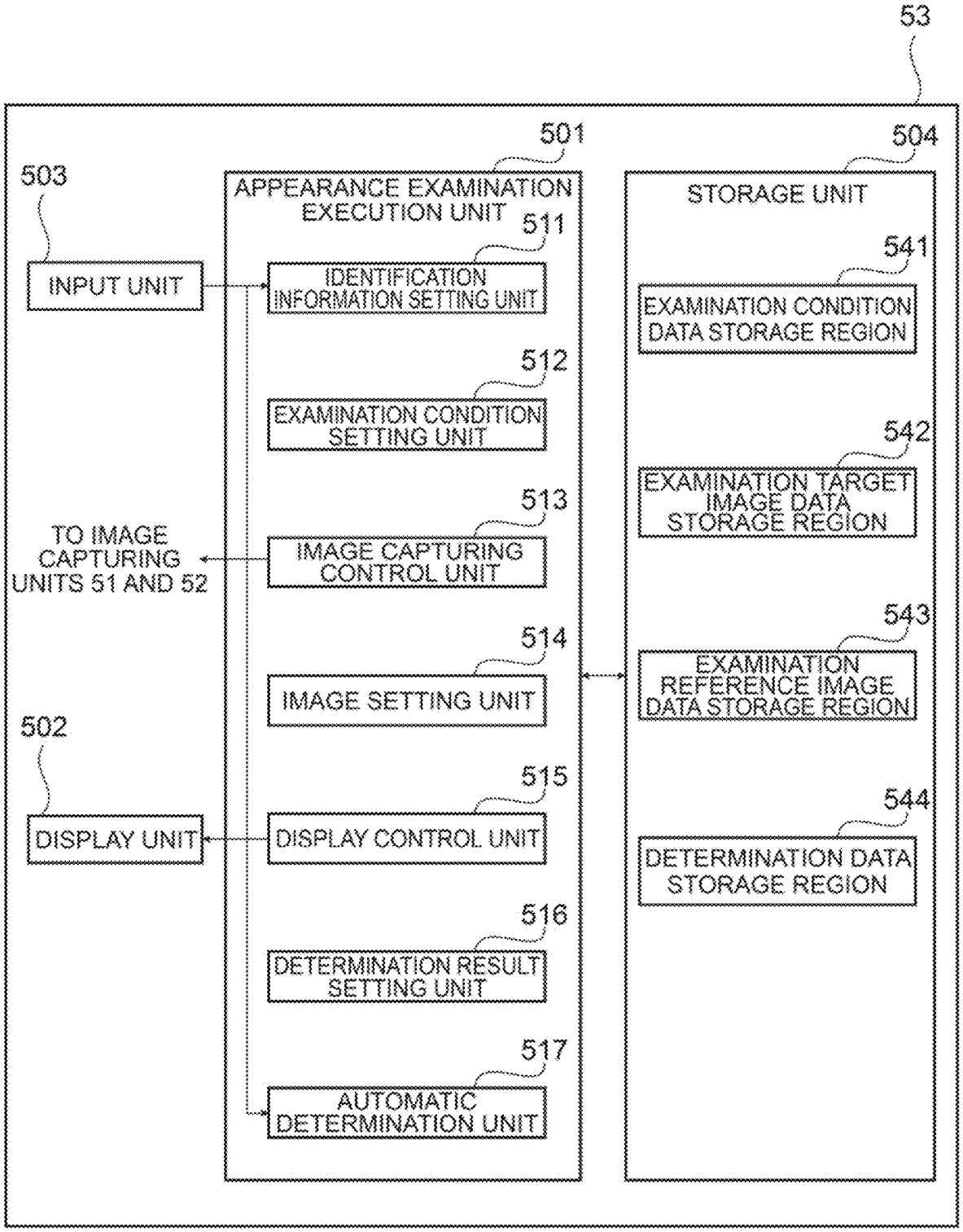
FIG. 19 is a diagram illustrating the configuration of functional blocks of the examination device according to the fourth embodiment of the present disclosure.
Figure 20A:
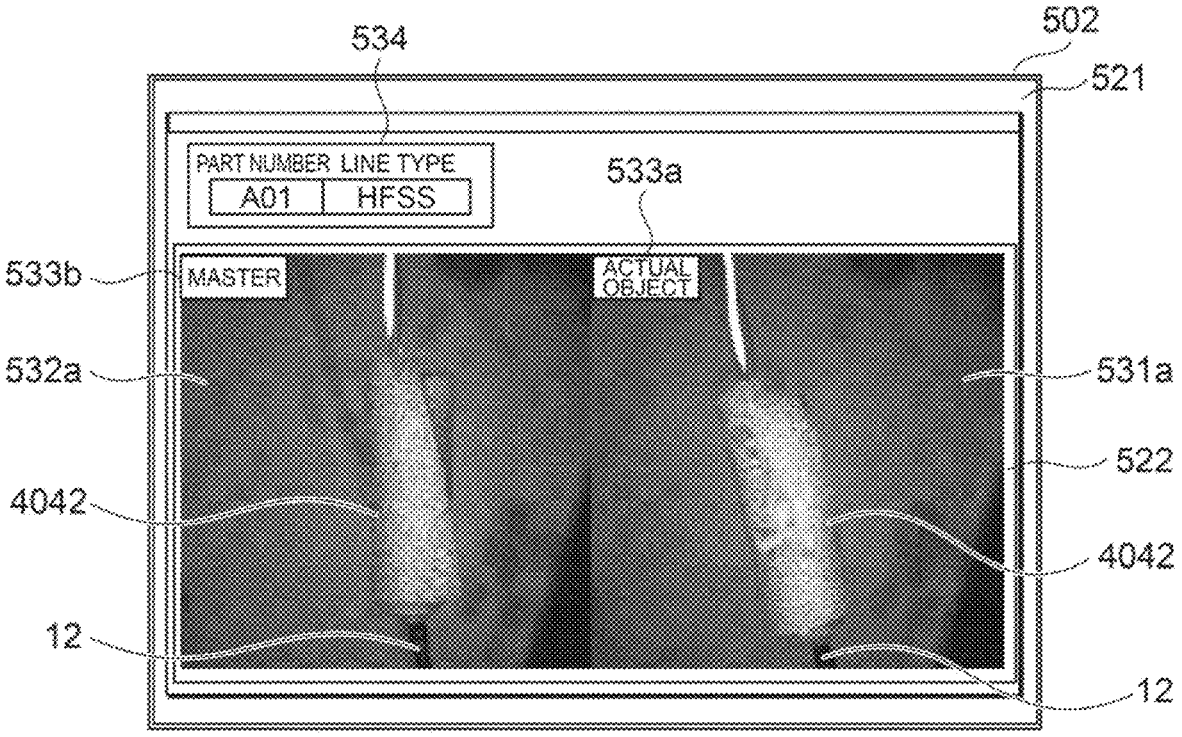
FIG. 20A and FIG. 20B are diagrams illustrating exemplary display by a display unit of the examination device according to the fourth embodiment of the present disclosure.
Figure 20B:
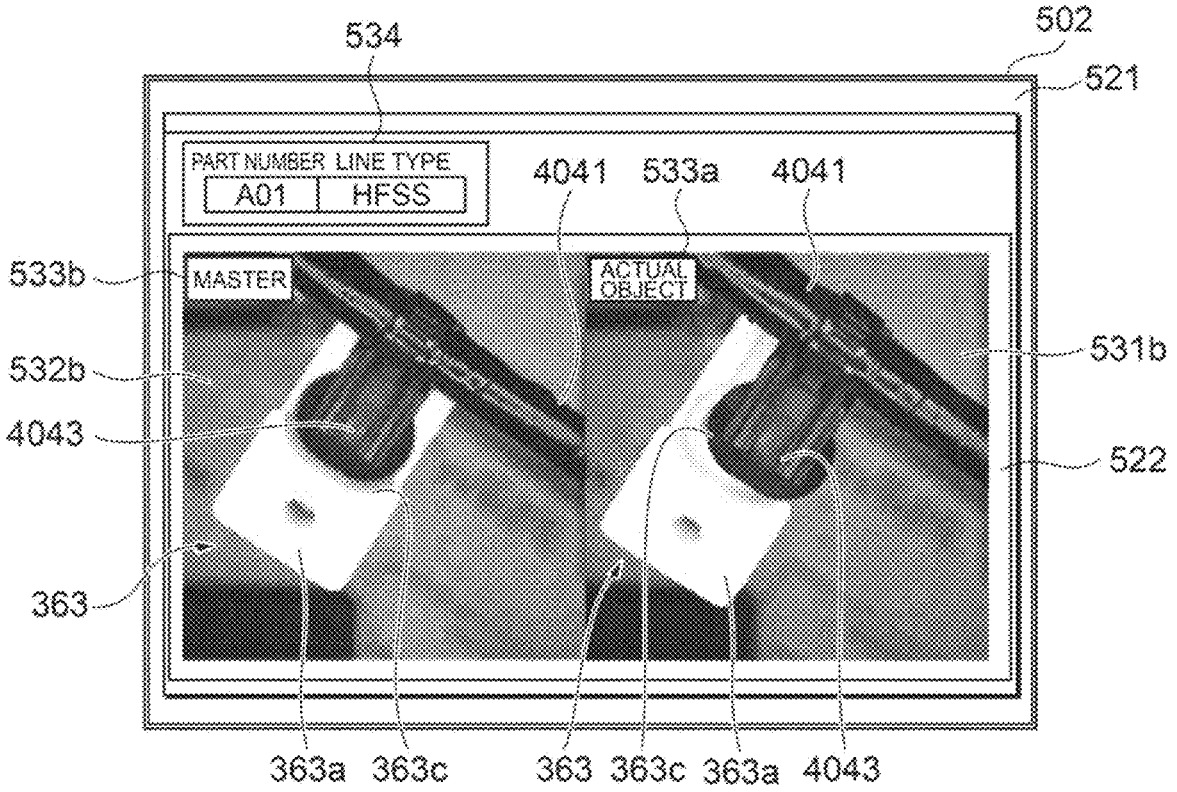

The following describes the configuration of the examination device 405 according to the fourth embodiment of the present disclosure with reference to FIGS. 18 to 20. FIG. 18 is a schematic diagram for description of disposition of image capturing units 51 and 52 of the examination device 405 according to the fourth embodiment of the present disclosure. FIG. 19 is a diagram illustrating the configuration of functional blocks of the examination device 405 according to the fourth embodiment of the present disclosure. FIGS. 20A and 20B are diagrams illustrating exemplary display of a determination image by the examination device 405 according to the fourth embodiment of the present disclosure.

The examination device 405 performs the appearance examination by displaying, on a display unit 502 to be described later, an image (hereinafter also referred to as an examination target image) of an examination target site of the wire harness 1, which is captured by the image capturing units 51 and 52, and a master image (hereinafter also referred to as an examination reference image) as a reference of determination that the examination target site is desirable. Then, a worker visually determines quality by comparing the examination target image and the examination reference image displayed on the display unit 502 and stores a result of the quality determination in a storage region.

As illustrated in FIG. 18, the image capturing units 51 and 52 of the examination device 405 is, for example, a color charge coupled device (CCD) camera configured to capture an image of an examination target site of a manufactured wire harness 1. The image capturing units 51 and 52 are provided in the examination zone 25 as a work zone on the downstream side of the routing zone 22 for wiring the subassembly 11 among the plurality of processing zones 21 to 26 in a production line of the wire harness 1 through which one work board 31 is sequentially moved to the plurality of processing zones 21 to 26, an electrical line bundle (subassembly 11) as a fabrication target being placed on the work board 31 (refer to FIG. 3). Note that the image capturing units 51 and 52 may be provided in a zone other than the examination zone 25.

A plurality of image capturing units 51 and 52 are provided at positions facing the work surface 31*a* of the work board 31, in other words, on the left side C and the right side D of a conveyer 3 (refer to FIG. 3) in the width direction W of the work board 31 and on the upper side E (refer to FIG. 17) in the thickness direction H of the work board 31. Specifically, the image capturing unit 51 includes a plurality (in the embodiment of the present disclosure, four) of image capturing units 51*a* to 51*d* disposed at positions facing a pair of edge parts 30*c* and 30*d* extending in the conveyance direction L in the work board 31 conveyed to the examination zone 25 (refer to FIG. 3) with the work surface 31*a* being in the horizontal state, and a plurality (in the embodiment of the present disclosure, eight) of image capturing units 52*a* to 52*h* disposed at positions facing the work surface 31*a* of the work board 31.

Among image capturing areas S1 to S8 obtained by dividing the region of the work board 31 so that image capturing by the image capturing unit 51 is possible, the image capturing units 51*a* to 51*d* capture images of the image capturing areas S1 to S7 from the left side C and the right side D. Specifically, the image capturing unit 51*a* captures images of the image capturing areas S1 and S2 from the left side C, the image capturing unit 51*b* captures images of the image capturing areas S2 and S3 from the right side D, the image capturing unit 51*c* captures images of the image capturing areas S3 and S4 from the right side D, and the image capturing unit 51*d* captures images of the image capturing areas S5, S6, and S7 from the right side D. In this manner, the image capturing units 51*a* to 51*d* capture images of the image capturing areas S1 to S7 through one or a plurality of image capturing units.

The image capturing units 52*a* to 52*h* capture, from the upper side E (refer to FIG. 17), imaging of the image capturing areas S1 to S8 obtained by dividing the region of the work board 31 so that image capturing is possible by the image capturing unit 51. Specifically, the image capturing unit 52*a* captures an image of the image capturing area S1, the image capturing unit 52*b* captures an image of the image capturing area S2, the image capturing unit 52*c* captures an image of the image capturing area S3, the image capturing unit 52*d* captures an image of the image capturing area S4, the image capturing unit 52*e* captures an image of the image capturing area S5, the image capturing unit 52*f* captures an image of the image capturing area S6, the image capturing unit 52*g* captures an image of an image capturing area S7, and the image capturing unit 52*h* captures an image of an image capturing area S8. In this manner, the image capturing units 52*a* to 52*h* capture an image of each of the image capturing areas S1 to S8 through one image capturing unit.

As illustrated in FIG. 19, an examination server 53 includes, as functional blocks, an appearance examination execution unit 501, the display unit 502, an input unit 503, and a storage unit 504.

Each functional block included in the examination server 53 is achieved through cooperation of hardware resources and software included in the examination server 53. Specifically, the examination server 53 includes, for example, as the hardware resources, a program processing device such as an MCU, a storage device such as a RAM or a ROM, and a peripheral circuit such as a power circuit, an AC/DC converter, a DC/AC converter, a communication circuit, or an input-output interface circuit, and the appearance examination execution unit 501 and the storage unit 504 are achieved by the above-described program processing device controlling the above-described peripheral circuit by executing arithmetic processing in accordance with a computer program stored in the above-described storage device.

Note that the above-described computer program (appearance examination program) may be distributable through a network or may be written in a computer-readable storage medium (non-transitory computer readable medium) such as a CD-ROM and be distributable.

The appearance examination execution unit 501 includes an identification information setting unit 511, an examination condition setting unit 512, an image capturing control unit 513, an image setting unit 514, a display control unit 515, a determination result setting unit 516, and an automatic determination unit 517.

The identification information setting unit 511 is a functional component configured to set the identification information of the wire harness 1. Specifically, when the work board 31 is conveyed from the second finishing zone 24 (refer to FIG. 3) to the examination zone 25 (refer to FIG. 3), inputting of the identification information of the wire harness 1 is received. The identification information of the wire harness 1 is stored as, for example, a two-dimensional code such as a bar code or a QR code (registered trademark), and the two-dimensional code is bonded to an exterior component or the like of the wire harness 1 or the work board 31. Then, for example, the two-dimensional code bonded to the wire harness 1 is scanned by the input unit 503 to cause the identification information setting unit 511 to read the identification information of the wire harness 1, thereby setting the identification information.

The examination condition setting unit 512 is a functional component configured to set an examination target site of the wire harness 1. Specifically, the examination condition setting unit 512 determines examination items based on the identification information of the wire harness 1, which is set by the identification information setting unit 511, and sets an examination condition by determining an examination target site corresponding to the determined examination items.

The image capturing control unit 513 is a functional component configured to control operation of the image capturing units 51 and 52. The image capturing control unit 513 outputs an image capturing start signal for starting image capturing to the image capturing units 51 and 52 through a communication interface (not illustrated). Specifically, when an examination target is set by the examination condition setting unit 512, the image capturing start signal is output to the image capturing units 51 and 52. Note that output of the image capturing start signal may be performed based on an operation input received by the input unit 503. In addition, as for image capturing by the image capturing units 51 and 52, the image capturing may be simultaneously started by all image capturing units 51 and 52 or the image capturing may be individually started.

The image setting unit 514 is a functional component configured to set image data of the examination target image and the examination reference image to be displayed on the display unit 502. Specifically, the image setting unit 514 determines examination target image data of the examination target image and examination reference image data of the examination reference image to be displayed on the display unit 502 based on an examination target site of an examination item for which a worker visually performs examination among the examination items set by the examination condition setting unit 512.

The display control unit 515 is a functional component configured to control the display unit 502 and cause various types of information and images to be displayed on a screen 521 of the display unit 502. Specifically, the display control unit 515 causes the examination target image and the examination reference image to be displayed on the screen 521 of the display unit 502 based on the examination target image data and the examination reference image data set by the image setting unit 514 (refer to FIGS. 20A and 20B). In addition, the display control unit 515 causes an examination target image 531*a* and an examination reference image 532*a* to be displayed side by side in an identical display region on the screen 521 of the display unit 502 so that the images can be compared.

For example, as illustrated in FIG. 20A, when an examination item of whether a tape 4042 bundling the electrical lines 12 is correctly mounted is examined, the display control unit 515 causes the examination target image 531*a* as an image of an examination target site corresponding to the examination item, and the examination reference image 532*a* to be compared with the examination target image 531*a*, to be displayed in a display region 522 on the screen 521 of the display unit 502. Specifically, the display control unit 515 causes an image (examination target image 531*a*) of the tape 4042 captured by the image capturing units 51 and 52 and an image (examination reference image 532*a*) of the tape 4042 to be compared with the examination target image 531*a* to be displayed laterally side by side in the display region 522.

In addition, the display control unit 515 displays, on the screen 521 of the display unit 502 together with the examination target image 531*a* and the examination reference image 532*a*, image information 533*a* of an "actual object" indicating that the examination target image 531*a* is an actual image captured by the image capturing units 51 and 52, and image information 533*b* of a "master" indicating that the examination reference image 532*a* is a master image as a reference for determining an examination target image 531*a* to be desirable. In addition, the display control unit 515 causes wire harness information 534 such as the identification information of the examination target wire harness 1 and information (for example, the line type, the line diameter, and the line color) of each electrical line 12 to be displayed.

In addition, for example, as illustrated in FIG. 20B, when an examination item of whether a housing unit 4043 of a protection member 4041 is correctly housed in a clamp jig 363 is subsequently examined, the display control unit 515 causes an image (examination target image 531*b*) of the holding recess 363*c* of the clamp jig 363 and the housing unit 4043 of the protection member 4041, which is captured by the image capturing units 51 and 52, and an image (examination reference image 532*b*) of the holding recess 363*c* of the clamp jig 363 and the housing unit 4043 of the protection member 4041, which is to be compared with the examination target image 531*b*, to be displayed laterally side by side in the display region 522.

Note that FIGS. 20A and 20B illustrate a case in which an examination target image 531 and an examination reference image 532 are displayed laterally side by side in an identical display region on the screen 521 of the display unit 502 by the display control unit 515 so that the images can be compared with each other, but disposition of the examination target image 531 and the examination reference image 532 may be changed as appropriate. Specifically, when the examination target image and the examination reference image can be compared by displaying the images in an identical display region, the images may be, for example, vertically displayed in an identical display region.

The determination result setting unit 516 is a functional component configured to set a result of quality determination that a worker performs by comparing the examination target image and the examination reference image. Specifically, the determination result setting unit 516 sets a result of the quality determination of the appearance examination based on an input signal when a result of quality determination that the worker performs by comparing the examination target image and the examination reference image is input through the input unit 503.

The automatic determination unit 517 is a functional component configured to perform quality determination of the appearance of the wire harness 1 without visual recognition by a worker. For example, the automatic determination unit 517 performs quality determination of the appearance of the wire harness 1 through image matching of determining similarity in, for example, the colors and shapes of images by comparing the examination target image data and the examination reference image data corresponding to an examination item on which quality determination is performed without visual recognition by a worker among the items to be examined.

The display unit 502 is a device, the display on which is controlled by the display control unit 515 and is configured to display the examination target image and the examination reference image in an identical display region based on the examination target image data captured by the image capturing units 51 and 52 and the examination reference image data as the examination reference of an examination target site. The display unit 502 is, for example, a liquid crystal display or an organic EL display.

The input unit (determination result input unit) 503 is an input instrument, such as a keyboard, a mouse, or a bar code reader, through which operation input is performed by a worker. Specifically, a determination result related to an examination target site of the examination target image displayed on the display unit 502 is input through the input unit 503 by the worker. In addition, the identification information of the wire harness 1 is set at the identification information setting unit 511 upon input at the input unit 503.

The storage unit 504 includes a storage region for executing processing at the appearance examination execution unit 501 and includes, for example, an examination condition data storage region 541, an examination target image data storage region 542, an examination reference image data storage region 543, and a determination data storage region 544.

The examination condition data storage region 541 is a region that stores examination condition data indicating an examination condition set by the examination condition setting unit 512. The examination condition data storage region 541 is, for example, a region that stores the examination condition data based on an input signal received through input at the input unit 503. Specifically, identification information data indicating the identification information of the wire harness 1, examination item data indicating an examination item on which examination is performed based on the identification information data, and examination target site data indicating an examination target site corresponding to the examination item data are stored in the examination condition data storage region 541 in association with an examination condition number.

The examination target image data storage region 542 is a region that stores the examination target image data of the wire harness 1 captured by the image capturing units 51 and 52.

The examination reference image data storage region 543 is a region that stores image examination reference image data in advance based on operation input received through, for example, input at the input unit 503.

The determination data storage region 544 is a region that stores the examination target image data and the examination reference image data displayed on the display unit 502 and determination data based on a determination result input by the input unit 503 in association with each other. Specifically, the identification information data indicating the identification information set by the identification information setting unit 511, the examination item data indicating an examination item, the examination target image data and the examination reference image data corresponding to an examination item, which are set by the image setting unit, and determination result data indicating a result of the quality determination of the appearance examination, which is set by the determination result setting unit, are associated with one another through a determination number and stored as determination data.

[Appearance Examination by Examination Device]

Figure 21:
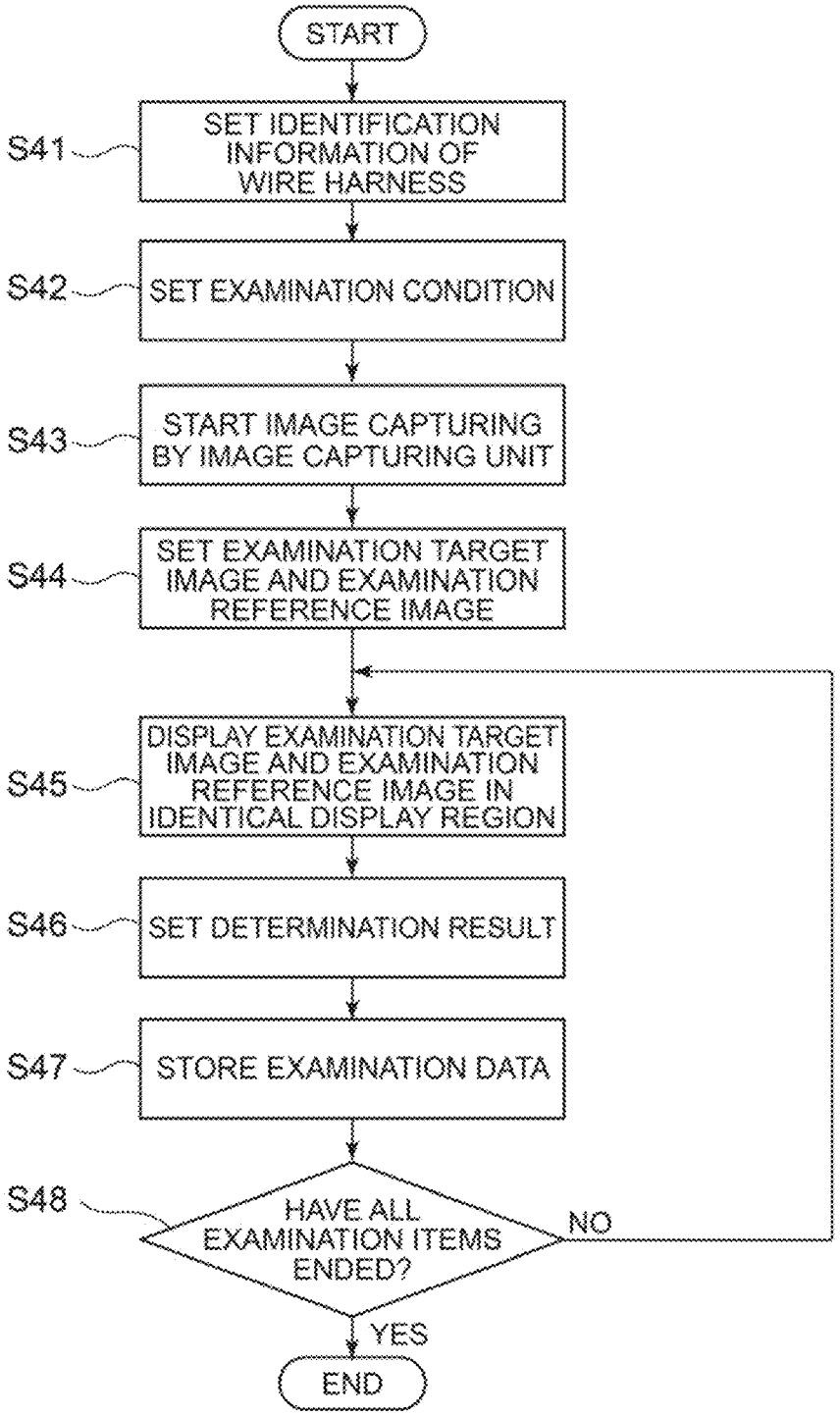
FIG. 21 is a flowchart illustrating flow of appearance examination by an examination device according to another embodiment according to the fourth embodiment of the present disclosure.

The following describes processing of the appearance examination by the examination server 53 of the examination device 405 according to the fourth embodiment of the present disclosure. FIG. 21 is a flowchart illustrating flow of the appearance examination by the examination device 405 according to the fourth embodiment of the present disclosure.

First, the identification information setting unit 511 of the examination server 53 sets the identification information of the wire harness 1 (step S41). For example, when the work board 31 is conveyed from the second finishing zone 24 (refer to FIG. 3) to the examination zone 25 (refer to FIG. 3), an image that prompts inputting of the identification information of the wire harness is displayed on the display unit 502, and, for example, a worker scans a two-dimensional code with the input unit 503 to read and set the identification information of the wire harness 1.

Subsequently, the examination condition setting unit 512 sets an examination condition based on the identification information set at step S41 (step S42). Specifically, as for an examination condition for executing the appearance examination, an examination condition number is specified based on the identification information of the wire harness 1 in the examination condition data storage region 541. Then, an examination item is determined based on the specified examination condition number, and an examination condition is set by determining an examination target site corresponding to the determined examination item.

For example, when the identification information of the wire harness 1, which is set by the identification information setting unit 511 is "A01", the examination condition setting unit 512 specifies an examination condition number "1" in the examination condition data storage region 541. Then, an examination target is set by determining "A01, B03, D07", and the like as examination items based on examination item data associated with the specified examination condition number, and "the tape 4042 bundling the electrical lines 12", "the holding recess 363*c* of the clamp jig 363 and the housing unit 4043 of the protection member 4041", "the connector part 362*b* of the connector jig 362 and the connector 13", and the like as examination target sites based on the examination target site data.

Subsequently, the image capturing control unit 513 starts image capturing of the wire harness 1 by means of the image capturing units 51 and 52 (step S43). Specifically, the image capturing control unit 513 starts image capturing of the wire harness 1 by outputting an image capturing start signal to the image capturing units 51 and 52. Image data captured by the image capturing units 51 and 52 is transmitted from the image capturing units 51 and 52 to the examination server 53 through the communication interface (not illustrated) and stored in the examination target image data storage region 542.

Subsequently, the image setting unit 514 sets the examination target image and the examination reference image (step S44). Specifically, the image setting unit 514 sets the examination target image data in the examination target image data storage region 542 based on an examination target site set by the examination condition setting unit 512. For example, when the examination target site is set to be "the tape 4042" by the examination condition setting unit 512, image data of "the tape 4042" is determined in the examination target image data storage region 542 and set as the examination target image data.

In addition, the image setting unit 514 sets the examination reference image data in the examination reference image data storage region 543 based on an examination target site set by the examination condition setting unit 512. For example, when the examination target site is set to be "the tape 4042" by the examination condition setting unit 512, image data of "the tape 4042" is determined in the examination reference image data storage region 543 and set as the examination reference image data.

Subsequently, the display control unit 515 displays the examination target image and the examination reference image on the screen 521 of the display unit 502 (step S45). Specifically, the display control unit 515 displays the examination target image and the examination reference image in an identical display region on the screen 521 of the display unit 502 based on the examination target image data and the examination reference image data set by the image setting unit 514.

Subsequently, when the worker compares the examination target image and the examination reference image and a result of quality determination is input through the input unit 503, the determination result setting unit 516 sets determination result data indicating the input result of quality determination (step S46).

Subsequently, the appearance examination execution unit 501 stores examination data in the determination data storage region 544 (step S47). Specifically, the identification information data and the examination item data set at step S41, the examination target image data and the examination reference image data set at step S44, the determination result data indicating the result of the quality determination of the appearance examination, which is set at step S46 are associated with one another through a determination number and stored as determination data in the determination data storage region 544.

Subsequently, the appearance examination execution unit 501 determines whether examination of all examination items has ended (step S48). Specifically, whether the determination result data for all examination items of the examination condition set at step S42 is stored in the determination data storage region 544 is determined.

When examination has not ended for all examination items, in other words, when the examination target image and the examination reference image are displayed on the display unit 502 based on not all examination target sites of examination items for which the worker performs visual examination, return is made to the processing at step S45. Then, the processing at steps S45 to S48 is repeated until determination result data for the remaining examination items is stored in the determination data storage region 544. When examination of all examination items has ended, the processing of the appearance examination is ended.

Note that processing of automatically carrying out, by means of the automatic determination unit 517, the appearance examination of quality determination of the appearance of the wire harness 1 without visual recognition by the worker may be executed after step S47. In addition, the processing of performing the appearance examination by the automatic determination unit 517 may be executed while the processing at steps S43 to S48 is executed.

In this manner, in the examination device 405, the image capturing units 51 and 52 is provided in the examination zone 25 as a work zone on the downstream side of the routing zone 22 in which the subassembly 11 is wired among the plurality of processing zones 21 to 26 in which manufacturing processing on the wire harness 1 is performed. Accordingly, it is possible to perform the appearance examination in the manufacturing area (processing zones 21 to 26) for the wire harness 1, and thus it is possible to improve manufacturing efficiency. In other words, since the image capturing units 51 and 52 are provided on the production line (in-line) of the wire harness 1, it is not necessary to move the wire harness 1 to another examination area to perform the appearance examination.

In addition, the examination target image and the examination reference image are displayed in an identical display region on the screen 521 of the display unit 502. Specifically, since the examination target image (actual image) and the examination reference image (master image) are displayed on the display unit 502 so that the images can be compared, the worker can easily perform the quality determination of the wire harness 1. Accordingly, it is easy not only for an experienced worker but also for an unexperienced worker to determine the quality of an examination target site, and thus it is possible to improve operational efficiency in the appearance examination of the wire harness 1.

Then, the examination target image data and the examination reference image data displayed on the display unit 502 and determination result data based on a determination result input by the input unit 503 are stored in the determination data storage region 544 in association with one another. Thus, determination data stored in the determination data storage region 544 can be utilized as data for automatic determination by the automatic determination unit 517.

Specifically, for example, it is possible to determine, from among examination target image data stored in the determination data storage region 544, examination target image data approximate to examination target image data newly captured by the image capturing units 51 and 52. Then, quality determination of new examination target image data may be performed based on determination result data of the determined examination target image data.

In addition, the data pair of examination target image data and determination result data associated and stored in the determination data storage region 544 can be utilized as learning data (sample data) for artificial intelligence. Specifically, with the examination device 405, the above-described data pair is accumulated each time the appearance examination of the wire harness 1 is performed, and thus it is possible to produce a learning model by using a large amount of accumulated data pairs and to automatically perform failure determination of an examination target site by using the learning model in the future.

In addition, the image capturing units 51 and 52 are disposed at a position facing the pair of edge parts 30*c* and 30*d* extending in the conveyance direction L in the work board 31 conveyed to the work zone of the examination zone 25 with the work surface 31*a* being in the horizontal state and at a position facing the work surface 31*a* of the work board 31. Thus, when an image of the work board 31 in the state of being tilted or vertical to the horizontal line is to be captured, the image capturing units 51 and 52 need to be disposed at positions where an image of a worker working on the work board 31 is not captured in order to capture an image of the work surface 31*a*, and there is a chance that the image capturing units 51 and 52 cannot be freely disposed. However, since images of the work board 31 conveyed to the examination zone 25 with the work surface 31*a* being in the horizontal state are captured by the image capturing units 51 and 52, it is possible to improve the freedom of disposition of the image capturing units 51 and 52. Note that the image capturing units 51 and 52 may be installed to be movable. When the image capturing units 51 and 52 are movable, it is possible to, for example, more effectively prevent interference with the worker and reduce the number of image capturing units 51 and 52.

Then, an examination item is determined based on the identification information of the wire harness 1, and an examination condition is set by determining examination target site corresponding to the determined examination item. Thus, it is possible to perform the appearance examination with an examination item in accordance with the type of the wire harness 1.

Other Embodiments

Note that, in the fourth embodiment described above, a case in which the appearance examination of the wire harness 1 is performed by capturing an image of the work board 31 with the image capturing units 51 and 52 provided in the examination zone 25 is described, but the conduction examination of examining whether a connection between the connectors 13 of the wire harness 1 is correct based on the existence of conduction may be performed after the appearance examination.

In addition, in the fourth embodiment described above, a case in which the image capturing units 51*a* to 51*d* of the examination device 405 are disposed at positions facing the pair of edge parts 30*c* and 30*d* is described, but the image capturing units 51*a* to 51*d* may be disposed at a position facing the edge part 30*c* or 30*d* as one of the pair of edge parts 30*c* and 30*d*. In addition, it is possible to change the number of image capturing units 51 and 52 as appropriate depending on the type of the work board 31. In addition, it is possible to change, as appropriate, the range and number of image capturing areas S1 to S8 in which the image capturing units 51 and 52 perform image capturing.

In addition, in the fourth embodiment described above, an example in which the examination device 405 includes the image capturing units 51 and 52 and the examination server 53 is described, but the image capturing units 51 and 52 may have at least some of the functions of the examination server 53.

Although the fourth embodiment of the present disclosure is described above, the present disclosure is not limited to the examination device 405 according to the fourth embodiment of the present disclosure described above but includes any aspect included in the concept and claims of the present disclosure. In addition, configurations may be selectively combined as appropriate to achieve at least part of the above-described problems and effects.

The following describes a fifth embodiment of the present disclosure.

The fifth embodiment of the present disclosure relates to a work board for wire harness manufacturing by using a subassembly including a plurality of electrical lines to each of which a connection component such as a connector or a connection terminal is attached.

In the manufacturing process of a wire harness in which connectors are connected to both end parts and middle parts of a plurality of electrical lines, whether a wire harness as a completed product having ended all manufacturing processes satisfies requested specifications is examined before packaging of the wire harness.

In this examination process, for example, the conduction examination for examining whether connection between connectors of the wire harness is correct based on the existence of conduction, and the appearance examination for examining the kind, attachment state, damage existence, and the like of an exterior component of the wire harness are performed.

The conduction examination among these examinations needs to examine conduction and opening between terminals of all connectors to reliably find connection failure between an electrical line and a terminal of a connector or the like at assembly.

Typically, an automated examination technology using a computer is used in the conduction examination of a wire harness. The automated examination technology is a technology of comparing an input-output result of an electric signal for each electrical line of an examination target wire harness and correct connection information of the examination target wire harness and determining whether connection between connector pins is appropriate based on the comparison result (refer to Japanese Patent Laid-open No. 2014-206394, for example).

An examination device configured to examine conduction between connectors of a wire harness in Japanese Patent Laid-open No. 2014-206394 is provided with a connector connection unit, and conduction examination is performed by directly connecting a connector of the wire harness with the connector connection unit.

In addition, conduction examination of a wire harness is sometimes performed in an examination area disposed beside a production line of the wire harness in a wire harness manufacturing process (refer to Japanese Patent Laid-open No. 2017-188237, for example).

However, in Japanese Patent Laid-open No. 2014-206394, direct connection is required between a connector of a wire harness and the examination device, and examination of conduction of the wire harness is performed, for example, after assembly and manufacturing of the wire harness on a work board in a wire harness manufacturing system. Thus, there has been demand for rationalization of wire harness manufacturing work by performing examination of a wire harness, which has been conventionally performed after a manufacturing process of the wire harness, in a wire harness manufacturing system (in-line).

Thus, the present disclosure is related to providing a work board configured to enable conduction examination of a wire harness in the manufacturing process of the wire harness.

The fifth embodiment of the present disclosure is a work board for wire harness manufacturing using a subassembly including a plurality of electrical lines to each of which a connection component is attached, the work board being used in a wire harness manufacturing system and including an examination jig connected with an examination wire for conduction examination of the wire harness, and the connection component of the subassembly is connected with the examination jig.

In addition, it is preferable that the examination jig includes a cancellation mechanism configured to cancel a mechanical connection state with the connection component.

It is preferable to further include a plurality of the examination jigs and a terminal mount that is connectable with a device for the conduction examination, and that the examination wire is connected with the terminal mount.

In addition, it is preferable to include a grasping jig configured to grasp the wire harness and that the grasping jig includes a cancellation mechanism configured to cancel a grasping state of the wire harness.

With the work board according to the present disclosure, it is possible to perform the conduction examination of a wire harness in the manufacturing process of the wire harness.

The following describes a preferable embodiment of the present disclosure with reference to the accompanying drawings. Note that the embodiment described below is one example and may have various forms in the scope of the present disclosure.

[Work Board]

As illustrated in FIG. 4, the work board 31 is formed of a plate material of a rectangular shape in plan view, is a table on which the subassembly 11 is spread and disposed along a predetermined routing path and that is used for assembling the wire harness 1 by processing the subassembly 11 in the processing zones 22 to 25, and is also called an ASSY board. The work board 31 is placed on the conveyer 32 in the horizontal state so that the work board 31 is sequentially conveyed along the plurality of processing zones 21 to 26 while the work surface 31*a* as a surface to be provided with manufacturing processing for manufacturing the wire harness 1 is placed on the upper side E.

Note that the "horizontal state" includes a state (hereinafter also referred to as a "substantially horizontal state") of being laid on the circulation conveyer 3 such that approach to the work board 31 in the wire harness manufacturing system 100 from the right and left sides C and D is allowed to perform work processing.

As illustrated in FIG. 5, the predetermined routing path (not illustrated) of the subassembly 11 is printed on the work surface 31*a* of the work board 31, as a surface on which the subassembly 11 is placed. The work board 31 includes the plurality of jigs 36 configured to hold the subassembly 11 being placed along the routing path, and the integrated terminal mount (terminal mount) 37.

Each jig 36 is erected on the work surface 31*a*. The jigs 36 includes the receiving jig 361 on which the subassembly 11 is hung by the routing processing device 4, the connector jig (examination jig) 362 electrically connected with the corresponding connector 13, the clamp jig (grasping jig) 363 configured to grasp the wire harness 1 at the corresponding exterior component 14, and the support jig 364 configured to support the wire harness 1 in the corresponding electrical line 12. The receiving jig 361 and the connector jig 362 are disposed close to each other. Note that the number of the jigs 361 to 364 is not particularly limited. In addition, the receiving jig 361 and the connector jig 362 may be disposed separately from each other as appropriate as long as the correspondence relation between the receiving jig 361 and the connector jig 362 is clear and the shape of the wire harness 1 to be manufactured does not change when the connector 13 is attached to the connector jig 362 and no excessive tensile load is applied to each electrical line 12.

The receiving jig 361 includes the bar member 361*a* and the two leg parts 361*b* of a two-fork shape. The bar member 361*a* is attached to the work surface 31*a* at one end and includes the leg parts 361*b* at the other end, and the subassembly 11 is hung at the leg parts 361*b*. The leg parts 361*b* of the two-fork shape contact each other to form a closed state of an annular shape at a leading end part on a side opposite to the bar member 361*a* side, and the leg parts 361*b* are formed to be elastically opened and closed.

As illustrated in FIG. 6, the connector jig 362 is provided near the receiving jig 361. The connector jig 362 includes the bar member 362*a* and the connector part 362*b* of a substantially rectangular parallelepiped shape. The bar member 362*a* is attached to the work surface 31*a* at one end and includes the connector part 362*b* at the other end, and the connector 13 of the subassembly 11 is mechanically and electrically connected at the connector part 362*b*. The connector part 362*b* includes the engagement port part 362*c* that has a concave shape and is engaged with the connector 13 of the subassembly 11, the lock click 362*d* configured to lock the connector 13 housed in the engagement port part 362*c*, the cancellation mechanism (not illustrated), and the examination wire 362*e*.

The engagement port part 362*c* is formed at one surface of the connector part 362*b* in the direction along the work surface 31*a* of the work board 31 in a state in which the connector jig 362 is attached to the work board 31. A plurality of conduction pins (not illustrated) that are electrically connected with the connector 13 are provided inside the engagement port part 362*c*.

The lock click 362*d* is provided at a peripheral part of the engagement port part 362*c* and configured to freely protrude and retract relative to the engagement port part 362*c*. In a state in which the cancellation mechanism does not act, the leading end of the lock click 362*d* overlaps with the engagement port part 362*c* so that the lock click 362*d* is engaged with the connector 13 housed in the engagement port part 362*c* and prevents removal of the connector 13 from the engagement port part 362*c*. In a state in which the cancellation mechanism acts, the leading end part of the lock click 362*d* does not overlap with the engagement port part 362*c*.

The cancellation mechanism includes an air cylinder (not illustrated) configured to cancel the engagement state of the lock click 362*d* and the connector 13. The air cylinder has one end directly or indirectly coupled with the lock click 362*d* and has the other end connected with, for example, a compressor configured to supply compression air on the back surface 31*b* side as the surface of the work surface 31*a* on the back side.

The examination wire 362*e* is connected with each conduction pin on a side of the connector part 362*b*, which is opposite to a side on which the connector 13 is inserted. The examination wire 362*e* from the connector jig 362 is connected with the integrated terminal mount 37 to be described later.

As illustrated in FIG. 7, the clamp jig 363 includes the bar member 363*a* and the clamp member 363*b*. The bar member 363*a* is attached to the work surface 31*a* at one end and includes the clamp member 363*b* at the other end, and the exterior component 14 is grasped at the clamp member 363*b*. The clamp member 363*b* includes the holding recess 363*c* configured to hold the exterior component 14, the cover part 363*d* that is movable and covers the holding recess 363*c*, and the cancellation mechanism (not illustrated) configured to allow the cover part 363*d* to move.

The holding recess 363*c* is opened, at one surface of the clamp member 363*b*, toward a side opposite to the work surface 31*a* in the direction along the work surface 31*a* of the work board 31. The cover part 363*d* is configured to be slidable in the direction along the work surface 31*a* of the work board 31, covers the holding recess 363*c* in a state in which the cancellation mechanism does not act in a state in which the cancellation mechanism acts, and opens the holding recess 363*c* toward the side opposite to the work surface 31*a*.

The cancellation mechanism includes an air cylinder (not illustrated) configured to cause the cover part 363*d* to move from a position at which the holding recess 363*c* is covered to a position at which the holding recess 363*c* is opened. The air cylinder has one end directly or indirectly coupled with the cover part 363*d* and has the other end connected with, for example, a compressor configured to supply compression air on the back surface 31*b* side as the surface of the work surface 31*a* on the back side. Note that the compressors to which the air cylinder of the clamp jig 363 and the air cylinder of the connector jig 362 are connected may be the same compressor or different compressors.

The support jig 364 includes the bar member 364*a* and the two leg parts 364*b* of a two-fork shape. The bar member 362*a* is attached to the work surface 31*a* at one end and includes the leg parts 364*b* at the other end, and the electrical line 12 is hung at the leg parts 364*b*.

As illustrated in FIG. 5, the work board 31 includes the integrated terminal mount 37 on the work surface 31*a* side. The examination wire 362*e* of the connector jig 362 is connected with the integrated terminal mount 37. The integrated terminal mount 37 includes an engagement target unit (not illustrated) and is connectable with the conduction examination device 6 at the engagement target unit.

The work board 31 includes, near the bar member 362*a* of the connector jig 362, the hole 31*c* formed to penetrate in the thickness direction of the work board 31. The examination wire 362*e* connected with the connector part 362*b* of the connector jig 362 is routed to the back surface 31*b* side through the hole 31*c*. In addition, the work board 31 includes, near the integrated terminal mount 37, a hole 31*d* formed to penetrate in the thickness direction of the work board 31. The examination wire 362*e* routed to the back surface 31*b* side is routed to the work surface 31*a* side through the hole 31*d* and connected with the integrated terminal mount 37.

[Conduction Examination Device]

The conduction examination device 6 is a device configured to examine the conduction state of the wire harness 1 manufactured in the second finishing zone 24. The conduction examination device 6 is provided on the left side C or the right side D of the circulation conveyer 3 in the examination zone 25. As illustrated in FIG. 12, the conduction examination device 6 includes the input-output unit (connection engagement unit) 3024 electrically connected with the engagement target unit of the integrated terminal mount 37 of the work board 31. The input-output unit 3024 is automatically connected with the integrated terminal mount 37.

The input-output unit 3024 is a functional component for electrically connecting an internal circuit (not illustrated) of the conduction examination device 6 and the wire harness 1 on the work board 31. For example, the input-output unit 3024 includes a plurality of connector pins 241 and the signal wire 242 for electrically connecting each connector pin 241 and the internal circuit of the conduction examination device 6. For example, the input-output unit 3024 and each terminal of the integrated terminal mount 37 are electrically connected with each other by engaging the connector pins 241 of the input-output unit 3024 with the integrated terminal mount 37. Accordingly, the examination target wire harness 1 connected with a connector jig 36 of the work board 31 and the internal circuit of the conduction examination device 6 are electrically connected to each other.

[Manufacturing Process of Wire Harness]

The following describes a manufacturing process of the wire harness 1 (refer to FIG. 1) in the wire harness manufacturing system 100 with reference to FIGS. 3 and 4. A manufacturing method of the wire harness 1 by the wire harness manufacturing system 100 is performed on the circulation conveyer 3 and includes at least a process of standing up the work board 31 being laid down in the substantially horizontal state and placing the subassembly 11 (refer to FIG. 2) onto the work board 31 in the stand-up state, a process of performing image examination of the wire harness 1, and a process of performing conduction examination of the wire harness 1.

As illustrated in FIGS. 3 and 4, the work boards 31 in a number corresponding to the number of the processing zones 21 to 26 are disposed on the circulation conveyer 3 in the wire harness manufacturing system 100 and simultaneously provided with respective pieces of manufacturing processing in the processing zones 21 to 26. The circulation conveyer 3 is intermittently provided with drive control by the drive unit and the control unit so that the work boards 31 stay in the processing zones 21 to 26 for a predetermined time by the control unit of the conveyance device 3. Note that the following describes the manufacturing processing in the processing zones 21 to 26 in the order of the processing zones 21 to 26 for the objective of description.

First, in the supply zone 21, the work board 31 on which no subassembly 11 is mounted is supplied. The process of manufacturing the wire harness 1 in the wire harness manufacturing system 100 starts at the supply zone 21. The work board 31 is conveyed while being laid down in the substantially horizontal state and the work surface 31*a* of the work board 31 faces towards the upper side E in the up-down direction H. When the supply of the work board 31 is completed, a signal indicating the completion of the work is transmitted from the supply zone 21 to the control unit.

When the work board 31 is conveyed from the supply zone 21 to the routing zone 22 by the circulation conveyer 3, the raiser 33 is at a position at which the frame 331 (refer to FIG. 8) does not interfere with the conveyance of the work board 31. Specifically, the frame 331 of the raiser 33 is slightly standing up on the left side C in the width direction W. After the work board 31 is conveyed to the routing zone 22, the frame 331 of the raiser 33 rotates about the drive shaft 333 (refer to FIG. 8) so as to move closer to the work board 31.

The frame 331 rotates until the work board 31 is housed in the space 331*c* (refer to FIG. 8) (until the frame 331 is positioned in a substantially horizontal state), and the grasping body 332 (refer to FIG. 8) partially grasps an outer edge part extending in the conveyance direction L in the work board 31. Once the work board 31 is grasped by the grasping body 332, the work board 31 is lifted up from one edge part of the work board 31 extending in the conveyance direction L of the work board 31, for example, an edge part on the right side D in the width direction W toward the upper side E in the up-down direction H and the left side C in the width direction W. Accordingly, the raiser 33 sets the work board 31 to the stand-up state in which the work board 31 stands up by 90° approximately from the substantially horizontal state. In the stand-up state, the work surface 31*a* of the work board 31 faces toward the left side C.

Simultaneously in parallel with the above-described work by the raiser 33, the routing processing device 4 moves to acquire the subassembly 11 from the subassembly assembly device 200. In the routing processing device 4, each slide member 44 (refer to FIG. 9) configured to grasp the connector 13 of the subassembly 11 (refer to FIGS. 1 and 2) protrudes from the holding member 43 (refer to FIG. 9). Once the grasping body 45 (refer to FIG. 9) of each slide member 44 grasps the corresponding connector 13 of the subassembly 11 from the subassembly assembly device 200, the slide members 44 other than the slide member 44 grasping a connector 13 to be mounted onto the work board 31 first retract to the holding member 43 side.

The body part 41 moves closer to the work board 31 in the stand-up state, and the slide member 44 protruding from the holding member 43 hangs the connector 13 of the subassembly 11 onto a predetermined receiving jig 361 (refer to FIG. 5) provided to the work surface 31*a* of the work board 31. After the grasping body 45 releases the connector 13, the slide member 44 retracts to the holding member 43 side, and the slide member 44 grasping a connector 13 to be subsequently hung on the receiving jig 361 protrudes from the holding member 43. The routing processing device 4 spreads the connector 13 of the subassembly 11 on the work board 31 (forms a multifurcating shape) by attaching each connector 13 of the subassembly 11 to an individual receiving jig 361 in accordance with the routing path on the work board 31.

After the routing work of the subassembly 11 onto the work surface 31*a* of the work board 31 by the routing processing device 4 ends, the raiser 33 lays down the frame 331 until the work board 31 is in the substantially horizontal state. Then, the grasping body 332 of the frame 331 releases the work board 31, and the work board 31 is placed on the downstream conveyance unit 321 of the circulation conveyer 3 again. Once the work board 31 is laid down in the substantially horizontal state again, a signal indicating the completion of the work is transmitted from the routing zone 22 to the control unit. Note that, upon conveyance of the work board 31 from the routing zone 22 to the first finishing zone 23, the frame 331 has moved to a position where the frame 331 does not interfere with the conveyance of the work board 31.

In the first finishing zone 23, a worker removes the connector 13 of the subassembly 11 from the receiving jig 361 and inserts the connector 13 into the engagement port part 362*c* (refer to FIG. 6) of the connector part 362*b* of the corresponding connector jig 362. As the connector 13 is inserted into the engagement port part 362*c* of the connector jig 362, the lock click 362*d* (refer to FIG. 6) is pressed down to the work surface 31*a* side of the work board 31. Once a mechanical connection state of the connector 13 and the connector jig 362 is achieved, the lock click 362*d* returns to the original position, in other words, a position where the leading end overlaps with the engagement port part 362*c*. Accordingly, the lock click 362*d* engages with the connector 13 from a rear end part side in an insertion direction into the engagement port part 362*c*.

In addition, in the first finishing zone 23, the electrical lines 12 of the subassembly 11 wired on the work board 31 are twisted together, and the electrical lines 12 are placed between the leg parts 364*b* (refer to FIG. 5) of the support jig 364. Once the work in the first finishing zone 23 is completed, a signal indicating the completion of the work is transmitted from the first finishing zone 23 to the control unit. Note that the work in the first finishing zone 23 may be performed by using a dedicated device, not by a worker.

In the second finishing zone 24, a worker finishes the subassembly 11 into the wire harness 1 by mounting, for example, the exterior component 14 on the electrical lines 12 twisted together and bundling the electrical lines 12. In the second finishing zone 24, the worker slides the cover part 363*d* (refer to FIG. 7) of the clamp jig 363 and houses the exterior component 14 in the holding recess 363*c* (refer to FIG. 7). The cover part 363*d* automatically returns to a position where the cover part 363*d* covers the holding recess 363*c*.

In addition, in the second finishing zone 24, for example, a part number label such as a bar code or a QR code (registered trademark) is attached to the wire harness 1 by the worker. Examination contents to be executed in the examination zone 25 are transmitted to the image capturing device 5 and the conduction examination device 6 by reading the part number label. Note that the attachment of the part number label to the wire harness 1 may be performed in the first finishing zone 23.

Once the work in the second finishing zone 24 is completed, a signal indicating the completion of the work is transmitted from the second finishing zone 24 to the control unit. Note that the work in the second finishing zone 24 may be performed by using a dedicated device, not by a worker.

In the examination zone 25, first, image examination of the wire harness 1 is performed. Specifically, the image capturing device 5 captures an image of the appearance of the wire harness 1, for example, the appearance of a particular exterior component 14 from the upper side E, the left side C, and the right side D. The image captured by the image capturing device 5 is displayed on the display device 15. Whether the displayed image of the wire harness 1 satisfies a predetermined reference is determined by a worker. Note that this image determination work may be performed by using an AI or the like, not by a worker. Note that the image capturing device 5 may be installed to be movable. When the image capturing device 5 is movable, it is possible to, for example, more effectively prevent interference with the worker and reduce the number of image capturing devices 5.

After the image examination ends, conduction examination of the wire harness 1 is performed. The conduction examination is performed when the connector pins 241 of the input-output unit 3024 of the conduction examination device 6 are automatically engaged with the engagement target unit of the integrated terminal mount 37 of the work board 31 as illustrated in FIG. 12.

Once the image examination and the conduction examination are completed, a signal indicating the completion of the work is transmitted from the examination zone 25 to the control unit. Note that connection between the connection engagement unit of the conduction examination device 6 and the integrated terminal mount 37 may be performed by the worker. In addition, the order of the image examination and the conduction examination is not particularly limited, but the image examination may be performed after the conduction examination, or the image examination and the conduction examination may be simultaneously performed.

In the conveying-out zone 26, the connection state of each connector 13 of the wire harness 1 and the connector part 362*b* of the corresponding connector jig 362 of the work board 31 and the grasping state of each exterior component 14 of the wire harness 1 by the clamp member 363*b* (refer to FIG. 7) of the clamp jig 363 are canceled first.

Specifically, the other ends of the air cylinders of the connector jig 362 and the clamp jig 363 are connected with compression air. As compression air is supplied from the compressor to the air cylinder of the cancellation mechanism of the connector jig 362, the lock click 362*d* moves down to the work surface 31*a* side of the work board 31, and in addition, the cover part 363*d* slides from the holding recess 363*c* and the grasping state of the exterior component 14 of the wire harness 1 is canceled as compression air is supplied from the compressor to the air cylinder of the cancellation mechanism of the clamp jig 363. Note that the cancellation of the wire harness 1 from the connector jig 362 and the clamp jig 363 may be simultaneously performed, or orders may be allocated to the connector jig 362 and the clamp jig 363 and the cancellation may be performed based on the orders.

As the lock click 362*d* moves down to the work surface 31*a* side, the engagement state (mechanical connection state) of the lock click 362*d* and the connector 13 is canceled, and the connector 13 of the wire harness 1 is removed from the engagement port part 362*c* of the connector jig 362 by the own weight of the wire harness 1. In addition, once the grasping state of the exterior component 14 of the wire harness 1 is canceled, the exterior component 14 of the wire harness 1 is removed from the clamp member 363*b* of the clamp jig 363 by the own weight of the wire harness 1. Accordingly, the wire harness 1 falls onto the work surface 31*a*. Then, the work board 31 is tilted from the substantially horizontal state to one side in the width direction W, for example, the left side C, and the wire harness 1 is conveyed out of the circulation conveyer 3, specifically, the wire harness manufacturing system 100. Once the conveyance-out of the wire harness 1 is completed, a signal indicating the completion of the work is transmitted from the conveying-out zone 26 to the control unit.

Having received the signals each indicating the completion of the work from the processing zones 21 to 26, the control unit transmits a signal to the drive unit. The drive unit having received the signal from the control unit drives the conveyer 32 to convey the work boards 31 in the processing zones 21 to 25 to processing zones disposed on the downstream side B thereof, and, in addition, convey the work board 31 in the processing zone 26 to the upstream conveyance unit 323. The conveyance of the work boards 31 in the processing zones 21 to 26 is performed on a condition that all above-described manufacturing processing in the processing zones 21 to 26 is completed. In other words, the conveyance of the work boards 31 in the conveyance direction L is not performed when even one manufacturing processing is not completed among the processing zones 21 to 26.

All above-described manufacturing processing in the processing zones 21 to 26 is performed simultaneously in parallel, and the process of manufacturing the wire harness 1 is completed through all the processing zones 21 to 26. The wire harness 1 thus conveyed out is conveyed to the next process of the manufacturing process, for example, a packaging process.

Note that the work board 31 from which the wire harness 1 has been conveyed out is conveyed from the downstream conveyance unit 321 to the lower side F by the move-down conveyance unit 322, then to the upstream side A by the upstream conveyance unit 323, and then finally to the upper side E by the move-up conveyance unit 324, and returned to the downstream conveyance unit 321.

<Characteristics of Work Board>

In a conventional wire harness manufacturing system, a manufactured wire harness is moved to an examination area provided at a place separated from a wire harness manufacturing area, and is subjected to, for example, conduction examination separately. However, since the work board 31 as described above includes the connector jig 362 and the examination wire 362*e* for conduction examination of the wire harness 1 as illustrated in FIG. 6, it is possible to perform the conduction examination of the wire harness 1 on an identical line (in-line) in the wire harness manufacturing system 100 and significantly improve operational efficiency.

As illustrated in FIGS. 5 and 6, the plurality of connector jigs 362 are provided to the work board 31, and the examination wire 362*e* extending each connector jig 362 is connected to the common integrated terminal mount 37. Thus, it is possible to extremely easily perform conduction examination among the plurality of connectors 13 of the wire harness 1 on the work board 31 only by connecting the connector pins 241 of the conduction examination device 6 with the engagement target unit of the integrated terminal mount 37.

In the work board 31, the connector jig 362 includes an air cylinder as the cancellation mechanism configured to cancel the connection state with the wire harness 1, the clamp jig 363 includes an air cylinder as the cancellation mechanism configured to cancel the grasping state of the wire harness 1, and each cancellation mechanism is connectable with a compressor configured to supply compression air. Thus, it is possible to easily and rapidly remove the wire harness 1 from the connector jig 362 and the clamp jig 363 by supplying compression air from the compressor to each air cylinder.

<Others>

Note that the present disclosure is not limited to the above-described fifth embodiment, but may be modified as appropriate without departing from the scope of the present disclosure. For example, the work board 31 may be changed as appropriate to the work board 31 having the corresponding routing path and size in accordance with the type of the wire harness 1 to be manufactured, and is placed at the conveyer 32 of the circulation conveyer 3.

In the above-described fifth embodiment, the circulation conveyer 3 intermittently performs conveyance of the work board 31 by the conveyer 32 but may continuously perform the conveyance. In addition, the conveyance speed of the work board 31 may be variably adjusted. Note that the conveyer 32 may be provided across all processing zones 21 to 26, or the conveyer 32 corresponding to each of the processing zones 21 to 26 may be provided as long as conveyance of the work board 31 between the processing zones 21 to 26 is not interfered with. When the conveyer 32 is individually provided to each of the processing zones 21 to 26, there may be a conveyer 32 on which no work board 31 is placed (a free space may be temporarily provided between the work boards 31 on the circulation conveyer 3). Accordingly, it is possible to have a time difference between intermittent operations of the work boards 31, and in addition, it is possible to variably adjust the conveyance speed for each work board 31.

In the above-described fifth embodiment, the work board 31 is conveyed in the horizontal state with the work surface 31*a* facing towards the upper side E, but may be conveyed so that the work surface 31*a* is parallel to the installation surface of the circulation conveyer 3.

In the above-described fifth embodiment, the work board 31 is conveyed on the conveyer 32 in the substantially horizontal state in the circulation conveyer 3, but the conveyer 32 may convey the work board 31 in an obliquely stand-up state from the substantially horizontal state.

In the above-described fifth embodiment, the cancellation mechanisms of the connector jig 362 and the clamp jig 363 are each an air cylinder but may be a solenoid or piezoelectric actuator.

In the above-described fifth embodiment, the connector part 362*b* of the connector jig 362 and the connector 13 of the subassembly 11 hold the engagement state with each other through the lock click 362*d*, but a multi-coupler may be provided to the engagement port part 362*c* of the connector part 362*b* so that the connector 13 is fitted to the multi-coupler. When the connector 13 is removed from the multi-coupler, the air cylinder presses the multi-coupler.

In the above-described fifth embodiment, the first and second finishing zones 23 and 24 are independent processing zones but may be integrated with each other as one processing zone.

In the above-described fifth embodiment, the upstream conveyance unit 323 is provided on the lower side F of the downstream conveyance unit 321, but may be provided on the upper side E of the downstream conveyance unit 321. In addition, the circulation conveyer 3 may be a conveyance device formed in a loop shape and configured to convey the work board 31 on an identical plane in the horizontal direction. In addition, the downstream conveyance unit 321 and the upstream conveyance unit 323 may extend straight, or, for example, may extend while bending with a meandering bend halfway through them.

The work surface 31*a* or the back surface 31*b* of the work board 31 in the above-described fifth embodiment may include a test-check wire harness that is connectable to the conduction examination device 6. In this case, the test-check wire harness is electrically connectable with the integrated terminal mount 37.

What is claimed is:

1. A wire harness manufacturing system, the wire harness manufacturing system including a plurality of processing zones, being configured to manufacture a wire harness by using a subassembly including a plurality of electrical lines to each of which a connection component is attached, and including a circulation conveyance device, the circulation conveyance device including:

work boards in a number at least corresponding to the number of the plurality of processing zones;

a raiser configured to set each work board to a stand-up state in which one of edge parts extending in a conveyance direction of each work board is positioned on an upper side of the other edge part in the work board, and to set each work board from the stand-up state back to a horizontal state, wherein a circulation conveyer configured to sequentially convey each work board in the horizontal state from an upstream side to a downstream side on a downstream conveyance path along the plurality of processing zones and then return each work board from the downstream side to the upstream side on an upstream conveyance path, wherein the wire harness manufacturing system further includes a routing processing device configured to place the subassembly on to the work board, wherein the routing processing device comprises:

a body part capable of freely moving relative to the work board along a shape in which the wire harness is to be manufactured by the wire harness manufacturing system; and a mounting unit attached to a leading end of the body part and configured to receive the subassembly from a supply device that supplies the subassembly and place each connection component of the subassembly at a position on the work board along the shape of the wire harness, wherein the mounting unit includes a slide member attached to a holding member configured to slide in a transverse direction to the conveyance direction and a grasping body configured to grasp the connection component and protrude and retract the connection component relative to the work board.

2. The wire harness manufacturing system according to claim 1, wherein the body part is a multi-axis multi-joint type robot.

3. The wire harness manufacturing system according to claim 1, wherein the raiser is provided at a position corresponding to the routing processing device.

4. The wire harness manufacturing system according to claim 1, further comprising an image capturing device provided along the circulation conveyance device and configured to capture an image of a wire harness on each work board.

5. The wire harness manufacturing system according to claim 1, further comprising a conduction examination device provided along the circulation conveyance device and configured to perform conduction examination of a wire harness on each work board.

6. The wire harness manufacturing system according to claim 1, wherein the circulation conveyance device further includes a drive unit configured to drive the circulation conveyer to intermittently convey the work boards.

7. The wire harness manufacturing system according to claim 1, wherein the circulation conveyance device being provided along the plurality of processing zones.

8. The routing processing device according to claim 1 further comprising processor storing a plurality of pieces of path information based on the shape of the wire harness, wherein the processor connected to a multi-axis multi-joint type robot, is configured to move the body part relative to the work board based on the path information.

9. An examination device for the wire harness manufacturing system according to claim 1, the examination device comprising:

a conduction examination execution unit configured to perform conduction examination between connection components included in an examination target wire harness;

a determination unit configured to determine whether connection between connection components included in the examination target wire harness is appropriate based on an examination result of the conduction examination by the conduction examination execution unit; and a display control unit configured to cause a display device to display a determination result by the determination unit, wherein, when a connection component, connection of which is determined to be inappropriate by the determination unit exists, the display control unit causes the display device to display error information including information of the connection component, connection of which is determined to be inappropriate, together with wire harness image information that schematically illustrates the examination target wire harness.

10. The examination device according to claim 9, wherein the display control unit displays the error information over the wire harness image information.

11. The examination device according to claim 10, wherein the display control unit displays, as the error information, image information that schematically illustrates a path between connection components, connection between which is determined to be inappropriate, over the wire harness image information.

12. The examination device according to claim 9, wherein, when a connection component, connection of which is determined to be inappropriate by the determination unit exists, the display control unit causes the display device to display connection component image information that schematically illustrates the connection component, connection of which is determined to be inappropriate, and connection component terminal information indicating a terminal of the connection component, connection of which is determined to be inappropriate.

13. The examination device according to claim 12, wherein the display control unit displays the connection component terminal information over the connection component image information.

14. The examination device according to claim 9, wherein, when a connection component, connection of which is determined to be inappropriate by the determination unit exists, the display control unit causes the display device to display information of a circuit including a terminal of the connection component, connection of which is determined to be inappropriate.

15. The examination device according to claim 9, further comprising a self-check unit configured to determine whether the examination device can normally operate, wherein the self-check unit causes the conduction examination execution unit to execute conduction examination between connection components included in a test-examination wire harness different from the examination target wire harness, and causes the determination unit to determine whether connection between connection components included in the test-examination wire harness is appropriate based on an examination result of the conduction examination of the test-examination wire harness by the conduction examination execution unit, and the self-check unit determines whether the examination device can normally operate based on a determination result of the test-examination wire harness by the determination unit.

16. An examination device used in the wire harness manufacturing system according to claim 1, the examination device comprising:

an image capturing unit configured to capture an image of an examination target site of a wire harness; and a display unit configured to display an examination target image and an examination reference image in an identical display region based on examination target image data captured by the image capturing unit and examination reference image data as an examination reference for the examination target site, wherein, in a production line for the wire harness, through which one work board is sequentially moved to a plurality of work zones with an electrical line bundle as a fabrication target placed on the work board, the image capturing unit is provided in an examination zone downstream of a routing zone for wiring with the electrical line bundle among the plurality of work zones.

17. The examination device according to claim 16, further comprising:

a determination result input unit configured to input a determination result related to the examination target site in the examination target image displayed on the display unit; and a storage unit configured to store the examination target image data and the examination reference image data displayed on the display unit in association with determination result data based on the determination result input by the determination result input unit.

18. The examination device according to claim 16, wherein the image capturing unit is disposed at a position facing at least one of a pair of edge parts extending in a conveyance direction of the work board conveyed to the examination zone with a work surface being in a horizontal state and a position facing the work surface of the work board.

19. The examination device according to claim 16, comprising:

an identification information setting unit configured to set identification information of the wire harness;

an examination condition setting unit configured to set the examination target site of the wire harness based on the identification information set by the identification information setting unit; and an image setting unit configured to determine the examination target image data and the examination reference image data based on the examination target site set by the examination condition setting unit, wherein the display unit displays the examination target image and the examination reference image based on the examination target image data and the examination reference image data determined by the image setting unit.

20. A work board for wire harness manufacturing using a subassembly including a plurality of electrical lines to each of which a connection component is attached, the work board being used in the wire harness manufacturing system according to claim 1 and comprising an examination jig connected with an examination wire for conduction examination of the wire harness, wherein the connection component of the subassembly is connected with the examination jig.

21. The work board for wire harness manufacturing according to claim 20, wherein the examination jig includes a cancellation mechanism configured to cancel a state of mechanical connection with the connection component.

22. The work board for wire harness manufacturing according to claim 20, further comprising:

a plurality of the examination jigs; and a terminal mount integrated with a connection engagement unit is configured to the conduction examination, wherein the conduction examination wire is connected with the terminal mount.

23. The work board for wire harness manufacturing according to claim 20, further comprising a grasping jig configured to grasp the wire harness, wherein the grasping jig includes a cancellation mechanism configured to cancel a grasping state of the wire harness.

* * * * *